US011668541B2

(12) United States Patent
Grob et al.

(10) Patent No.: US 11,668,541 B2
(45) Date of Patent: Jun. 6, 2023

(54) SUPPRESSOR ASSEMBLY FOR A FIREARM

(71) Applicant: KGMADE, LLC, Peachtree Corners, GA (US)

(72) Inventors: Kyle Grob, Woodstock, GA (US); Adam Pini, Woodstock, GA (US)

(73) Assignee: KGMade, LLC, Peachtree Corners, GA (US)

( * ) Notice: Subject to any disclaimer, the term of this patent is extended or adjusted under 35 U.S.C. 154(b) by 0 days.

(21) Appl. No.: 17/716,337

(22) Filed: Apr. 8, 2022

(65) Prior Publication Data

US 2022/0364814 A1 Nov. 17, 2022

Related U.S. Application Data

(63) Continuation of application No. 17/456,688, filed on Nov. 29, 2021.

(60) Provisional application No. 63/119,558, filed on Nov. 30, 2020.

(51) Int. Cl.
*F41A 21/30* (2006.01)

(52) U.S. Cl.
CPC ..... *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS 6,308,609 B1 * 10/2001 Davies ..... F41A 21/30 89/14.4
6,374,718 B1 4/2002 Rescigno et al.
6,575,074 B1 * 6/2003 Gaddini ..... F41A 21/30 89/14.4
8,096,222 B2 1/2012 Silvers
8,100,224 B1 1/2012 Olson
8,474,361 B2 7/2013 Brittingham
8,505,431 B2 8/2013 Hines
(Continued)

FOREIGN PATENT DOCUMENTS

WO 2019/134011 A1 7/2019

OTHER PUBLICATIONS

Maddox "Silencers—Monolithic Core Baffles Vs Stacked Baffles", Silencer Central (Aug. 15, 2013) (6 pp.).
(Continued)

*Primary Examiner* — Joshua E Freeman
*Assistant Examiner* — Benjamin S Gomberg
(74) *Attorney, Agent, or Firm* — Fox Rothschild LLP

(57) ABSTRACT

The disclosure relates to a firearm suppressor including a multi-material baffle configured to reduce at least audible discharge and muzzle flash. For example, a cone insert of the baffle may be formed of a first material, and a tubular member of the baffle may be formed of a second material different from the first material. The baffles may include a proximal circumferential flange having a plurality of through-wall ports through which fluid may be directed into a chamber defined by exterior surfaces of the baffles and the interior surface of an external can. The disclosure also relates to a firearm suppressor endcap having a plurality of through-wall ports radially disposed on a tubular body of the endcap, and a conical ramp configured to direct fluid across the conical ramp and through the plurality of through-wall ports of the endcap during operation of the suppressor.

5 Claims, 34 Drawing Sheets

(56) References Cited

U.S. PATENT DOCUMENTS

| | | | | |
|---|---|---|---|---|
| 8,991,550 | B2 | 3/2015 | Coley | |
| 9,038,770 | B1 | 5/2015 | Morrison | |
| 9,182,188 | B2 * | 11/2015 | Gawencki | F41A 21/30 |
| 9,303,939 | B1 * | 4/2016 | Brinkmeyer | F41A 21/38 |
| 9,709,354 | B2 * | 7/2017 | Larue | F41A 21/34 |
| 9,879,934 | B2 | 1/2018 | Thomas et al. | |
| 10,228,210 | B2 * | 3/2019 | Parker | F41A 21/30 |
| 10,480,888 | B2 * | 11/2019 | Barrett | F41A 21/28 |
| 10,976,125 | B2 * | 4/2021 | Hood, II | F41A 21/30 |
| 2016/0061551 | A1 | 3/2016 | Petersen | |
| 2017/0350670 | A1 | 12/2017 | Grob | |
| 2018/0172383 | A1 * | 6/2018 | James | F41A 21/30 |
| 2018/0202744 | A1 | 7/2018 | De Sousa | |
| 2018/0347932 | A1 | 12/2018 | Bray | |
| 2019/0107354 | A1 | 4/2019 | Alling et al. | |
| 2020/0049442 | A1 * | 2/2020 | Petersen | F41A 21/30 |
| 2020/0072571 | A1 * | 3/2020 | Washburn, III | F41A 21/30 |
| 2020/0141679 | A1 * | 5/2020 | Garst | F41A 21/30 |
| 2020/0141680 | A1 | 5/2020 | Morreau | |
| 2020/0173751 | A1 * | 6/2020 | Dorne | F41A 21/30 |
| 2020/0232741 | A1 * | 7/2020 | Hood, II | F41A 21/30 |
| 2021/0018287 | A1 * | 1/2021 | Kada | F41A 21/30 |
| 2021/0389077 | A1 * | 12/2021 | Turnblom | F41A 35/00 |
| 2021/0396485 | A1 * | 12/2021 | Reis-Green | F41A 21/30 |
| 2022/0049920 | A1 * | 2/2022 | Kras | F41A 21/30 |

OTHER PUBLICATIONS

Hakonen, "Firearm suppressors—structures and alternative materials Master of Science Thesis", Tampere University of Technology (Nov. 3, 2010) (53 pp.).

YouTube Video at https://www.youtube.com/watch?v=Ud2B4VqPsLk (Nov. 6, 2019).

Alabama Arsenal. KGM Technologies R30 I Noise and Recoil Reduction in One Suppressor. YouTube. Oct. 13, 2020. [retrieved on Jun. 7, 2022]. Retrieved from internet:< URL: https://www.youtube.com/watch?v=DnQWGKGimso>. entire video, 3 pages.

International Search Report and Written Opinion dated Jun. 27, 2022 for PCT/US2021/072610, 10 pages.

* cited by examiner

SUPPRESSOR ASSEMBLY FOR A FIREARM

CROSS-REFERENCE TO RELATED APPLICATION

This application is a continuation of U.S. patent application Ser. No. 17/456,688, filed Nov. 29, 2021, which claims the benefit of priority to U.S. Provisional Patent Appl. No. 63/119,558 filed Nov. 30, 2020, the disclosures of each are hereby incorporated by reference in their entireties.

FIELD

The present disclosure generally relates to a suppressor for a firearm, and more particularly to, an assembly including a multi-material baffle, a baffle stack configuration, an endcap with radial gas ports, and combinations thereof.

BACKGROUND

A firearm creates a loud audible noise and a flash as a round is discharged from within the firearm. Generally, a suppressor is coupled to the muzzle end of a firearm barrel. Suppressors work to reduce the audible discharge of a firearm as well as decrease the muzzle flash. The noise and light created by the discharge may be reduced in a number of different ways depending on the design of the suppressor. Conventional suppressors include a series of expansion chambers that capture and/or redirect the gas and soundwaves expelled from the firearm barrel. Some conventional suppressors simply place multiple walls and chambers throughout the suppressor in an effort to control the path of the exhaust discharged from the firearm through the suppressor.

It would therefore be desirable to provide an improved suppressor assembly with reduced audible discharge and muzzle flash, as well as reduced point of impact shift. It would also be desirable to provide a suppressor assembly with reduced weight and tunable firearm reaction. Such suppressors would derisibly be functional with fully automatic weapons and weapons of varying calibers.

SUMMARY

In one aspect, the disclosed technology relates to a multi-material baffle for use with a firearm suppressor, the baffle including: a cone insert having a proximal region, a distal region, and a cross-sectional area increasing in size from the proximal region toward the distal region, the cone insert including a circumferential ridge extending along an outer surface of the distal region of the cone insert, the cone insert formed of a first material; and a tubular member having a proximal portion and a distal portion, the proximal portion configured to receive at least a portion of the distal region of the cone insert and to engage with the circumferential ridge of the cone insert, the tubular member formed of a second material different from the first material.

In some embodiments, the baffle further includes a weld ring having a lumen sized and shaped to receive the cone insert therethrough, the weld ring configured to engage with the circumferential ridge of the cone insert and the proximal portion of the tubular member. In some embodiments, the weld ring is formed of a material including the second material. In some embodiments, the first material includes steel. In some embodiments, the second material includes titanium. In some embodiments, the proximal region of the cone insert includes an arcuate outer surface. In some embodiments, the cone insert is threadably connected to the tubular member. In some embodiments, the distal portion of the tubular member includes a distal circumferential flange extending along an outer surface of the tubular member between the proximal portion and the distal portion, the distal circumferential flange including one or more through-wall ports. In some embodiments, the proximal portion of the tubular member includes a proximal circumferential flange extending along an outer surface of the proximal portion, the proximal circumferential flange including one or more through-wall ports. In some embodiments, the one or more through-wall ports of the proximal circumferential flanges are offset from the one or more through-wall ports of the distal circumferential flange. In some embodiments, the proximal circumferential flange includes a seat. The disclosure also relates to a firearm suppressor including one or more of the disclosed baffles.

In another aspect, the disclosed technology relates to a suppressor for use with a firearm, the suppressor including: a spacer having a proximal end, a distal end, and a cross-sectional area decreasing from the proximal end toward the distal end, the spacer having an interior forming a first chamber and including a plurality of through-wall ports circumferentially disposed on the spacer between the proximal end and the distal end; a plurality of baffles distal to the spacer, each baffle of the plurality of baffles including a proximal cone insert, a distal tubular member, a proximal circumferential flange extending along an outer surface of the proximal cone insert and including one or more through-wall ports, and a distal circumferential flange extending along an outer surface of the baffle between the proximal cone insert and the distal tubular member and including one or more through-wall ports, the distal circumferential flange having a larger diameter than the proximal circumferential flange; and an external can having a proximal end, a distal end, and a lumen extending therethrough, the lumen sized and shaped to receive the spacer and the plurality of baffles therein such that the proximal end of the spacer and the distal circumferential flange of at least a proximal baffle of the plurality of baffles engage with an inner surface of the external can, thereby forming a second chamber defined by the inner surface of the external can, and outer surfaces of the spacer and the plurality of baffles; wherein, during operation of the suppressor, fluid is directed from the first chamber, through at least one of the plurality of through-wall ports of the spacer or the plurality of through-wall ports of the proximal circumferential flange of the proximal baffle into the second chamber. In some embodiments, the through-wall ports of the plurality of baffles are symmetrically arranged so as to provide an even gas dispersion flow.

In some embodiments, the proximal circumferential flange of at least one intermediate baffle of the plurality of baffles is configured to engage with the distal end of the distal tubular member of an adjacent baffle of the plurality of baffles. In some embodiments, the proximal cone insert of at least one baffle of the plurality of baffles is formed of a first material, and the distal tubular member of the at least one baffle of the plurality of baffles is formed of a second material different from the first. In some embodiments, the suppressor further includes an endcap including: a tubular body including a plurality of through-wall ports circumferentially disposed on a tubular body of the endcap; and a conical ramp configured to direct fluid from the plurality of chambers across the conical ramp and through the plurality of through-wall ports of the endcap during operation of the suppressor. The disclosure also relates to a firearm including the suppressor disclosed herein.

In another aspect, the disclosed technology relates to an endcap for use with a firearm suppressor, the endcap including: a tubular body having a proximal end, a distal end, and a plurality of through-wall ports radially disposed on the tubular body between the proximal end and the distal end; a rear wall coupled to the distal end of the tubular body, the rear wall including a central aperture; and a conical ramp extending from a proximal side of the rear wall toward the proximal end of the tubular body, the conical ramp including a central passageway aligned with the central aperture of the rear wall such that the conical ramp is disposed circumferentially around the central aperture of the rear wall, the conical ramp further including one or more channels extending from an outer edge of the conical ramp toward the central passageway, wherein the conical ramp is configured to direct fluid across the conical ramp from the proximal end toward the distal end of the tubular body and through the plurality of through-wall ports during operation of the suppressor. In some embodiments, at least one of the through-wall ports is threaded. The disclosure also relates to a firearm suppressor including the endcap disclosed herein.

BRIEF DESCRIPTION OF THE DRAWINGS

The accompanying drawings, which are incorporated herein and constitute part of this specification, are illustrative of particular embodiments of the present disclosure and do not limit the scope of the present disclosure. The drawings are not to scale and are intended for use in conjunction with the explanations in the following detailed description. The use of the same reference numerals may indicate similar or identical items. Various embodiments may utilize elements and/or components other than those illustrated in the drawings, and some elements and/or components may not be present in various embodiments. Throughout this disclosure, depending on the context, singular and plural terminology may be used interchangeably.

DETAILED DESCRIPTION

Figure 1A:
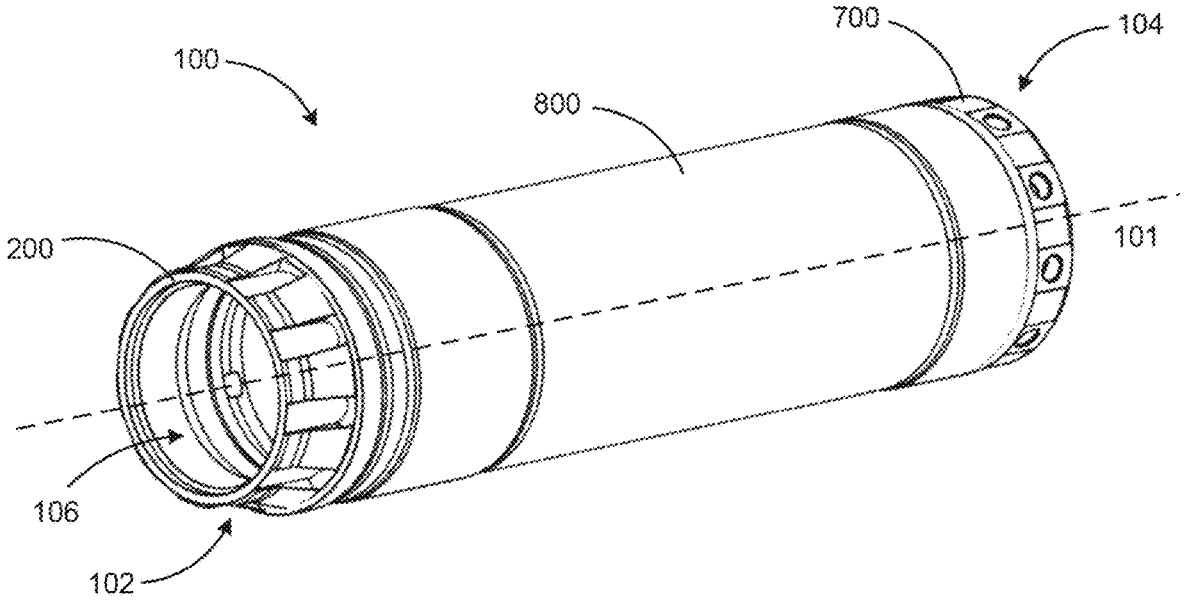
FIG. 1A depicts a front perspective view of an exemplary suppressor assembly for a firearm in accordance with one or more embodiments of the disclosure.

The following discussion omits or only briefly describes conventional features of the disclosed technology that are apparent to those skilled in the art. Reference to various embodiments does not limit the scope of the claims attached hereto. Additionally, any examples set forth in this specification are intended to be non-limiting and merely set forth some of the many possible embodiments for the appended claims. Further, particular features described herein can be used in combination with other described features in each of the various possible combinations and permutations. A person of ordinary skill in the art would know how to use the instant invention, in combination with routine experiments, to achieve other outcomes not specifically disclosed in the examples or the embodiments.

Unless otherwise specifically defined herein, all terms are to be given their broadest possible interpretation including meanings implied from the specification as well as meanings understood by those skilled in the art and/or as defined in dictionaries, treatises, etc. Unless defined otherwise, all technical and scientific terms used herein have the same meaning as commonly understood by one of ordinary skill in the art in the field of the disclosed technology. It must also be noted that, as used in the specification and the appended claims, the singular forms "a," "an" and "the" include plural referents unless otherwise specified, and that the terms "includes" and/or "including," when used in this specification, specify the presence of stated features, elements, and/or components, but do not preclude the presence or addition of one or more other features, steps, operations, elements, components, and/or groups thereof. Additionally, methods, equipment, and materials similar or equivalent to those described herein can also be used in the practice or testing of the disclosed technology.

Various examples of the disclosed technology are provided throughout this disclosure. The use of these examples is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. The invention is therefore to be limited only by the terms of the claims, along with the full scope of equivalents to which the claims are entitled.

Certain relationships between features of the suppressor are described herein using the term "substantially" or "substantially equal". As used herein, the terms "substantially" and "substantially equal" indicate that the equal relationship is not a strict relationship and does not exclude functionally similar variations therefrom. Unless context or the description indicates otherwise, the use of the term "substantially" or "substantially equal" in connection with two or more described dimensions indicates that the equal relationship between the dimensions includes variations that, using mathematical and industrial principles accepted in the art (e.g., rounding, measurement or other systematic errors, manufacturing tolerances, etc.), would not vary the least significant digit of the dimensions. As used herein, the term "substantially parallel" indicates that the parallel relationship is not a strict relationship and does not exclude functionally similar variations therefrom. As used herein, the term "substantially orthogonal" indicates that the orthogonal relationship is not a strict relationship and does not exclude functionally similar variations therefrom.

In accordance with one aspect of the present disclosure, a suppressor for use with a firearm is provided. As used herein, a "firearm" may refer to a rifle, shotgun, pistol, or other such weapon, including semi-automatic and automatic firearms. The suppressor technology disclosed herein can be used with all such firearms. For instance, fully automatic large caliber firearms typically do not include suppressors even though they generate a high degree of sound and pressure, further intensified by the rate of fire, that can impact the operator and those nearby (e.g., Humvee drivers, spotters, range officers/trainers, etc.). Accordingly, the disclosed suppressor could be particularly advantageous in relation to such weapons.

The disclosed suppressor may include a spacer having a proximal end, a distal end, and a cross-sectional area decreasing from the proximal end toward the distal end. The spacer may form a first chamber and may have a plurality of through-wall ports circumferentially disposed on the spacer between the proximal end and the distal end.

In addition, the suppressor may include a plurality of baffles distal to the spacer, one or more baffle of the plurality of baffles having a proximal conically shaped cone insert, a distal tubular member, a proximal circumferential flange extending along an outer surface of the proximal cone insert and having one or more through-wall ports, and a distal circumferential flange extending along an outer surface of the baffle between the proximal cone insert and the distal tubular member and having one or more through-wall ports. The distal circumferential flange may have a larger diameter than the proximal circumferential flange.

In addition, the suppressor may have an external can or tube having a proximal end, a distal end, and a lumen extending therethrough. The lumen may be sized and shaped to receive the spacer and the plurality of baffles therein such that the proximal end of the spacer and distal circumferential flange engage with an inner surface of the external can, thereby forming a second chamber between the external can, the spacer, a proximal baffle of the plurality of baffles, and a plurality of chambers between the external can, adjacent baffles. Accordingly, fluid may be directed from the first chamber, through at least one of the plurality of through-wall ports of the spacer or the plurality of through-wall ports of the proximal circumferential flange of the proximal baffle into the second chamber, and through the plurality of through-wall ports of the distal circumferential flange of the proximal baffle into the plurality of chambers.

The proximal circumferential flange of the plurality of baffles may be sized and shaped to engage with at least one of the distal end of the spacer or a distal end of the distal tubular member of an adjacent baffle of the plurality of baffles. In addition, the proximal cone insert of at least one baffle of the plurality of baffles may be formed of a first material, and the distal tubular member of the at least one baffle of the plurality of baffles may be formed of a second material different from the first. The suppressor further may include an endcap as described in further detail below. In some embodiments, the disclosed suppressor is at least partially ornamental in nature and features nonfunctional elements.

In accordance with another aspect of the present disclosure, a baffle for use with a firearm suppressor is provided. The baffle may include a cone insert having a proximal region, a distal region, and a cross-sectional area increasing in size from the proximal region toward the distal region. The cone insert may include a circumferential ridge extending along an outer surface of the distal region the cone insert. The cone insert may be formed of a first material, e.g., steel, Inconel (nickel alloy containing chromium and iron), nonmetallic materials, other suitable material, or a combination thereof. The proximal region of the cone insert may have an arcuate outer surface, and the distal region of the cone insert may have a tubular shape.

The baffle may further include a tubular member having a proximal portion and a distal portion. The proximal portion of the tubular member may receive at least a portion of the distal region of the cone insert and engage with the circumferential ridge of the cone insert. Additionally, the tubular member may be formed of a second material (e.g., titanium, ceramic, carbide, tungsten, cobalt, other suitable material, or a combination thereof) different from the first material. The tubular member may include a distal circumferential flange extending along an outer surface of the tubular member between the proximal portion and the distal portion, the distal circumferential flange having one or more through-wall ports. Additionally, the proximal portion of the tubular member may include a proximal circumferential flange extending along an outer surface of the proximal portion, the proximal circumferential flange having one or more through-wall ports. The one or more through-wall ports of the proximal circumferential flange may be offset from the one or more through-wall ports of the distal circumferential flange. Additionally, the proximal circumferential flange may include a seat.

The baffle may also include a weld ring having a lumen sized and shaped to receive the cone insert therethrough. The weld ring may engage with the circumferential ridge of the cone insert and the proximal portion of the tubular member. In some embodiments, the weld ring may be formed of the second material. In some embodiments, the disclosed baffles are at least partially ornamental in nature and feature nonfunctional elements.

In accordance with another aspect of the present disclosure, an endcap for use with a firearm suppressor is provided. The endcap may include a tubular body having a proximal end, a distal end, and a plurality of through-wall ports circumferentially disposed on the tubular body between the proximal end and the distal end. The endcap further may include a rear wall coupled to the distal end of the tubular body, the rear wall having a central aperture. In addition, the endcap may have a conical ramp extending from a proximal side of the rear wall toward the proximal end of the tubular body. The conical ramp may include a central passageway aligned with the central aperture of the rear wall such that the conical ramp is disposed circumferentially around the central aperture of the rear wall. Additionally, the conical ramp may include one or more channels extending from an outer edge of the conical ramp toward the central passageway. Accordingly, the conical ramp may direct fluid across the conical ramp from the proximal end toward the distal end of the tubular body and through the plurality of through-wall ports. An outer surface of the conical ramp may have a concave shape. In some embodiments, the one or more channels may extend in a substantially straight line from the outer edge of the conical ramp toward the central passageway. In some embodiments, the one or more channels may extend in curved line from the outer edge of the conical ramp toward the central passageway. In some embodiments, the disclosed endcap is at least partially ornamental in nature and features nonfunctional elements.

In some embodiments, the disclosed suppressor reduces point of impact shift, such that the projectiles fired by the firearm will impact at substantially the same location relative to the target aimed at by the shooter whether or not the suppressor is attached to the firearm. Thus, a user may zero the suppressed firearm using an optic, and then need not re-zero it after the suppressor is removed.

In general, the disclosed suppressor reduces the signature (i.e., one or more of sound, flash, frequency, pressure, etc.) of a firearm when fired, and is lighter weight than conventional suppressor designs. The disclosed suppressor may also provide tunability for customized signature reduction and weapon reaction. The devices and methods disclosed herein aim to alleviate or eliminate at least one of the aforementioned problems. However, it shall be understood that the disclosure herein is not limited to merely solving any one or more of these specific problems. Also, while many of the advantages described herein relate to military or law enforcement applications, the disclosure is not limited to enhancing the experience only of users involved in military and law enforcement, as civilian users may significantly benefit as well.

Figure 1B:
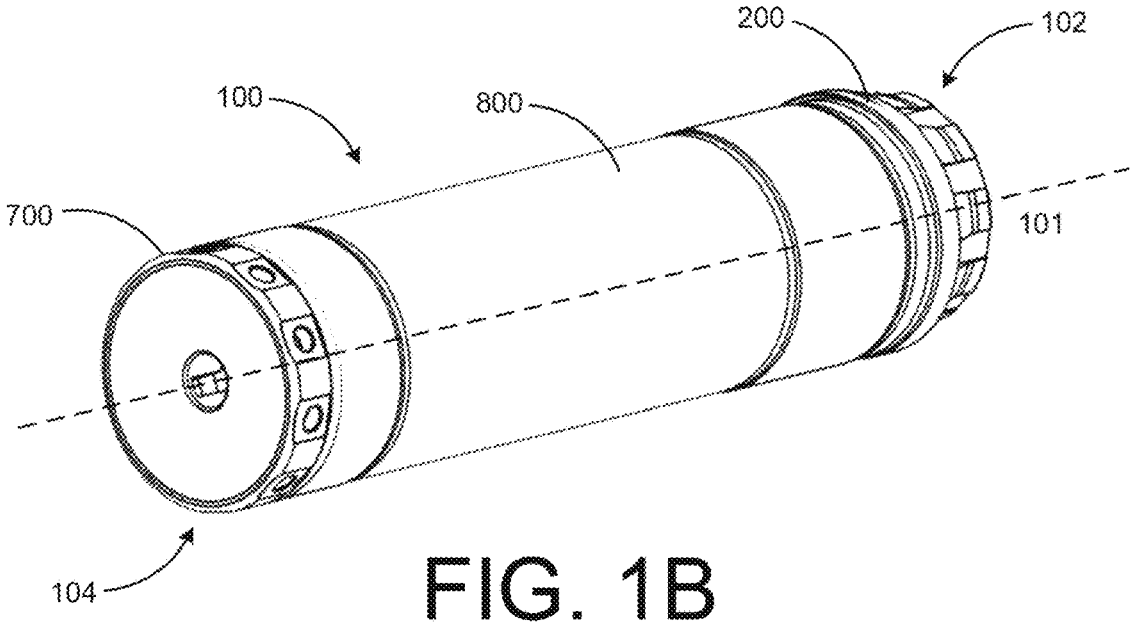
FIG. 1B depicts a rear perspective view of the suppressor assembly of FIG. 1A in accordance with one or more embodiments of the disclosure.
Figure 1C:
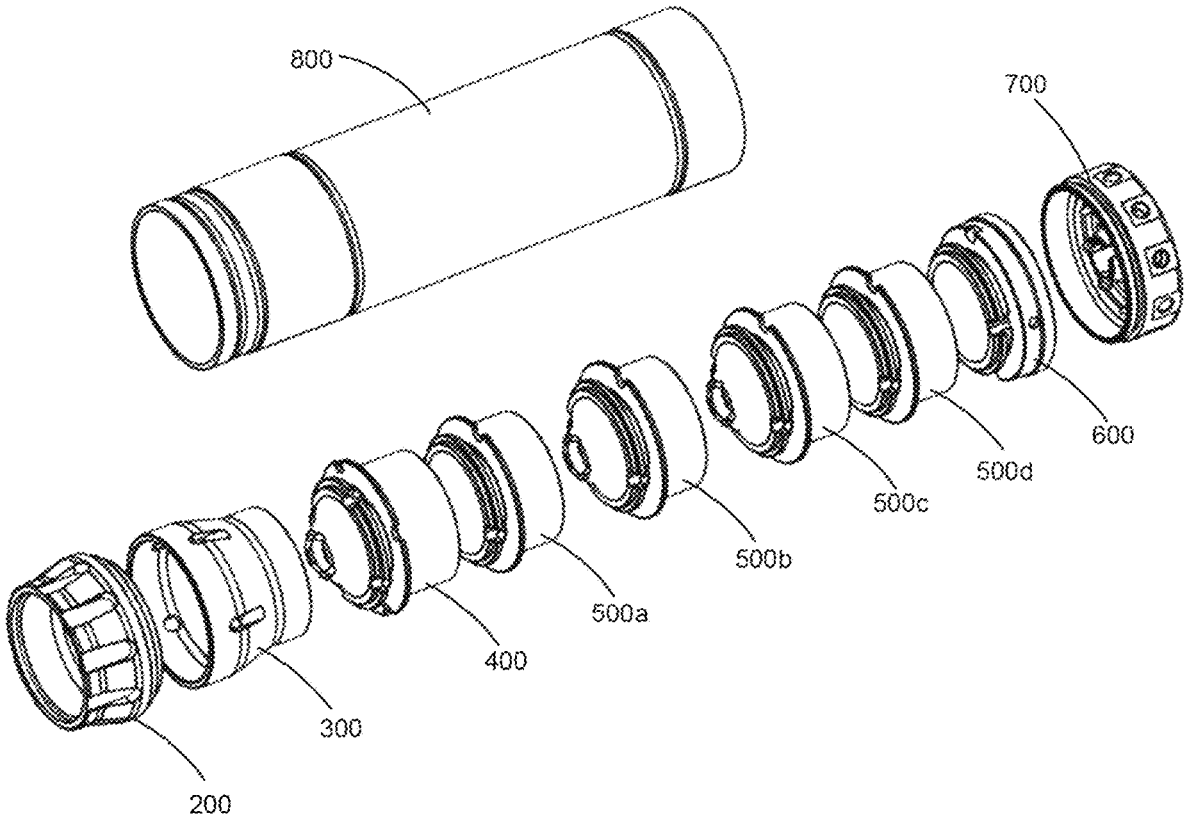
FIG. 1C depicts an exploded front view of the suppressor of FIG. 1A in accordance with one or more embodiments of the disclosure.

FIGS. 1A to 1C illustrate various views of an exemplary suppressor assembly for a firearm in accordance with one or more embodiments of the disclosure. Specifically, FIG. 1A depicts a front perspective view of suppressor 100, FIG. 1B depicts a rear perspective view suppressor 100, and FIG. 1C depicts an exploded front view of suppressor 100. Suppressor 100 may be configured to operably attach to one or more than one type of muzzle brake on different firearms. Accordingly, suppressor 100 may divert exhaust generated from the firing of a projectile from the firearm muzzle into multiple, separate expansion chambers. For example, as a projectile travels through the bore of suppress 100, e.g., an extended aligned aperture extending through suppressor 100, the exhaust gas diverts into different chambers of suppressor 100, which causes the exhaust gas to lose velocity and pressure from the projectile's path through the bore. The bore of suppressor 100 may be configured to align with the bore of a firearm when suppressor 100 is coupled to a firearm.

Suppressor 100 includes proximal end 102 and distal end 104, and may be overall symmetric about longitudinal axis 101. As shown in FIG. 1C, and as described in further detail below, suppressor 100 may include external can 800, muzzle mount 200, spacer 300, a plurality of baffles, e.g., proximal (blast) baffle 400, a stack of one or more intermediate baffles, e.g., baffles 500*a*, 500*b*, 500*c*, 500*d*, e.g., distal baffle 600, and an endcap, e.g., endcap 700. Spacer 300 and the plurality of baffles may be disposed within external can 800, which may be coupled at its proximal and distal ends to mount 200 and endcap 700, respectively, to form the expansion chambers and the bore extending through suppressor 100.

Figure 2A:
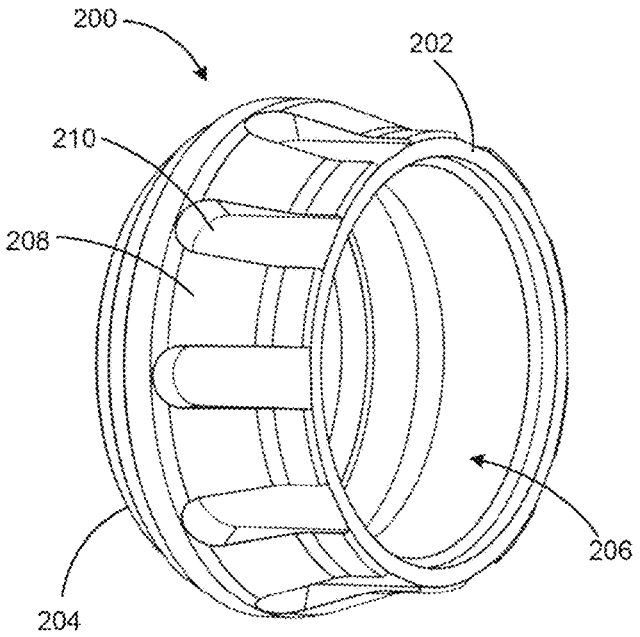
FIG. 2A depicts a perspective front view of an exemplary mount in accordance with one or more embodiments of the disclosure.
Figure 2B:
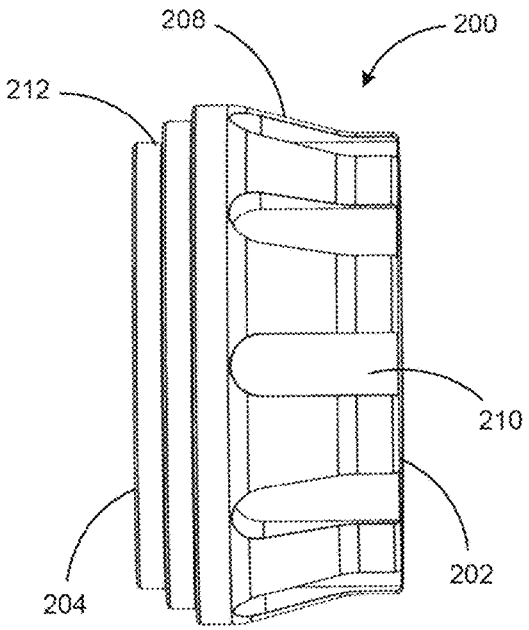
FIG. 2B depicts a side view of the mount of FIG. 2A in accordance with one or more embodiments of the disclosure.
Figure 2C:
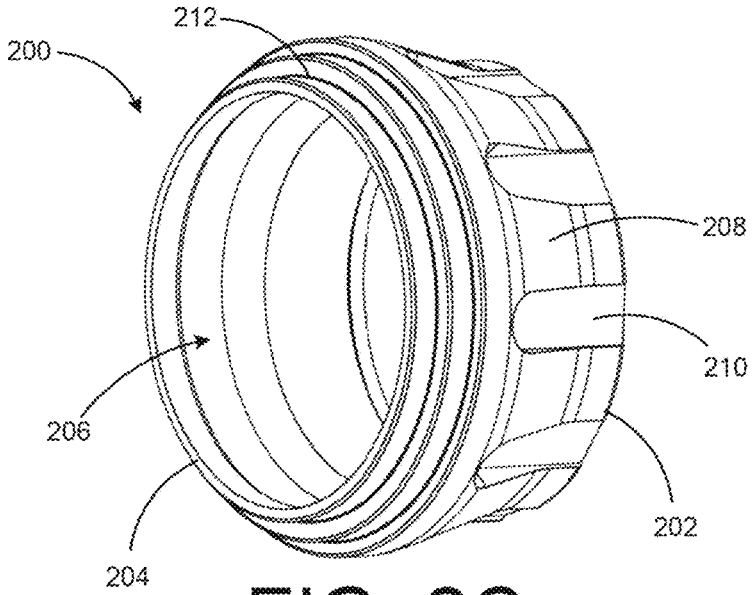
FIG. 2C depicts a perspective rear view of the mount baffle of FIG. 2A in accordance with one or more embodiments of the disclosure.
Figure 2D:
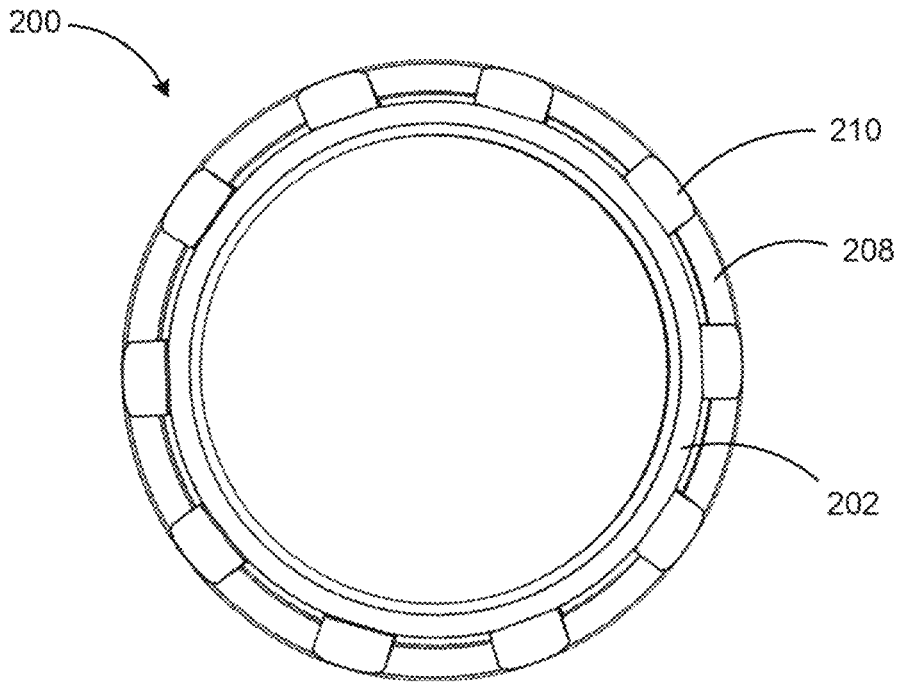
FIG. 2D depicts a front view of the mount of FIG. 2A in accordance with one or more embodiments of the disclosure.
Figure 2E:
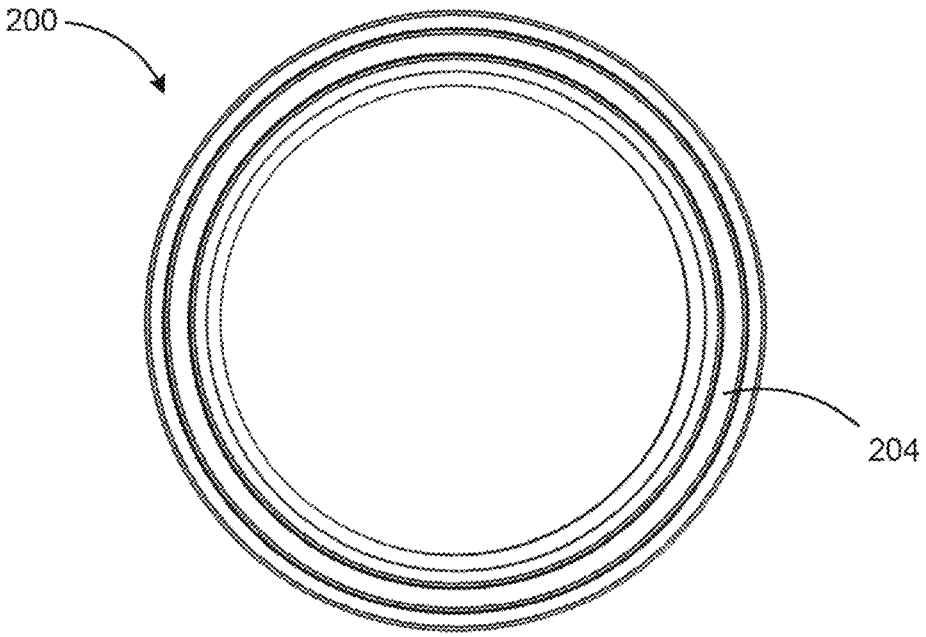
FIG. 2E depicts a rear view of the mount of FIG. 2A in accordance with one or more embodiments of the disclosure.

Referring now to FIGS. 2A to 2E, an exemplary muzzle mount in accordance with one or more embodiments of the disclosure is provided. FIG. 2A depicts a perspective front view of mount 200, FIG. 2B depicts a side view of mount 200, FIG. 2C depicts a perspective rear view of mount 200, FIG. 2D depicts a front view of mount 200, and FIG. 2E depicts a rear view of mount 200. Mount 200 may have a tubular body with proximal end 202, distal end 204, outer surface 208, and passageway 206 extending therethrough through which a projectile may travel. Proximal end 202 of mount 200 may be removably coupled to, e.g., a muzzle end of the barrel of a firearm. For example, mount 200 may include one or more screw threads along the inner surface at proximal end 202. The one or more screw threads may be configured to engage and be threadably coupled to a threaded surface on the firearm, e.g., along the muzzle end of the barrel of the firearm. Mount 200 may be removably attached to firearm bores having different sized calibers. Alternatively, proximal end 202 may be coupled to a muzzle end via welding, adhesives, or any other method known to those of ordinary skill in the art. In some embodiments, mount 200 may be configured to engage with a muzzle device attached to the muzzle end of the barrel of the firearm. As an example, mount 200 may include slots for receiving lugs of a muzzle device or a quick-locking mechanism to secure to a muzzle device.

In addition, distal end 204 of mount 200 may be threaded such that distal end 204 of mount 200 may be removably coupled to a proximal end of external can 800. For example, as shown in FIG. 2C, the outer surface of mount 200 at distal end 204 may be threaded such that distal end 204 may threadably engage with the corresponding threads of the proximal end of external can 800. Alternatively, distal end 204 may be coupled to external can 800 via welding, adhesives, or any other method known to those of ordinary skill in the art. In addition, the outer surface of mount 200 at distal end 204 may include seat 212, which may have a shape configured to engage with the proximal end of spacer 300, as described in further detail below.

Moreover, the cross-sectional area of outer surface 208 of mount 200 may increase from proximal end 202 toward distal end 204, which may provide stability when mount 200 is gripped by a user. In addition, mount 200 may include a plurality of ridges 210 disposed circumferentially on outer surface 208, which may further improve stability when mount 200 is gripped by a user. As shown in FIG. 2A, the bottom surface of ridges 210 may extend parallel to the central axis of mount 200.

Figure 3A:
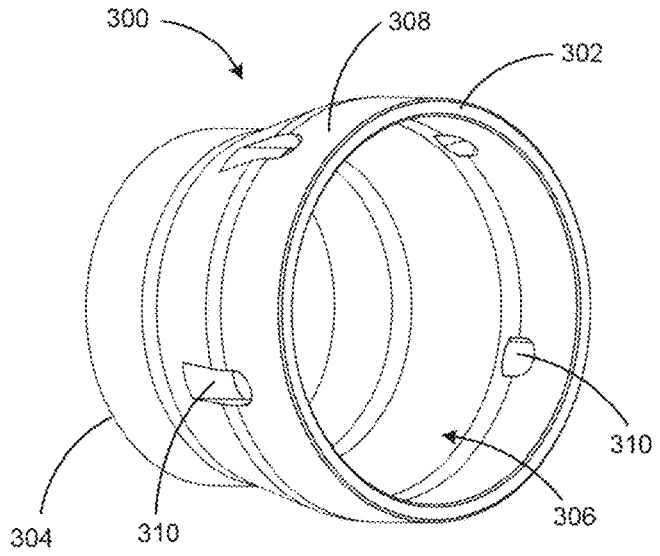
FIG. 3A depicts a perspective front view of an exemplary spacer in accordance with one or more embodiments of the disclosure.
Figure 3B:
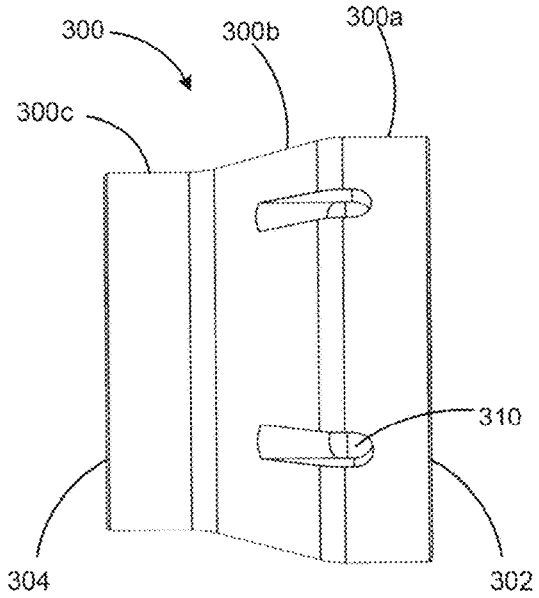
FIG. 3B depicts a side view of the spacer of FIG. 3A in accordance with one or more embodiments of the disclosure.
Figure 3C:
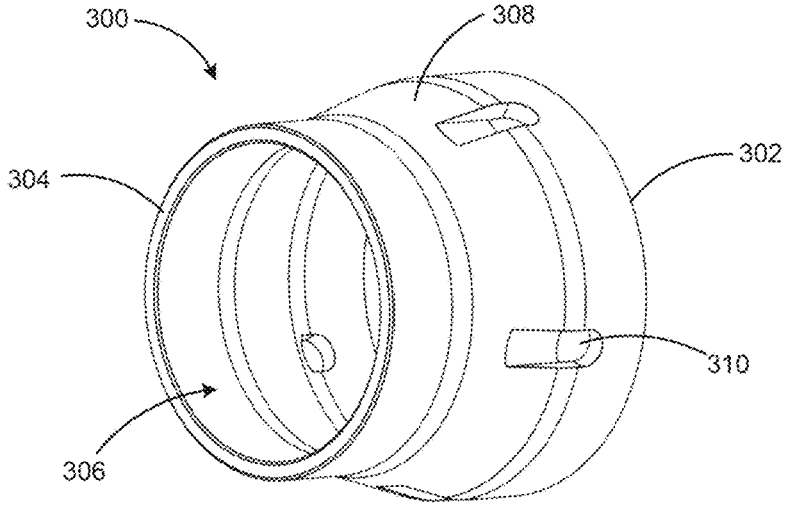
FIG. 3C depicts a perspective rear view of the spacer baffle of FIG. 3A in accordance with one or more embodiments of the disclosure.
Figure 3D:
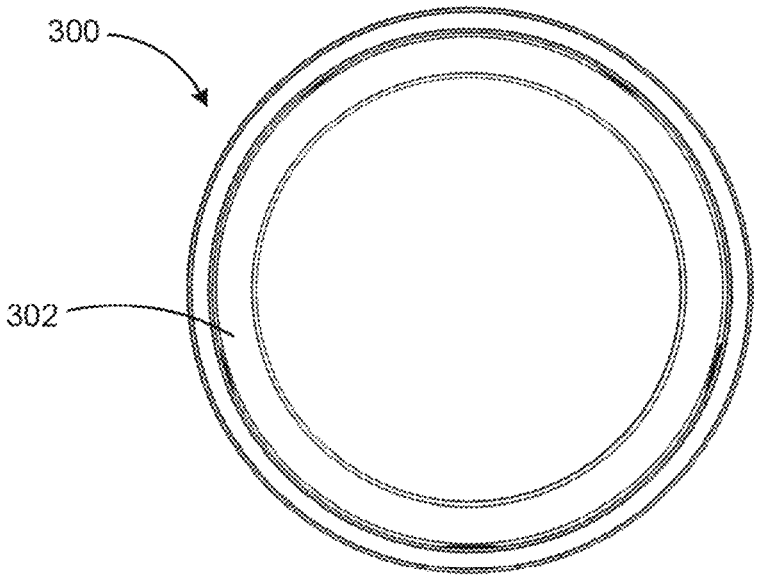
FIG. 3D depicts a front view of the spacer of FIG. 3A in accordance with one or more embodiments of the disclosure.
Figure 3E:
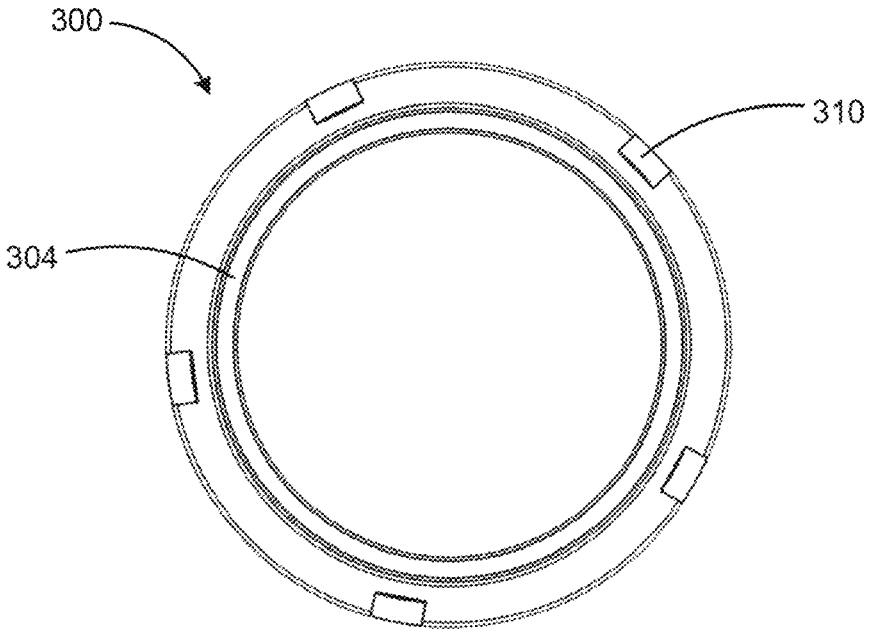
FIG. 3E depicts a rear view of the spacer of FIG. 3A in accordance with one or more embodiments of the disclosure.

Referring now to FIGS. 3A to 3E, an exemplary spacer in accordance with one or more embodiments of the disclosure is provided. FIG. 3A depicts a perspective front view of spacer 300, FIG. 3B depicts a side view of spacer 300, FIG. 3C depicts a perspective rear view of spacer 300, FIG. 3D depicts a front view of spacer 300, and FIG. 3E depicts a rear view of spacer 300. Spacer 300 may have a tubular body with proximal end 302, distal end 304, outer surface 308, and passageway 306 extending therethrough through which a projectile may travel. Proximal end 302 of spacer 300 may removably engage with distal end 204 of mount 200. For example, proximal end 302 of spacer 300 may engage with seat 212 of mount 200. As used herein, the term "seat" may refer to a ledge configured to receive a complementary shape. For example, seat 212 may be an outer edge formed by two flat surfaces creating a 90-degree angle (or some other angle). Additionally or alternatively, spacer 300 may include one or more screw threads along the outer surface at proximal end 302, which may threadably engage with distal end 204 of mount 200.

As shown in FIG. 3B, spacer 300 may include proximal portion 300*a*, middle portion 300*b*, and distal portion 300*c*. The cross-sectional area of spacer 300 may be relatively constant along proximal portion 300*a*, and relatively constant along distal portion 300*c*, and the cross-sectional area of proximal portion 300*a* may be larger than the cross-sectional area of distal portion 300*c*. Accordingly, the cross-sectional area of spacer 300 may decrease along middle portion 300*b* from proximal portion 300*a* toward distal portion 300*c*, thereby forming a nozzle. In addition, spacer 300 may include a plurality of through-wall ports 310 disposed circumferentially along at least a portion of proximal portion 300*a* and/or middle portion 300*b*. Accordingly, through-wall ports 310 may provide fluid communication between the chamber formed within the interior of spacer 300 and the chamber formed by outer surface 308 of spacer 300, external can 800, and the outer surface of blast baffle 400, as described in further detail below.

Figure 4A:
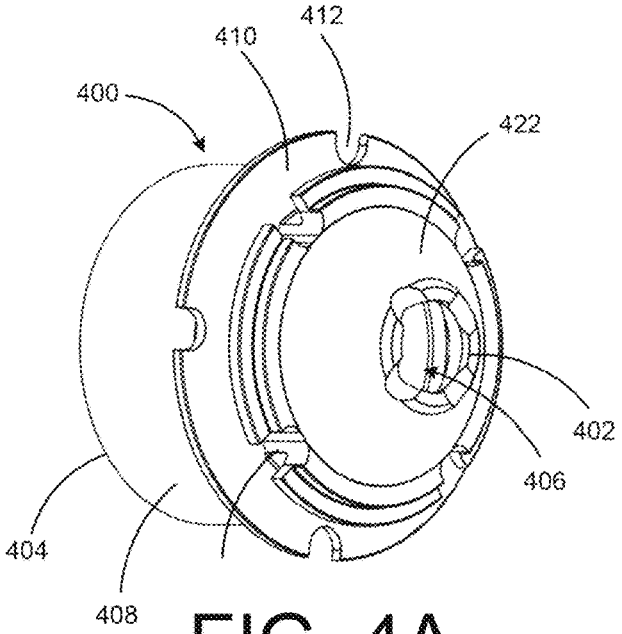
FIG. 4A depicts a perspective front view of an exemplary proximal baffle in accordance with one or more embodiments of the disclosure.
Figure 4B:
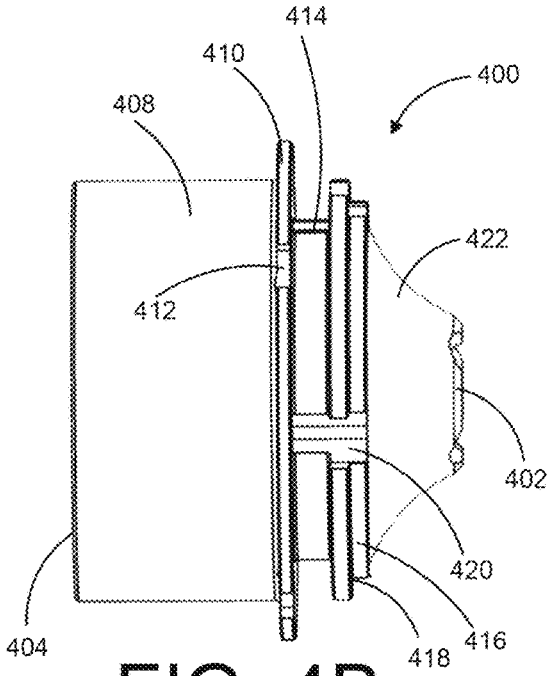
FIG. 4B depicts a side view of the proximal baffle of FIG. 4A in accordance with one or more embodiments of the disclosure.
Figure 4C:
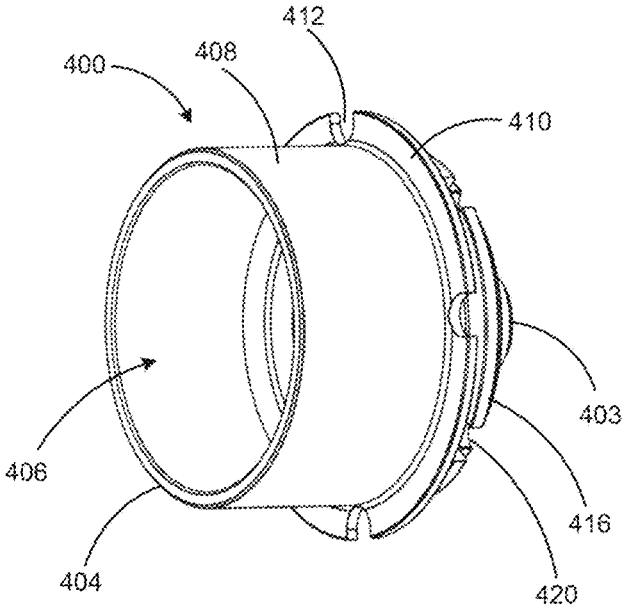
FIG. 4C depicts a perspective rear view of the proximal baffle of FIG. 4A in accordance with one or more embodiments of the disclosure.
Figure 4D:
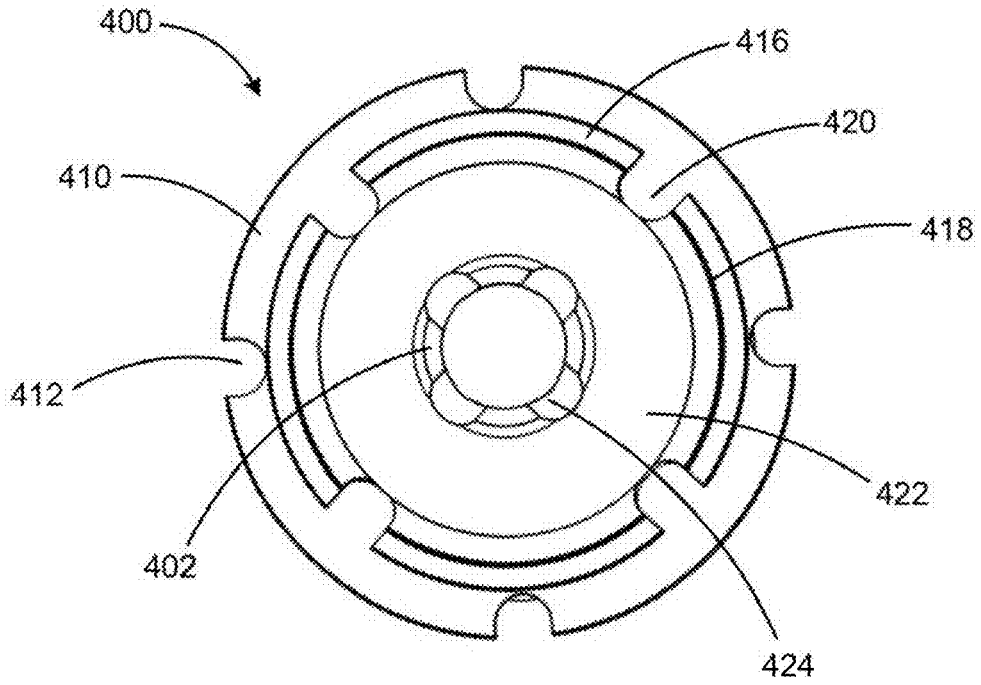
FIG. 4D depicts a front view of the proximal baffle of FIG. 4A in accordance with one or more embodiments of the disclosure.
Figure 4E:
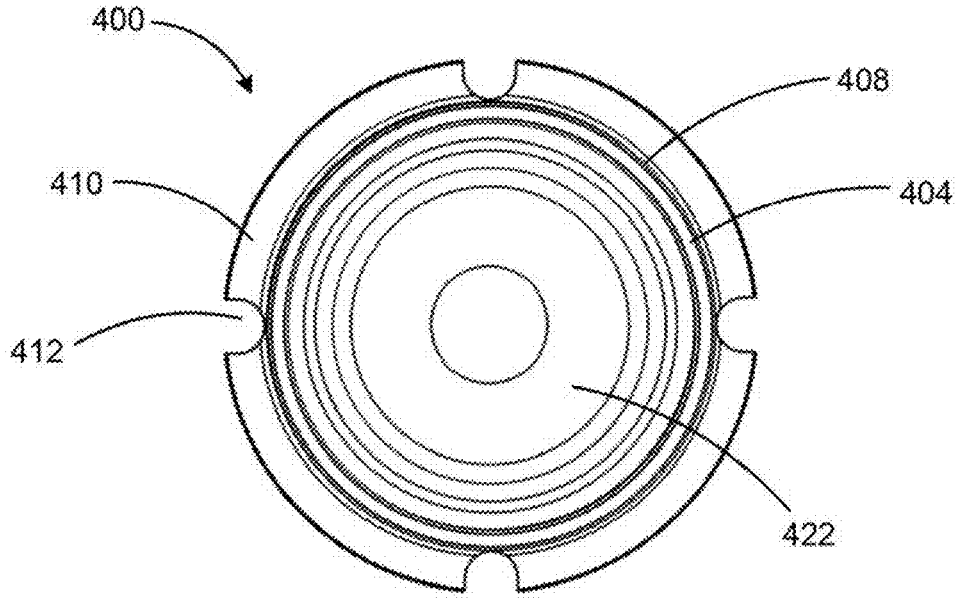
FIG. 4E depicts a rear view of the proximal baffle of FIG. 4A in accordance with one or more embodiments of the disclosure.

Referring now to FIGS. 4A to 4E, an exemplary proximal baffle (also referred to herein as a blast baffle) in accordance with one or more embodiments of the disclosure is provided. FIG. 4A depicts a perspective front view of proximal baffle 400, FIG. 4B depicts a side view of proximal baffle 400, FIG. 4C depicts a perspective rear view of proximal baffle 400, FIG. 4D depicts a front view of proximal baffle 400, and FIG. 4E depicts a rear view of proximal baffle 400. Blast baffle 400 may have proximal end 402, distal end 404, and passageway 406 extending therethrough through which a projectile may travel. In addition, blast baffle 400 may include tubular member 408, e.g., a wall extending axially from distal end 404 toward proximal end 402 having a cylindrical shape, middle portion 414, e.g., a wall extending axially from the proximal end of tubular member 408 toward proximal end 402 having a cylindrical shape, and cone insert 422 having an arcuate outer surface, e.g., a concave shape, extending from the proximal end of middle portion 414 toward proximal end 402. As described herein, blast baffle 400 may be constructed from one piece of material, thus the cone insert 422 may be part of that one piece. In other embodiments, described in greater detail below, baffles may be constructed from multiple pieces. As an example of the concave shape of cone insert 422, the arcuate outer surface of cone insert 422 may have a concave curved surface that extends from a portion that extends in a direction parallel or substantially parallel to the central axis of blast baffle 400 to a portion that extends in a direction orthogonal or substantially orthogonal to the central axis of blast baffle 400 adjacent the proximal end of middle portion 414. The arcuate outer surface of cone insert 422 may be disposed about the central axis of blast baffle 400. In addition, proximal end 402 may include a plurality of notches 424 for facilitating the redirecting the fluid flow across the arcuate outer surface of cone insert 422. As described in further detail below, cone insert 422 may be formed of a material that is different from the material forming the other components of blast baffle 400 to reduce muzzle flash.

Moreover, blast baffle 400 may include proximal flange 416 extending circumferentially along the outer surface of blast baffle 400, e.g., between cone insert 422 and middle portion 414. Proximal flange 416 may include seat 418. Seat 418 may be formed in a single flange of proximal flange 416, or alternatively, proximal flange 416 may be formed by two adjacent flanges, the proximal flange of the two adjacent flanges having an outer diameter that is smaller than the distal flange of the two adjacent flanges, thereby forming seat 418. The outermost diameter of proximal flange 416 may be substantially equal to the outer diameter of tubular member 408. Alternatively, the outermost proximal flange 416 may be smaller or larger than the outer diameter of tubular member 408, but less than the diameter of the interior lumen of external can 800. Seat 418 may be shaped to engage with distal end 304 of spacer 300.

In addition, blast baffle 400 may include distal flange 410 extending circumferentially along the outer surface of blast baffle 400, e.g., between middle portion 414 and tubular member 408. The outer diameter of distal flange 410 may be just slightly smaller than the diameter of the interior lumen of external can 800. Moreover, blast baffle 400 may include a plurality of through-wall ports 412 circumferentially and symmetrically disposed on the outer edge of distal flange 410. Accordingly, when blast baffle 400 is disposed within external can 800, distal flange 410 engages with the interior wall of external can 800 except for at through-wall ports 412. As shown in FIGS. 4A to 4E, distal flange 410 may include four through-wall ports 412 symmetrically disposed about the central axis of blast baffle 400. As will be understood by a person having ordinary skill in the art, distal flange 410 may include less or more than four through-wall ports 412.

Blast baffle 400 further may include a plurality of through-wall ports 420 circumferentially and symmetrically disposed on proximal flange 416. As shown in FIG. 4B, ports 420 may extend from a proximal side of proximal flange 416, through proximal flange 416 and through at least a portion of the outer surface of middle portion 414 toward distal flange 410. Accordingly, when blast baffle 400 is disposed within external can 800, adjacent and distal to spacer 300, and distal end 304 of spacer 300 is engaged with seat 418 of proximal flange 416, ports 420 may provide fluid communication between the chamber formed within the interior of spacer 300 and the chamber formed by outer surface 308 of spacer 300, external can 800, and the outer surface of blast baffle 400, as described in further detail below. As shown in FIG. 4D, blast baffle 400 may include four ports 420 symmetrically disposed about the central axis of blast baffle 400. As will be understood by a person having ordinary skill in the art, blast baffle 400 may include less or more than four ports 420. Moreover, ports 420 may be offset from through-wall ports 412, to create the longest pathway for fluid to flow from ports 420 to through-wall ports 412. For example, each port of ports 420 may be positioned at a midpoint circumferentially between adjacent ports of through-wall ports 412.

Figure 5A:
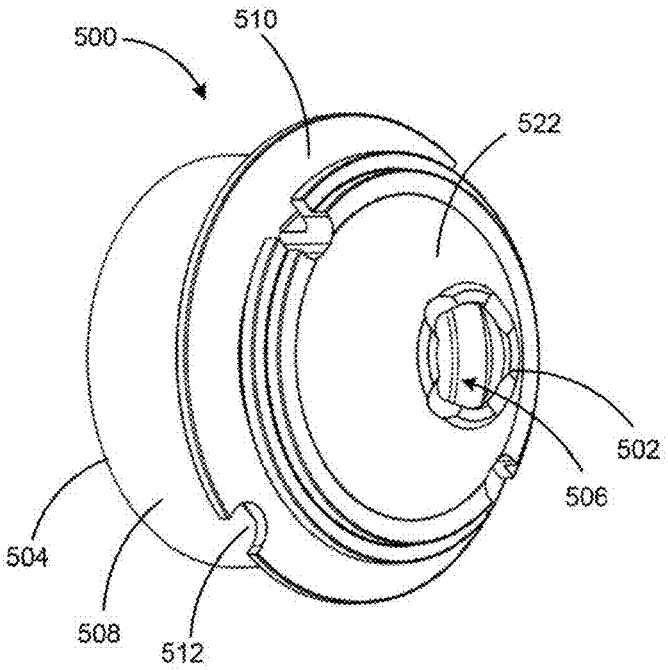
FIG. 5A depicts a perspective front view of an exemplary baffle in accordance with one or more embodiments of the disclosure.
Figure 5B:
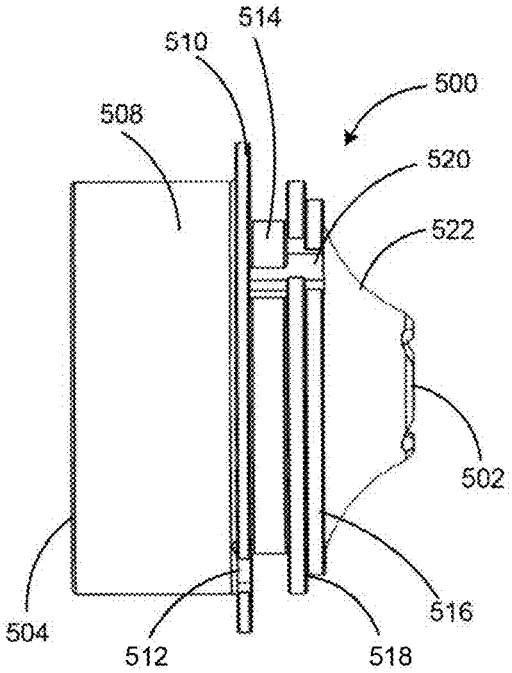
FIG. 5B depicts a side view of the baffle of FIG. 5A in accordance with one or more embodiments of the disclosure.
Figure 5C:
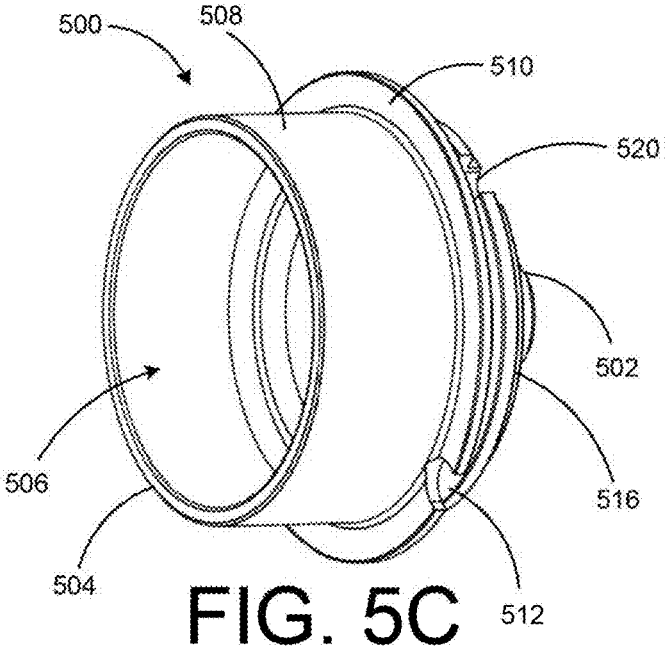
FIG. 5C depicts a perspective rear view of the baffle of FIG. 5A in accordance with one or more embodiments of the disclosure.
Figure 5D:
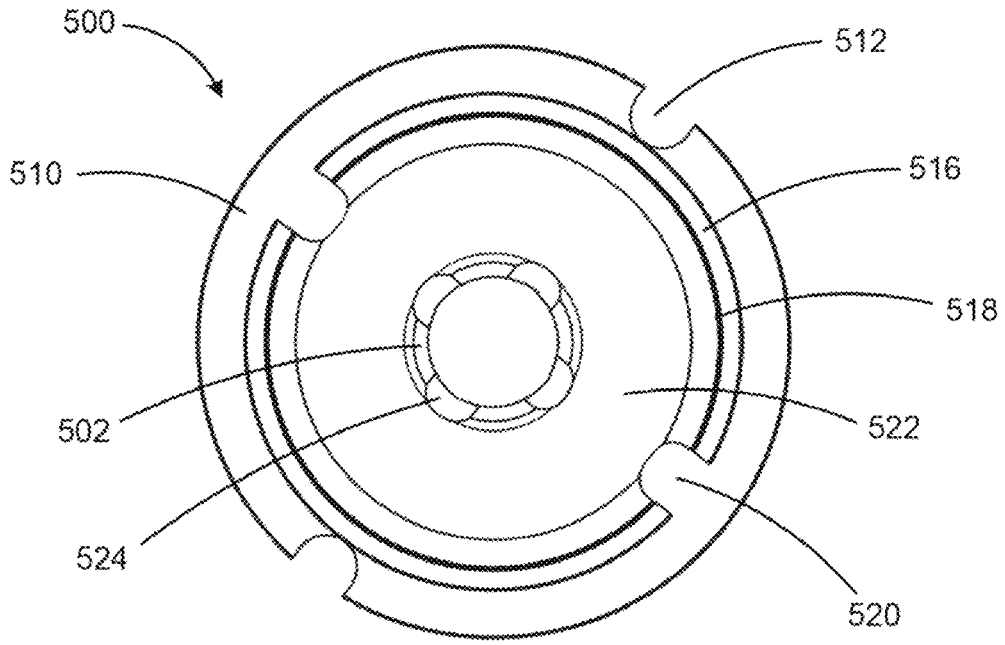
FIG. 5D depicts a front view of the baffle of FIG. 5A in accordance with one or more embodiments of the disclosure.
Figure 5E:
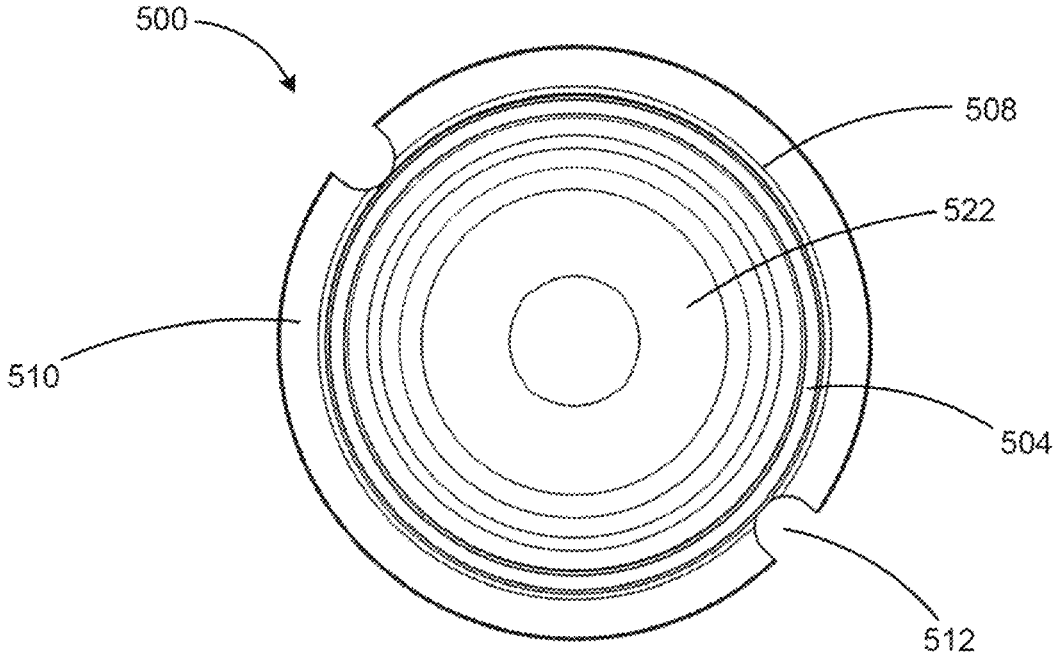
FIG. 5E depicts a rear view of the baffle of FIG. 5A in accordance with one or more embodiments of the disclosure.

Referring now to FIGS. 5A to 5E, an exemplary baffle in accordance with one or more embodiments of the disclosure is provided. Suppressor 100 may include a plurality of baffles 500, e.g., a stack including baffles 500*a*, 500*b*, 500*c*, and 500*d*, within external can 800. As will be understood by a person having ordinary skill in the art, suppressor 100 may include more or less than four baffles 500 within external can 800. FIG. 5A depicts a perspective front view of baffle 500, FIG. 5B depicts a side view of baffle 500, FIG. 5C depicts a perspective rear view of baffle 500, FIG. 5D depicts a front view of baffle 500, and FIG. 5E depicts a rear view of baffle 500. Baffle 500 may have proximal end 502, distal end 504, and passageway 506 extending therethrough through which a projectile may travel. In addition, baffle 500 may include tubular member 508, e.g., a wall extending axially from distal end 504 toward proximal end 502 having a cylindrical shape, middle portion 514, e.g., a wall extending axially from the proximal end of tubular member 508 toward proximal end 502 having a cylindrical shape, and cone insert 522 having an arcuate outer surface, e.g., a concave shape, extending from the proximal end of middle portion 514 toward proximal end 502. For example, the arcuate outer surface of cone insert 522 may have a concave curved surface that extends from a portion that extends in a direction parallel or substantially parallel to the central axis of baffle 500 to a portion that extends in a direction orthogonal or substantially orthogonal to the central axis of baffle 500 adjacent the proximal end of middle portion 514. The arcuate outer surface of cone insert 522 may be disposed about the central axis of baffle 500. In addition, proximal end 502 may include a plurality of notches 524 for facilitating the redirecting the fluid flow across the arcuate outer surface of cone insert 522. As described in further detail below, cone insert 522 may be formed of a material that is different from the material forming the other components of baffle 500 to reduce muzzle flash.

Moreover, baffle 500 may include proximal flange 516 extending circumferentially along the outer surface of baffle 500, e.g., between cone insert 522 and middle portion 514. Proximal flange 516 may include seat 518. Seat 518 may be formed in a single flange of proximal flange 516, or alternatively, proximal flange 516 may be formed by two adjacent flanges, the proximal flange of the two adjacent flanges having an outer diameter that is smaller than the outer diameter of the distal flange of the two adjacent flanges, thereby forming seat 518. The outermost diameter of proximal flange 516 may be substantially equal to the outer diameter of tubular member 508. Alternatively, the outermost proximal flange 516 may be smaller or larger than to the outer diameter of tubular member 508, but less than the diameter of the interior lumen of external can 800. Seat 518 may be shaped to engage with distal end of the component of suppressor 100 disposed proximal and adjacent to baffle 500, e.g., blast baffle 400, 500*a*, 500*b*, or 500*c*.

In addition, baffle 500 may include distal flange 510 extending circumferentially along the outer surface of baffle 500, e.g., between middle portion 514 and tubular member 508. The outer diameter of distal flange 510 may be substantially equal to the diameter of the interior lumen of external can 800. Moreover, baffle 500 may include a plurality of through-wall ports 512 circumferentially and symmetrically disposed on the outer edge of distal flange 510. Accordingly, when baffle 500 is disposed within external can 800, distal flange 510 engages with the interior wall of external can 800 except for at through-wall ports 512. As shown in FIGS. 5A to 5E, distal flange 510 may include two through-wall ports 512 symmetrically disposed about the central axis of baffle 500. As will be understood by a person having ordinary skill in the art, distal flange 510 may include less or more than two through-wall ports 512.

Baffle 500 further may include a plurality of through-wall ports 520 circumferentially and symmetrically disposed on proximal flange 516. As shown in FIG. 5B, ports 520 may extend from a proximal side of proximal flange 516, through proximal flange 516 and through at least a portion of the outer surface of middle portion 514 toward distal flange 510. Accordingly, when baffle 500 is disposed within external can 800, adjacent and distal to the adjacent baffle within external can 800, e.g., blast baffle 400, 500*a*, 500*b*, or 500*c*, and the distal end of adjacent component is engaged with seat 518 of proximal flange 516, ports 520 may provide fluid communication between the chamber formed within the interior of the proximally adjacent baffle and the chamber formed by the outer surface of the proximally adjacent baffle, external can 800 and the outer surface of baffle 500, as described in further detail below. As shown in FIG. 5D, baffle 500 may include two ports 520 symmetrically disposed about the central axis of baffle 500. As will be understood by a person having ordinary skill in the art, baffle 500 may include less or more than two ports 520. Moreover, ports 520 may be offset from through-wall ports 512, to create the longest pathway for fluid to flow from ports 520 to through-wall ports 512. For example, each port of ports 520 may be positioned at a midpoint circumferentially between adjacent ports of through-wall ports 512. In some embodiments, the ports disposed on the distal flange of each baffle may be offset from the ports on the distal flanges of the adjacent baffles, as described in further detail below.

Figure 6A:
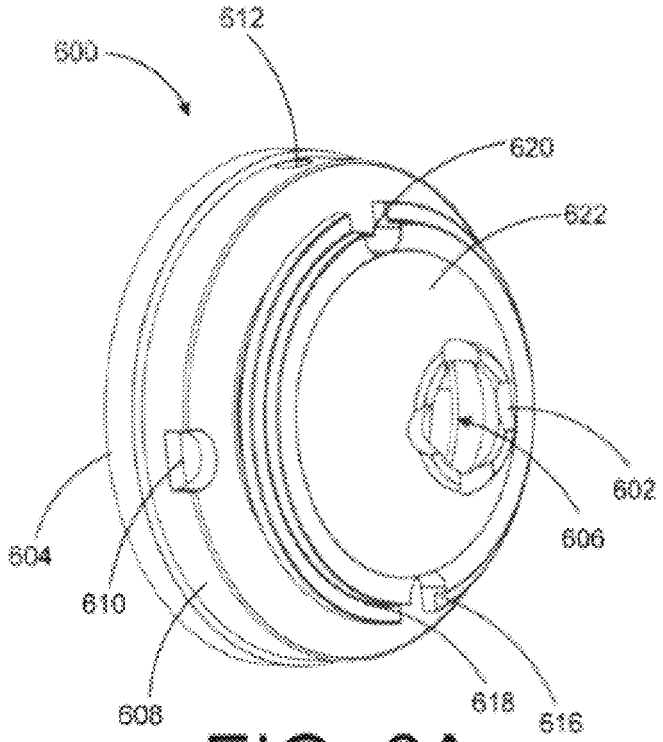
FIG. 6A depicts a perspective front view of an exemplary distal baffle in accordance with one or more embodiments of the disclosure.
Figure 6B:
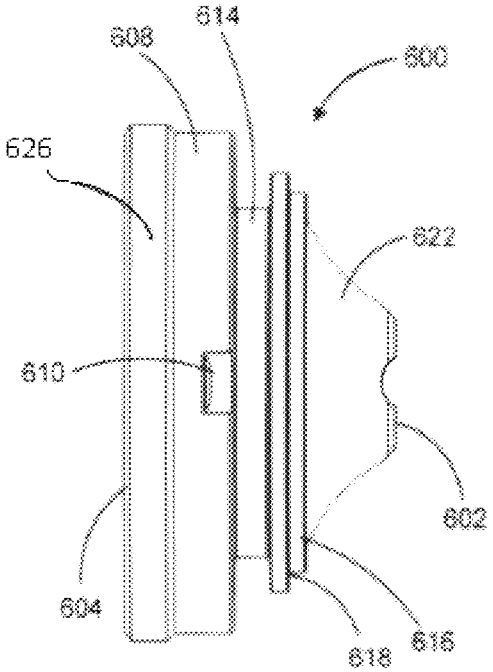
FIG. 6B depicts a side view of the distal baffle of FIG. 6A in accordance with one or more embodiments of the disclosure.
Figure 6C:
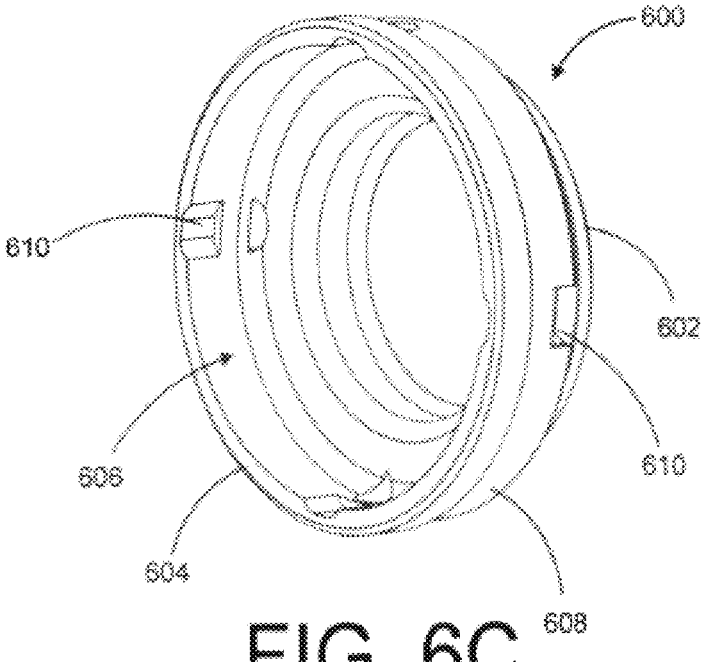
FIG. 6C depicts a perspective rear view of the distal baffle of FIG. 6A in accordance with one or more embodiments of the disclosure.
Figure 6D:
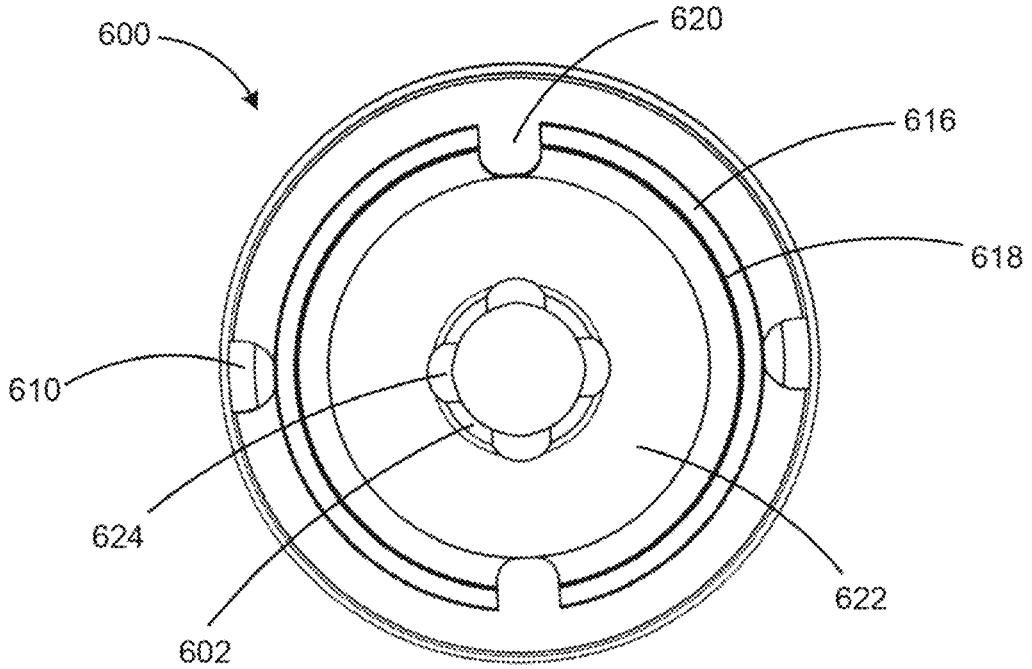
FIG. 6D depicts a front view of the distal baffle of FIG. 6A in accordance with one or more embodiments of the disclosure.
Figure 6E:
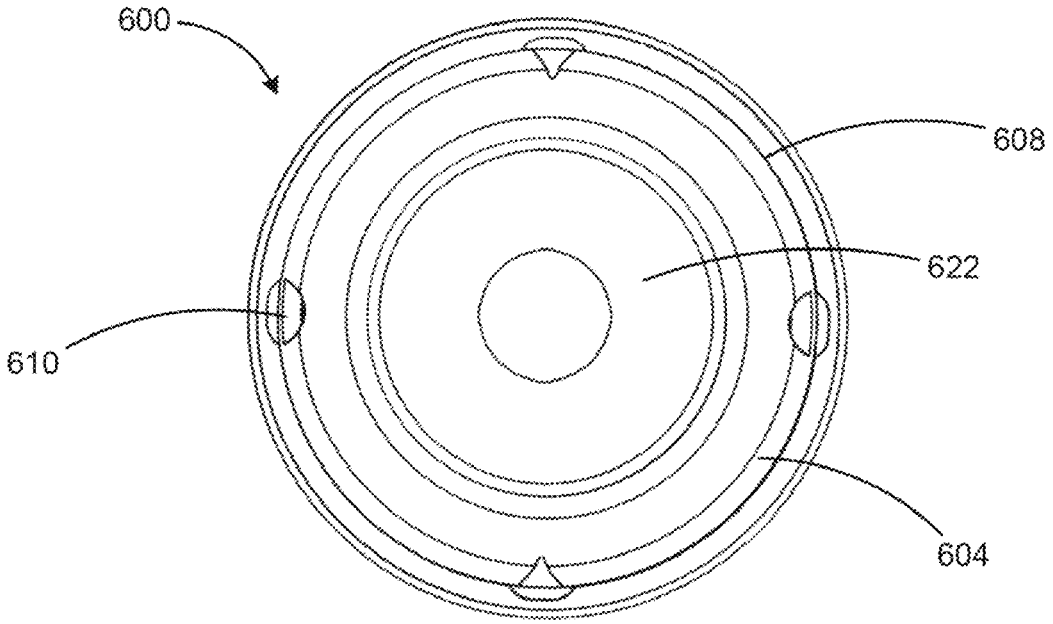
FIG. 6E depicts a rear view of the distal baffle of FIG. 6A in accordance with one or more embodiments of the disclosure.

Referring now to FIGS. 6A to 6E, an exemplary distal baffle in accordance with one or more embodiments of the disclosure is provided. FIG. 6A depicts a perspective front view of distal baffle 600, FIG. 6B depicts a side view of distal baffle 600, FIG. 6C depicts a perspective rear view of distal baffle 600, FIG. 6D depicts a front view of distal baffle 600, and FIG. 6E depicts a rear view of distal baffle 600. Distal baffle 600 may have proximal end 602, distal end 604, and passageway 606 extending therethrough through which a projectile may travel. In addition, distal baffle 600 may include tubular member 608, e.g., a wall extending axially from distal end 604 toward proximal end 602 having a cylindrical shape, middle portion 614, e.g., a wall extending axially from the proximal end of tubular member 608 toward proximal end 602 having a cylindrical shape, and cone insert 622 having an arcuate outer surface, e.g., a concave shape, extending from the proximal end of middle portion 614 toward proximal end 602. For example, the arcuate outer surface of cone insert 622 may have a concave curved surface that extends from a portion that extends in a direction parallel or substantially parallel to the central axis of distal baffle 600 to a portion that extends in a direction orthogonal or substantially orthogonal to the central axis of distal baffle 600 adjacent the proximal end of middle portion 614. The arcuate outer surface of cone insert 622 may be disposed about the central axis of distal baffle 600. In addition, proximal end 602 may include a plurality of notches 624 for facilitating the redirecting the fluid flow across the arcuate outer surface of cone insert 622. As described in further detail below, cone insert 622 may be formed of a material that is different from the material forming the other components of distal baffle 600 to reduce muzzle flash.

Tubular member 608 may have an outer diameter that is just slightly smaller than the inner diameter of external can 800. In addition, distal baffle 600 may include a plurality of through-wall ports 610 circumferentially and symmetrically disposed on the proximal edge of tubular member 608. For example, through-wall ports 610 may extend through the proximal wall of tubular member 608, along the outer edge of the proximal wall of tubular member 608. Accordingly, when distal baffle 600 is disposed within external can 800, tubular member 608 engages with the inner surface of external can 800 except at through-wall ports 610. Moreover, through-wall ports 610 may provide fluid communication between the chamber formed by the inner surface of external can 800, the outer surface of the proximally adjacent baffle, and the outer surface of distal baffle 600, and the chamber formed by the interior of distal baffle 600 and endcap 700, as described in further detail below. As shown in FIGS. 6A to 6E, tubular member 608 may include two through-wall ports 610 symmetrically disposed about the central axis of distal baffle 600. As will be understood by a person having ordinary skill in the art, tubular member 608 may include less or more than two through-wall ports 610. In addition, as shown in FIG. 6A, distal baffle 600 may include one or more apertures 612 disposed on tubular member 608, e.g., circumferentially between through-wall ports 610.

Moreover, distal baffle 600 may include proximal flange 616 extending circumferentially along the outer surface of distal baffle 600, e.g., between cone insert 622 and middle portion 614. Proximal flange 616 may include seat 618. Seat 618 may be formed in a single flange of proximal flange 616, or alternatively, proximal flange 616 may be formed by two adjacent flanges, the proximal flange of the two adjacent flanges having an outer diameter that is smaller than the distal flange of the two adjacent flanges, thereby forming seat 618. The outermost diameter of proximal flange 616 may be less than the diameter of the interior lumen of external can 800. Seat 618 may be shaped to engage with distal end of baffle 500 disposed proximal and adjacent to distal baffle 600.

Distal baffle 600 further may include a plurality of through-wall ports 620 circumferentially and symmetrically disposed on proximal flange 616. Ports 620 may extend from a proximal side of proximal flange 616, through proximal flange 616 and through at least a portion of the outer surface of middle portion 614 toward tubular member 608. Accordingly, when distal baffle 600 is disposed within external can 800, adjacent and distal to baffle 500 within external can 800, and distal end 504 is engaged with seat 618 of proximal flange 616, ports 620 may provide fluid communication between the chamber formed within the interior of the baffle 500 and the chamber formed by the outer surface of baffle 500, external can 800 and the outer surface of distal baffle 600, as described in further detail below. As shown in FIG. 6D, distal baffle 600 may include two ports 620 symmetrically disposed about the central axis of distal baffle 600. As will be understood by a person having ordinary skill in the art, distal baffle 600 may include less or more than two ports 620. Moreover, ports 620 may be offset from through-wall ports 610, to create the longest pathway for fluid to flow from ports 620 to through-wall ports 610. For example, each port of ports 620 may be positioned at a midpoint circumferentially between adjacent through-wall ports 610. Tubular member 608 may include external threads (threads not pictured) on surface 626 permitting distal baffle 600 to be threadably coupled to external can 800. As described in greater detail below, coupling of distal baffle 600 to external can 800 can compress the baffle stack within suppressor 100 and create tension in external can 800, which can stiffen suppressor 100 and increase its repeatability.

The symmetric radial wall ports of baffles 400, 500, and 600 limit turbulent gas flow through the suppressor and provide several advantages over conventional systems. Turbulent flow can cause an altered bullet path, which negatively affects accuracy of the firearm with the suppressor attached. Multiple gas ports through the baffles enables removal of more gas from the path of the projectile, which also mitigates shift of impact between a cold bore shot and subsequent shots. In some embodiments, various gas ports of the suppressor are symmetrically arranged so as to provide an even gas dispersion flow. Additionally, by rapidly venting gas to the outer portions of the suppressor, less gas is combusted within the suppressor, which leads to less visible flash caused by the flames created by gas combustion. The radial ports permit each baffle to vent gas, permitting a reduced audible and flash signature for the same size of suppressor/number of baffles. Accordingly, the communication between outer chambers created by the baffles can facilitate the same amount of noise/flash reduction using fewer baffles than conventional designs, which can decrease the overall size of the suppressor. Additionally, by venting the baffle chambers through the length of the suppressor and out of the endcap 700, little to no gas is trapped within the suppressor. This reduction in trapped gas over conventional designs permits suppressor 100 to run cooler and heat up more slowly. The symmetry of the radial ports around the baffles also permits the suppressor to be rotated relative to the host weapon without inducing a shift in point of impact.

In some embodiments, the overall length of the suppressor (including, for example, external can 800, mount 200 and endcap 700) is about 4 inches to about 10 inches, about 4 inches to about 9 inches, about 4 inches to about 8 inches, about 4 inches to about 7, about 4 inches to about 6 inches, about 6 inches to about 10 inches, or about 6 inches to about 8 inches.

In some embodiments, one or more baffles disclosed herein may be threadably connected or may be permanently connected by welding and/or other suitable means. In some embodiments, the baffle stack may be formed as a single piece monocore, wherein two or more of the proximal baffle, intermediate baffles and distal baffle are formed as a single piece.

Figure 7A:
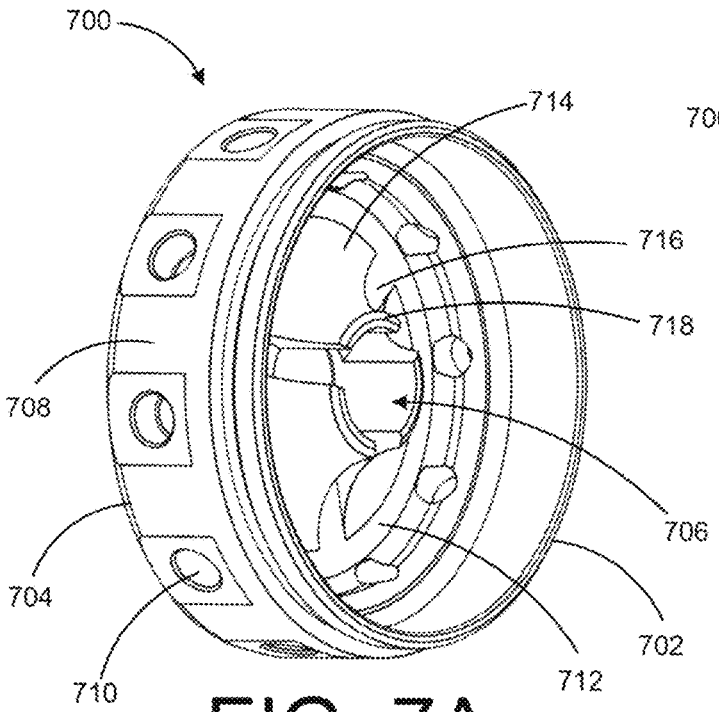
FIG. 7A depicts a perspective front view of an exemplary endcap in accordance with one or more embodiments of the disclosure.
Figure 7B:
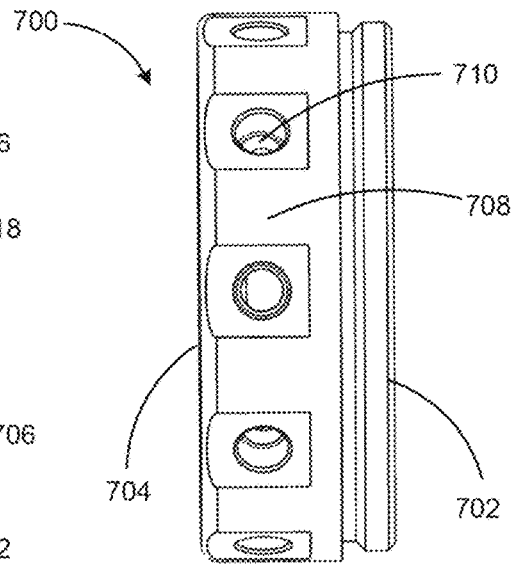
FIG. 7B depicts a side view of the endcap of FIG. 7A in accordance with one or more embodiments of the disclosure.
Figure 7C:
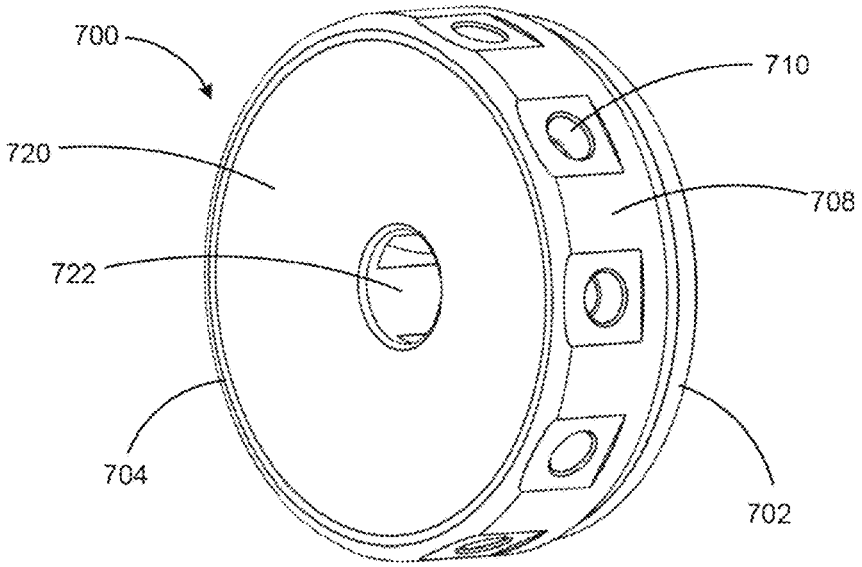
FIG. 7C depicts a perspective rear view of the endcap of FIG. 7A in accordance with one or more embodiments of the disclosure.
Figure 7D:
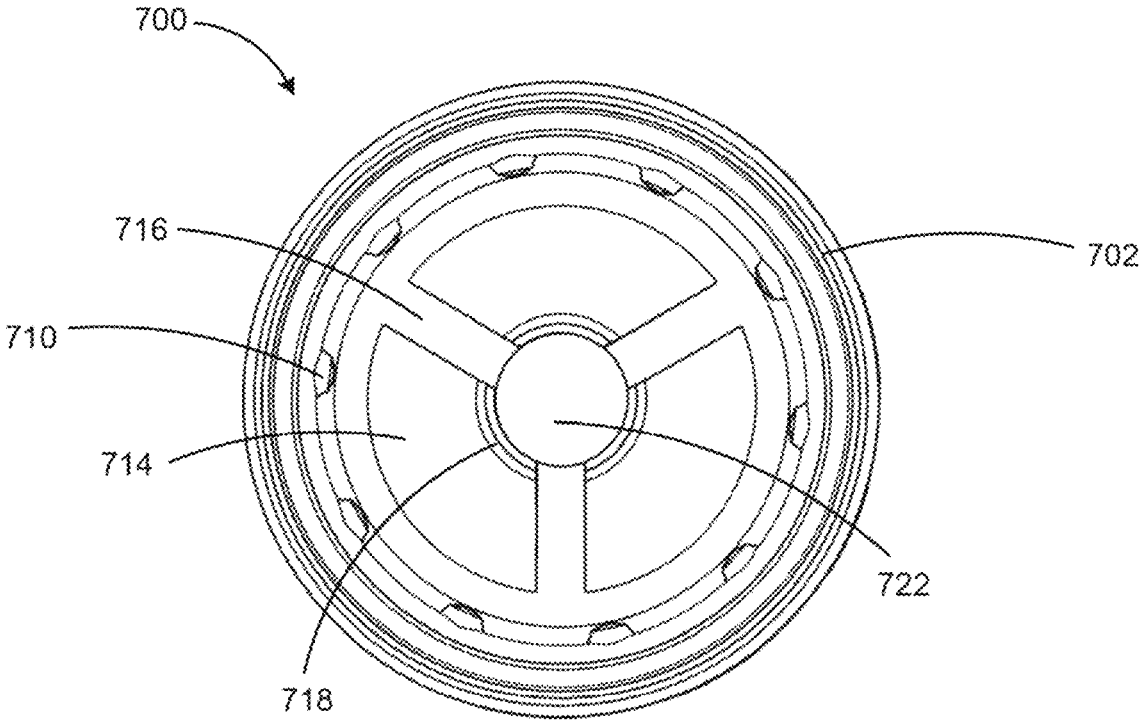
FIG. 7D depicts a front view of the endcap of FIG. 7A in accordance with one or more embodiments of the disclosure.
Figure 7E:
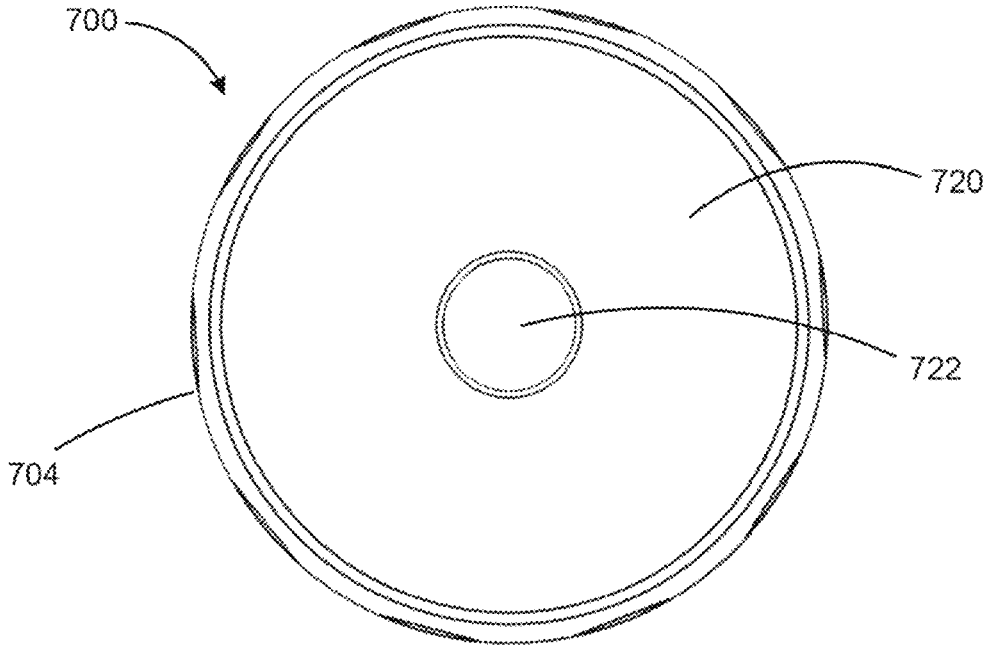
FIG. 7E depicts a rear view of the endcap of FIG. 7A in accordance with one or more embodiments of the disclosure.

Referring now to FIGS. 7A to 7E, an exemplary endcap in accordance with one or more embodiments of the disclosure is provided. FIG. 7A depicts a perspective front view of endcap 700, FIG. 7B depicts a side view of endcap 700, FIG. 7C depicts a perspective rear view of endcap 700, FIG. 7D depicts a front view of endcap 700, and FIG. 7E depicts a rear view of endcap 700. Endcap 700 may have tubular body 708 with proximal end 702, distal end 704, and passageway 706 extending therethrough through which a projectile may travel. Endcap 700 may have rear wall 720 coupled to distal end 704, and wall 720 may include outlet 722 aligned with passageway 706 through which a projectile may travel. In addition, proximal end 702 of endcap 700 may be removably coupled to the distal end of external can 800. For example, endcap 700 may include one or more screw threads along the outer surface at proximal end 702. The one or more screw threads may be configured to engage and be threadably coupled to a threaded surface at the distal end of external can 800. Alternatively, proximal end 702 may be coupled to the distal end of external can 800 via welding, adhesives, or any other method known to those of ordinary skill in the art.

Endcap 700 may include a plurality of through-wall ports 710 disposed circumferentially and radially along the perimeter of tubular body 708. For example, endcap 700 may include 2, 3, 4, 5, 6, 7, 8, 9, 10, 11, 12, or more through-wall ports 710. In some embodiments, the through-wall ports 710 are evenly spaced from each other. Accordingly, when endcap 700 is coupled to external can 800, ports 710 may provide fluid communication between the chamber formed by distal baffle 600 and endcap 700 and the atmosphere external to suppressor 100. In some instances, the ports 710 may be threaded such that a set screw or the like may be inserted into one or more of the ports 710. In this manner, a user may block or "plug" one or more of the ports 710 to adjust the flow of gas exiting the ports 710.

In addition, endcap 700 may include conical ramp 714 extending from proximal side 712 of wall 720 to edge 718 toward proximal end 702. Ramp 714 may be disposed circumferentially about the central axis of endcap 700, and may have an aperture extending therethrough forming passageway 706. Ramp 714 may have an arcuate surface, e.g., a concave curved surface, that extends from a portion that extends in a direction parallel or substantially parallel to the central axis of endcap 700 to a portion that extends in a direction orthogonal or substantially orthogonal to the central axis of endcap 700 adjacent to proximal side 712 of wall 720.

Moreover, ramp 714 may include one or more channels 716 extending from an outer edge of ramp 714 towards passageway 706. Channels 716 may break up and create turbulence in the fluid flow as the fluid hits proximal side 712 of wall 720 disposed within channels 716, e.g., cross-jetting. As shown in FIG. 7D, ramp 714 may include three channels 716. As will be understood by a person having ordinary skill in the art, ramp 714 may include less or more than three channels 716. Accordingly, fluid will be directed through passageway 706, as well as across the arcuate surface of ramp 714 and out through ports 710 in a radial direction orthogonal or substantially orthogonal to the central axis of endcap 700. Channels 716 also create a plurality of ramps 714 (in the example illustrated by FIG. 7D, there are three ramps 714), which can also function together a flash hider. For example, as illustrated in FIGS. 7A and 7D, the ramps can form a three-prong flash hider to aid in flash mitigation (e.g., the firearm will produce less visible flash at the muzzle when fired).

Radially vented endcap 700 provides several advantages over conventional suppressors. The ability to plug ports 710 can provide the user with the ability to tune a reaction of the firearm on the shot. Additionally, the user can control the direction in which gas is vented. For example, if a user is shooting the firearm from a prone position (lying on the ground), the user may want to plug one or more of the ports 710 located on the bottom of endcap 700 to prevent a large of amount dust or dirt being kicked up from gas being vented directly at the ground. By plugging bottom ports, the endcap 700 will vent gas up and to the sides, thus decreasing or eliminating dust kicked up by the firearm and improving the user's visibility after the first initial shot. Additionally, the user may be able to fine tune the natural reaction of the firearm after a shot. For example, a certain firearm may naturally move up and to the right after a shot. A user may plug one or more ports 710 on the bottom and left of endcap 700. This can cause more gas to be vented out of the top and right sides of endcap 700, imparting a leftward and downward force on the muzzle end of the firearm, which can counteract the firearm's natural rise and rightward motion after a shot. By limiting such post-shot movement of the firearm, a shooter may be able to stay on target and more quickly fire follow-up shots.

As yet another advantage, the user may be able to fine tune the signature and recoil of the firearm by selectively plugging or unplugging ports 710. Relatively more open ports may decrease felt recoil, but relatively increase the sound of the firearm upon firing. Conversely, relatively fewer open ports may result in increased recoil, but a reduced sound signature. Accordingly, a user can fine tune endcap 700 to best suit the user's particular application. Radial venting of endcap 700 generally reduces felt recoil of the shooter because it the gases are vented symmetrically and outwardly, thus their forces offset each other. By contrast, systems that vent all gas forward do not experience such force offset, thus the reaction force of this forward venting is felt as recoil by the shooter. Moreover, while ports 710 are depicted as being of equal size, in some embodiments, port size may vary. For example, endcap 700 may include two port sizes and the port sizes may be alternated around the outside of endcap 700. As another example, one or more larger ports may be placed on a top side of endcap 700 to vent more gas upward and to the sides and away from the ground (thus reducing dust kick-up, as described above).

Figure 8A:
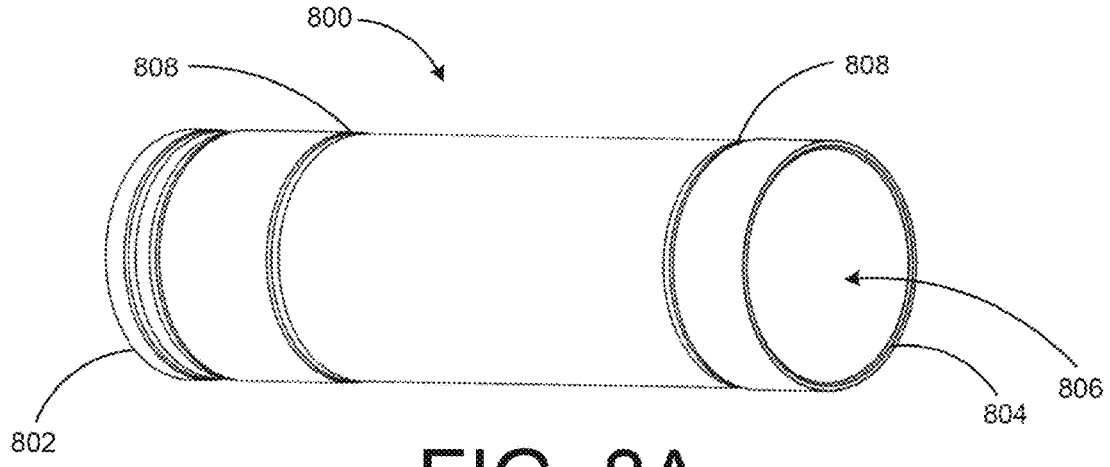
FIG. 8A depicts a perspective rear view of an exemplary can for use with the suppressor of FIG. 1A in accordance with one or more embodiments of the disclosure.
Figure 8B:
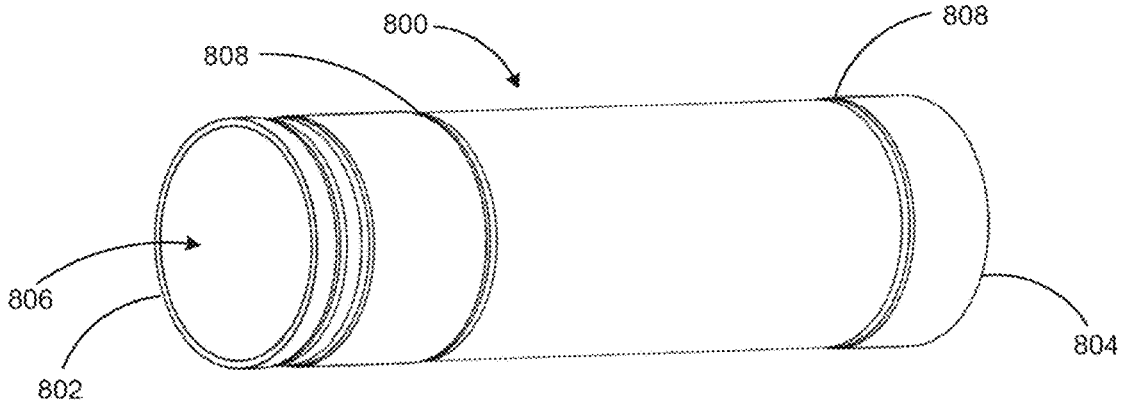
FIG. 8B depicts a perspective front view of the can of FIG. 8A in accordance with one or more embodiments of the disclosure.
Figure 8C:
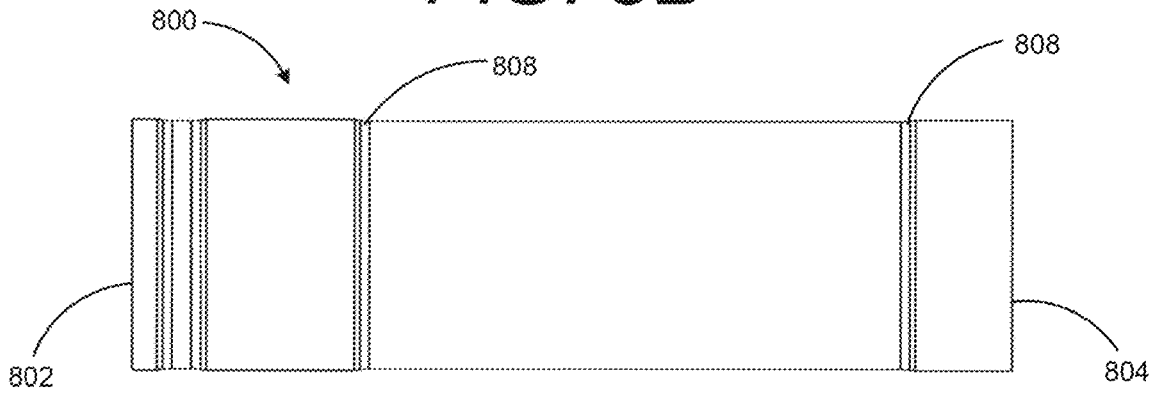
FIG. 8C depicts a side view of the can of FIG. 8A in accordance with one or more embodiments of the disclosure.
Figure 9A:
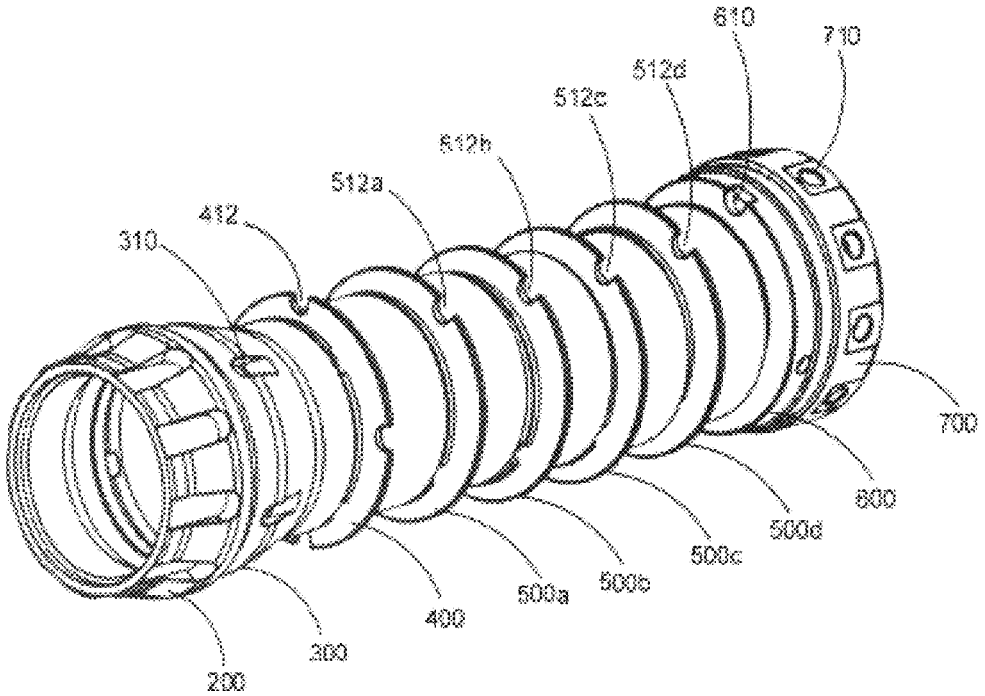
FIG. 9A depicts a front perspective view of the suppressor assembly of FIG. 1A with the can omitted in accordance with one or more embodiments of the disclosure.
Figure 9B:
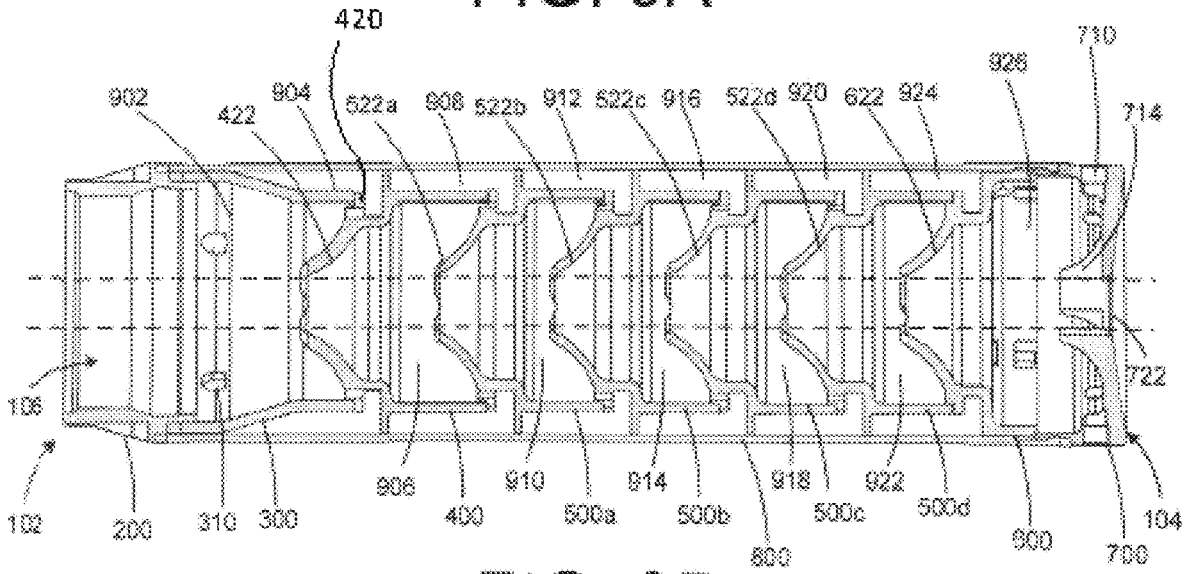
FIG. 9B depicts a cross-sectional side view of the suppressor assembly of FIG. 1A with the can omitted in accordance with one or more embodiments of the disclosure.

Referring now to FIGS. 8A to 8E, an exemplary external can in accordance with one or more embodiments of the disclosure is provided. FIG. 8A depicts a perspective rear view of external can 800, FIG. 8B depicts a perspective front view of external can 800, and FIG. 8C depicts a side view of external can 800. External can 800 may include proximal end 802, distal end 804, and a wall having an outer surface and an inner surface defining passageway 806 that extends axially through external can 800 along the central axis of external can 800 from proximal end 802 to distal end 804. For example, external can 800 may have a cylindrical shape. In addition, external can 800 may be substantially hollow such that passageway 806 makes up a substantial portion of the diameter of external can 800. Moreover, external can 800 may include one or more circumferential grooves 808 on the outer surface of external can 800. Each of one or more grooves 808 may be substantially orthogonal to central axis of the external can 102 and may be axially separated along the longitudinal axis of external can 800. At the location of grooves 808, the outer diameter of external can 800 may change. In some embodiments, the internal diameter of external can 800 may change proportionally to the change in external diameter. The change in diameter may facilitate a seal between the outer flanges of baffles (e.g., baffles 500) and the inner surface of passageway 806. In other embodiments, e.g., as shown in FIG. 9B described below, the inner diameter of external can 800 may be consistent, even when outer diameter of external can 800 decreases at circumferential grooves 808. As described above, proximal end 802 may include a threaded surface for being removably coupled to mount 200, and distal end 804 may include a threaded surface for being removably coupled to endcap 700. Alternatively, proximal end and distal end of external can 800 may be coupled to mount 200 and endcap 700, respectively, via welding, adhesives, or any other method known to those of ordinary skill in the art.

In some embodiments, distal end 804 can include internal threads on the walls of passageway 806 that extend to approximately the distal circumferential groove 808. As described herein, distal baffle 600 may engage with such threads to couple distal baffle 600 external can 800. Such coupling of distal baffle 600 with external can 800 (and mount 200) can cause compression of the baffle stack (e.g., the series of baffles 400, 500*a*, 500*b*, 500*c*, 500*d*, and 600 as illustrated in FIGS. 9A and 9B described in greater detail below) and create tension in external can 800. This compression of the baffle stack and corresponding tension in external can 800 can stiffen the assembly of suppressor 100, causing it flex less during a shot and move less from shot to shot. This stiffening can make the suppressor more repeatable and accurate because such decrease in movement of the suppressor lessens any deviation in the gas flow through the suppressor from shot to shot and thus provides a consistent bullet path through the suppressor.

FIG. 9A illustrates the components of suppressor 100 coupled together, with external can 800 omitted for clarity. As shown in FIG. 9A, through-wall port 412 of blast baffle 400 may be offset from through-wall port 512*a* of baffle 500*a*. Although FIG. 9A illustrates through-wall ports 512*a*, 512*b*, 512*c*, and 512*d* as being aligned, as described above, each port may be offset from the adjacent port(s), in an alternating manner, to thereby provide the longest path for fluid to flow from baffle to baffle. Moreover, port 412 of blast baffle 400 may be offset from through-wall port 310 of spacer 300, and through-wall port 512*d* of baffle 500*d* may be offset from port 610 of distal baffle 600.

FIG. 9B depicts a cross-sectional side view of suppressor 100 with the components of suppressor 100 coupled together. As shown in FIG. 9B, mount 200 may be coupled to both spacer 300 and the proximal end of external can 800, with spacer 300 disposed within external can 800 and coupled to blast baffle 400, which is coupled to baffle 500*a*, which is coupled to baffle 500*b*, which is coupled to baffle 500*c*, which is coupled to baffle 500*d*, which is coupled to distal baffle 600, which is coupled to endcap 700, which is coupled to the distal end of external can 800. Accordingly, chamber 902 is formed by the inner surface of mount 200, the inner surface of spacer 300, and the outer surface of cone insert 422 of blast baffle 400, chamber 904 is formed by the outer surface of spacer 300, the inner surface of external can 800, and the outer surface of blast baffle 400, chamber 906 is formed by the inner surface of blast baffle 400 and the outer surface of cone insert 522*a* of baffle 500*a*, chamber 908 is formed by the outer surface of blast baffle 400, the inner surface of external can 800, and the outer surface of baffle 500*a*, chamber 910 is formed by the inner surface of baffle 500*a* and the outer surface of cone insert 522*b* of baffle 500*b*, chamber 912 is formed by the outer surface of baffle 500*a*, the inner surface of external can 800, and the outer surface of baffle 500*b*, chamber 914 is formed by the inner surface of baffle 500*b* and the outer surface of cone insert 522*c* of baffle 500*c*, chamber 916 is formed by the outer surface of baffle 500*b*, the inner surface of external can 800, and the outer surface of baffle 500*c*, chamber 918 is formed by the inner surface of baffle 500*c* and the outer surface of cone insert 522*d* of baffle 500*d*, chamber 920 is formed by the outer surface of baffle 500*c*, the inner surface of external can 800, and the outer surface of baffle 500*d*, chamber 922 is formed by the inner surface of baffle 500*d* and the outer surface of cone insert 622 of distal baffle 600, chamber 924 is formed by the outer surface of baffle 500*d*, the inner surface of external can 800, and the outer surface of distal baffle 600, and chamber 926 is formed by the inner surface of distal baffle 600 and inner surface of endcap 700.

As shown in FIG. 9B, the bore extending through suppressor 100 is denoted by the dashed lines, which may be aligned with the bore of the firearm when suppressor 100 is coupled to the firearm through which a projectile may travel. Accordingly, as a projectile travels through the bore of suppressor 100 from proximal end 102 to distal end 104 of suppressor 100, exhaust gas within chamber 902 may travel to chamber 904 and equalize therein via through-wall ports 310 and ports 420 of blast baffle 400, and to chamber 906 via passageway 406 (the center passageway of blast baffle 400, as illustrated in FIG. 4A). The exhaust gas within chamber 904 further may travel to chamber 908 via through-wall ports 412, from chamber 908 to chamber 912 via through-wall ports 512*a*, from chamber 912 to chamber 916 via through-wall ports 512*b*, from chamber 916 to chamber 920 via through-wall ports 512*c*, from chamber 920 to chamber 924 via through-wall ports 512*d*, from chamber 924 to chamber 926 via through-wall ports 610, and from chamber 926 to the atmosphere external to suppressor 100 via ports 710 in endcap 700. Moreover, the exhaust gas from chamber 906 further may travel to chamber 908 and equalize therein via ports 520*a*, and to chamber 910 via passageway 506*a*. The exhaust gas from chamber 910 further may travel to chamber 912 and equalize therein via ports 520*b*, and to chamber 914 via passageway 506*b*. The exhaust gas from chamber 914 further may travel to chamber 916 and equalize therein via ports 520*c*, and to chamber 918 via passageway 506*c*. The exhaust gas from chamber 918 further may travel to chamber 920 and equalize therein via ports 520*d*, and to chamber 922 via passageway 506*d*. The exhaust gas from chamber 922 further may travel to chamber 924 and equalize therein via ports 620, and to chamber 926 via passageway 606. The pressure of the exhaust gas may drop, e.g., 20-30% in each chamber from proximal end 102 to distal end 104 through suppressor 100. Moreover, the exhaust gas is distributed evenly across suppressor 100 due to the symmetry of suppressor 100 as described above.

For example, in some embodiments, the pressure of the exhaust gas may reach a maximum value of 150 psi in chamber 926. In other embodiments, for example, when a larger number of through-wall ports 710 of endcap 700 are closed, the pressure may reach a maximum value of 250 psi. In yet further embodiments, for example, when all of the through-wall ports 710 of endcap 700 are closed, the pressure may reach a maximum of 300 psi. In addition to more uniform pressure distribution, disclosed embodiments can provide further improvements in suppressor effectiveness.

For example, one or more embodiments of the disclosed suppressor assembly may reduce muzzle flash to a visibly detectable range of ± about 45 degrees, about 40 degrees, about 35 degrees, about 30 degrees, about 25 degrees, about 20 degrees, or about 15 degrees relative to the longitudinal axis 101 of suppressor 100. One or more embodiments of the disclosed suppressor assembly may reduce the audible report of a shot of the firearm to less than about 150 DB, less than about 140 DB, less than about 130 DB, less than about 120 DB, less than about 110 DB, or less than about 110 DB. Similarly, one or more embodiments of the disclosed suppressor assembly may provide a sound reduction, as compared to the same firearm unsuppressed, of at least 10 DB, at least 15 DB, at least 20 DB, at least 25 DB, at least 30 DB, at least 35 DB, at least 40 DB, at least 45 DB, at least 50 DB, at least 55 DB, or at least 60 DB. As described herein, one or more embodiments of the disclosed suppressor assembly may also reduce recoil of the firearm, by up to 30 percent, up to 40 percent, up to 50 percent, or more, as compared to the same firearm when fired without a suppressor.

Figure 10A:
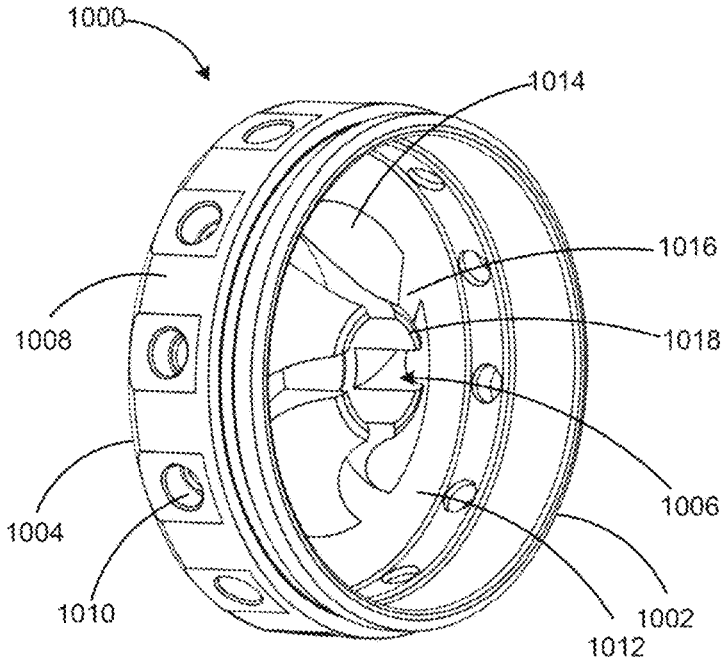
FIG. 10A depicts a perspective front view of an alternative exemplary endcap in accordance with one or more embodiments of the disclosure.
Figure 10B:
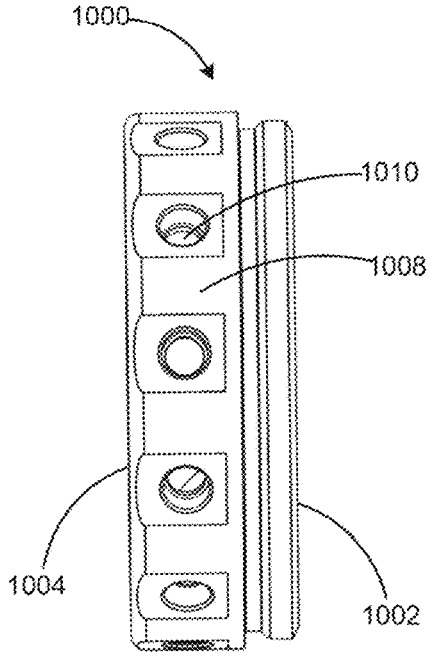
FIG. 10B depicts a side view of the endcap of FIG. 10A in accordance with one or more embodiments of the disclosure.
Figure 10C:
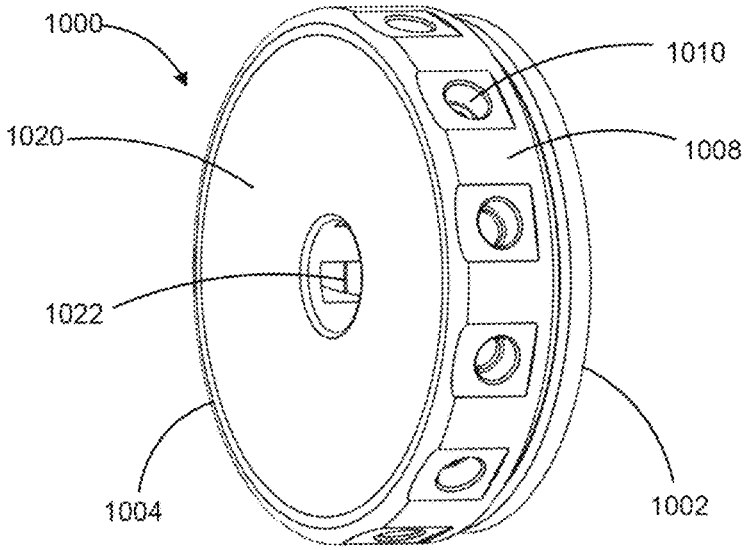
FIG. 10C depicts a perspective rear view of the endcap of FIG. 10A in accordance with one or more embodiments of the disclosure.
Figure 10D:
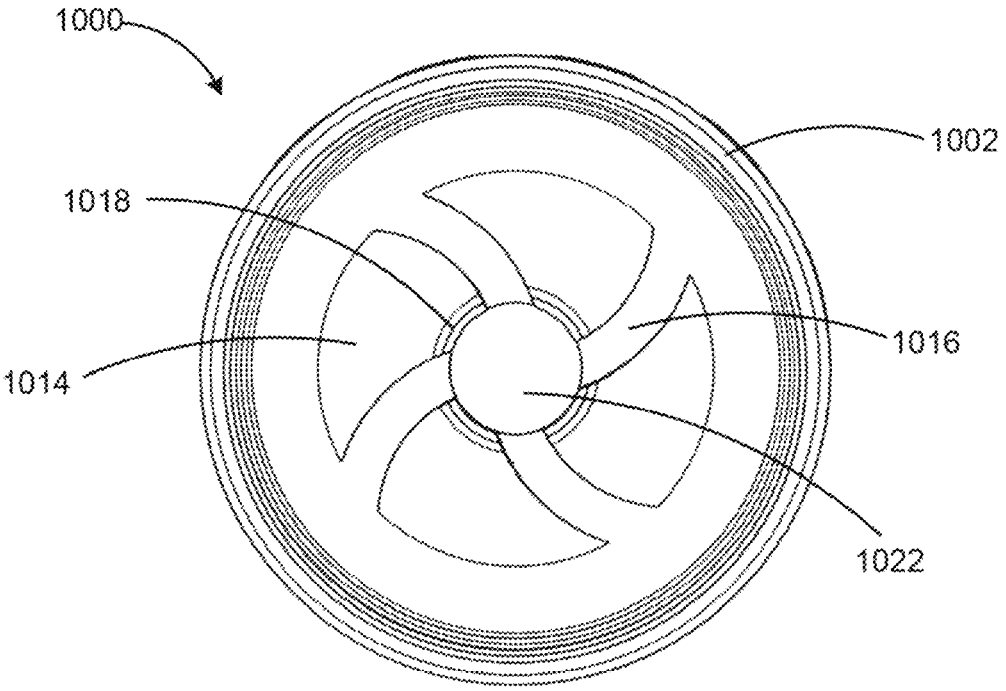
FIG. 10D depicts a front view of the endcap of FIG. 10A in accordance with one or more embodiments of the disclosure.
Figure 10E:
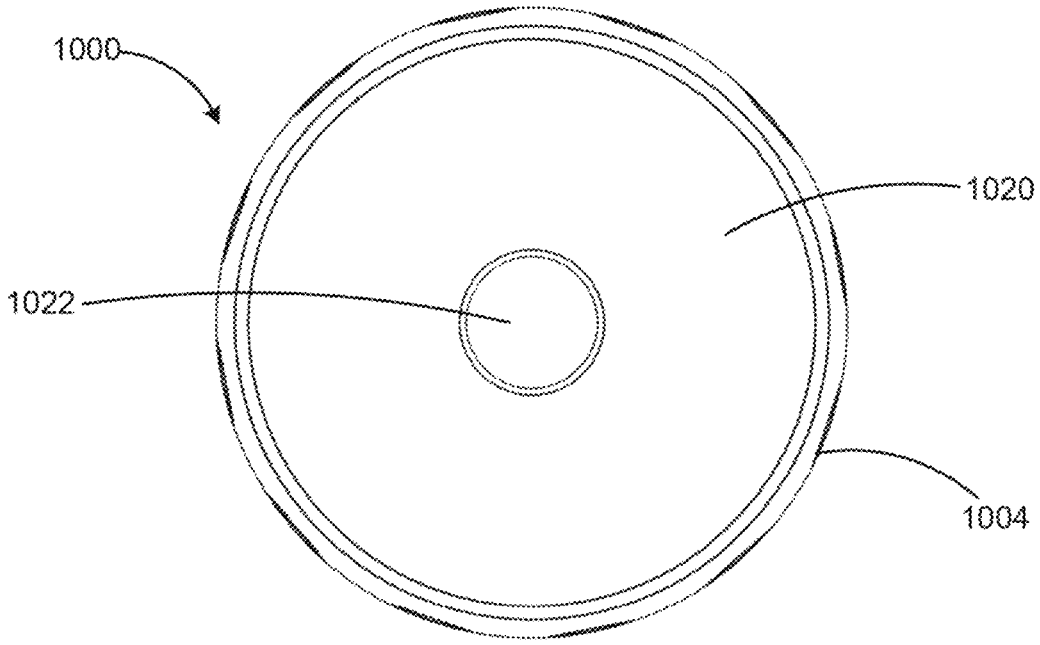
FIG. 10E depicts a rear view of the endcap of FIG. 10A in accordance with one or more embodiments of the disclosure.

Referring now to FIGS. 10A to 10E, an alternative exemplary endcap in accordance with one or more embodiments of the disclosure is provided. FIG. 10A depicts a perspective front view of endcap 1000, FIG. 10B depicts a side view of endcap 1000, FIG. 10C depicts a perspective rear view of endcap 1000, FIG. 10D depicts a front view of endcap 1000, and FIG. 10E depicts a rear view of endcap 1000. Endcap 1000 may be constructed similar to endcap 700. For example, tubular body 1008 can correspond to tubular body 708, rear wall 1020 can correspond to rear wall 720, outlet 1022 can correspond to outlet 722, through-wall ports 1010 can correspond to through-wall ports 710, and passageway 1006 can correspond to passageway 706. Endcap 1000 differs from endcap 700 in the construction of ramp 1014 (as compared to ramp 714 of endcap 700).

Like endcap 700, endcap 1000 may include rear wall 1020 coupled to distal end 1004. Endcap 1000 may further include conical ramp 1014 extending from proximal side 1012 of wall 1020 to edge 1018 toward proximal end 1002. Ramp 1014 may be disposed circumferentially about the central axis of endcap 1000, and may have an aperture extending therethrough forming passageway 1006. Ramp 1014 may have an arcuate surface, e.g., a concave curved surface, that extends from a portion that extends in a direction parallel or substantially parallel to the central axis of endcap 1000 to a portion that extends in a direction orthogonal or substantially orthogonal to the central axis of endcap 1000 adjacent to proximal side 1012 of wall 1020. In some instances, the ramp may include a swirl configuration so as to direct gas in a clockwise or counter-clockwise flow towards the through-wall ports 1010.

Moreover, ramp 1014 may include one or more channels 1016 extending from an outer edge of ramp 1014 towards passageway 1006. Channels 1016 may break up and create turbulence in the fluid flow as the fluid hits proximal side 1012 of wall 1020 disposed within channels 1016, e.g., cross-jetting. However, unlike channels 716 of endcap 700, channels 716 may extend in a curved (e.g., "swirled") manner from the outer edge of ramp 1014 towards passageway 1006. As shown in FIG. 10D, ramp 1014 may include four channels 1016. As will be understood by a person having ordinary skill in the art, ramp 1014 may include less or more than four channels 1016. Accordingly, fluid will be directed through passageway 1006, as well as across the arcuate surface of ramp 1014 and out through through-wall ports 1010 in a radial direction orthogonal to the central axis of endcap 1000. Although previously described embodiments refer to endcap 700 (e.g., those described with reference to FIGS. 1C, 9A, 9B, etc.), endcap 1000 may be interchanged with endcap 700 and implemented in such embodiments.

Figure 11A:
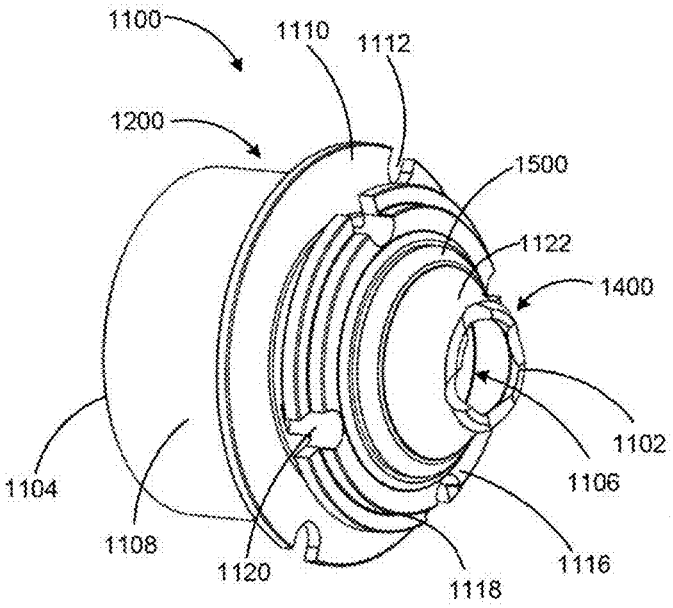
FIG. 11A depicts a perspective front view of an exemplary multi-material baffle in accordance with one or more embodiments of the disclosure.
Figure 11B:
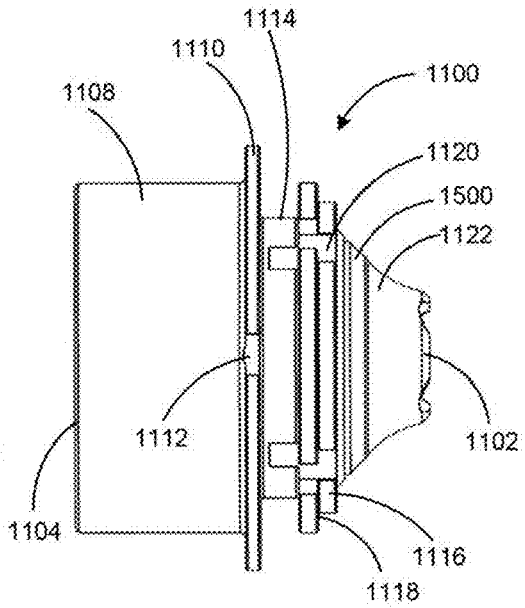
FIG. 11B depicts a side view of the multi-material baffle of FIG. 11A in accordance with one or more embodiments of the disclosure.
Figure 11C:
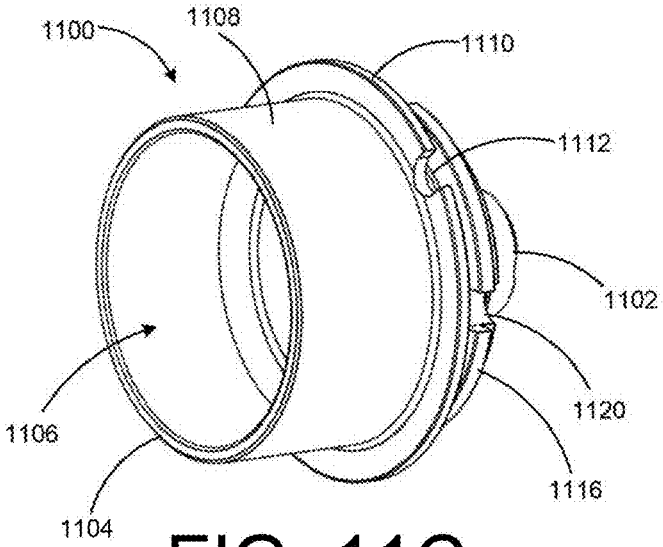
FIG. 11C depicts a perspective rear view of the multi-material baffle of FIG. 11A in accordance with one or more embodiments of the disclosure.
Figure 11D:
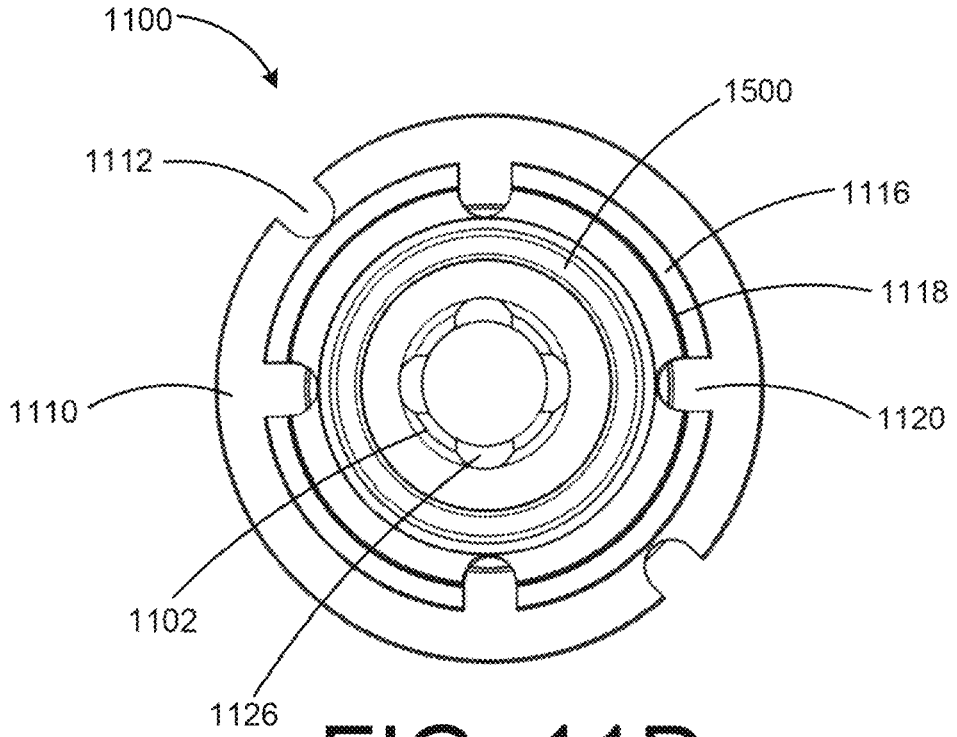
FIG. 11D depicts a front view of the multi-material baffle of FIG. 11A in accordance with one or more embodiments of the disclosure.
Figure 11E:
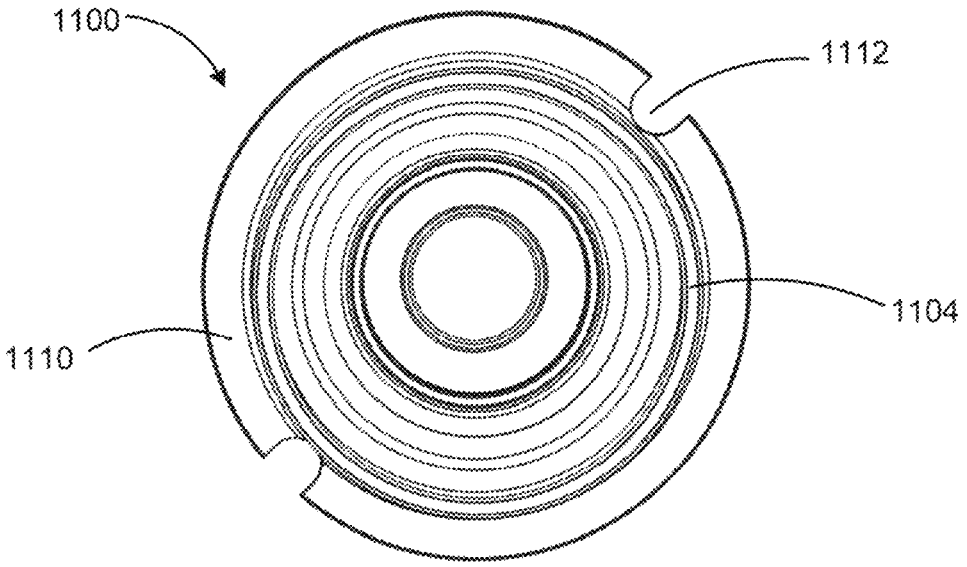
FIG. 11E depicts a rear view of the multi-material baffle of FIG. 11A in accordance with one or more embodiments of the disclosure.
Figure 11F:
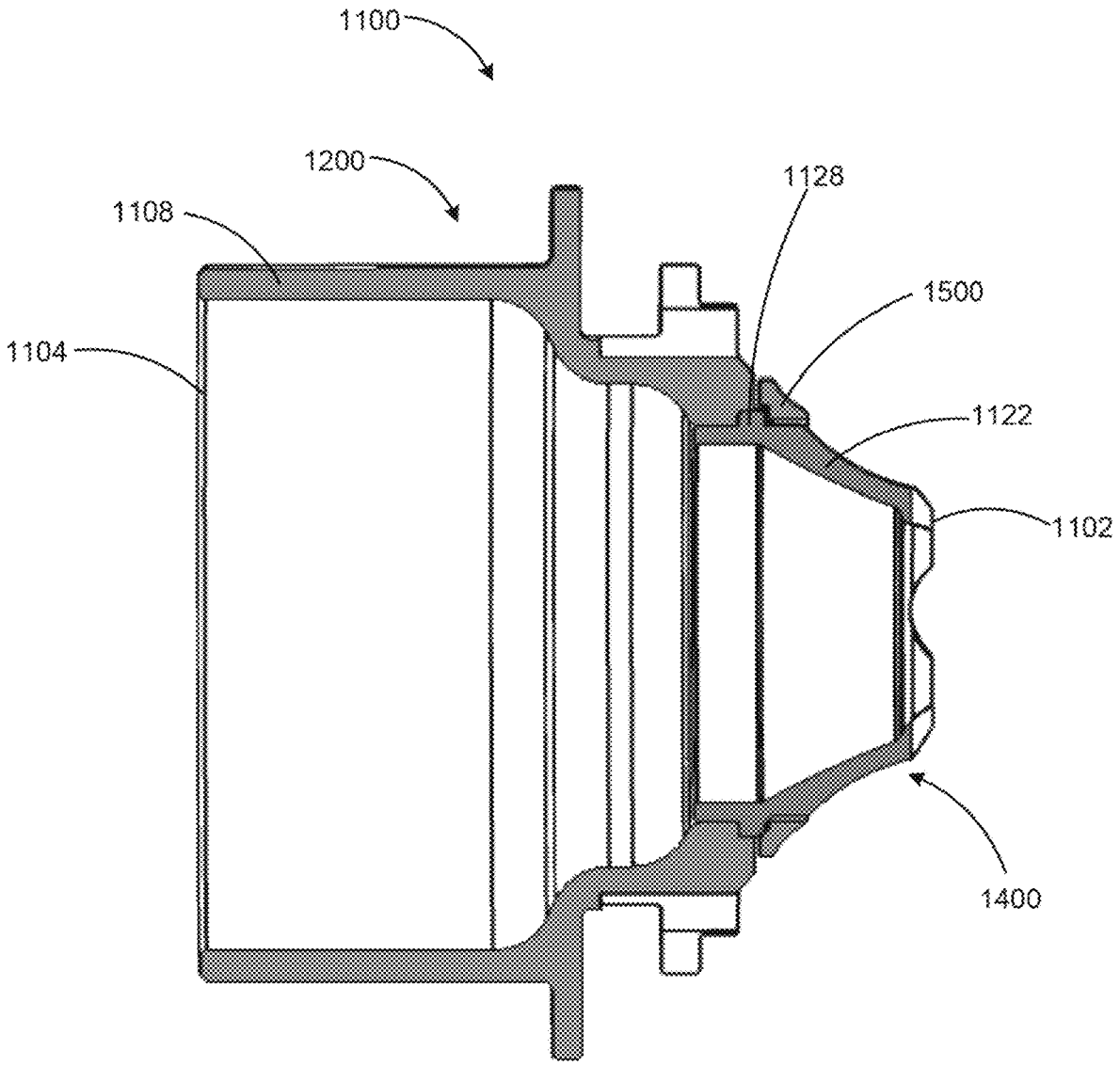
FIG. 11F depicts a cross-sectional side view of the multi-material baffle of FIG. 11A in accordance with one or more embodiments of the disclosure.
Figure 11G:
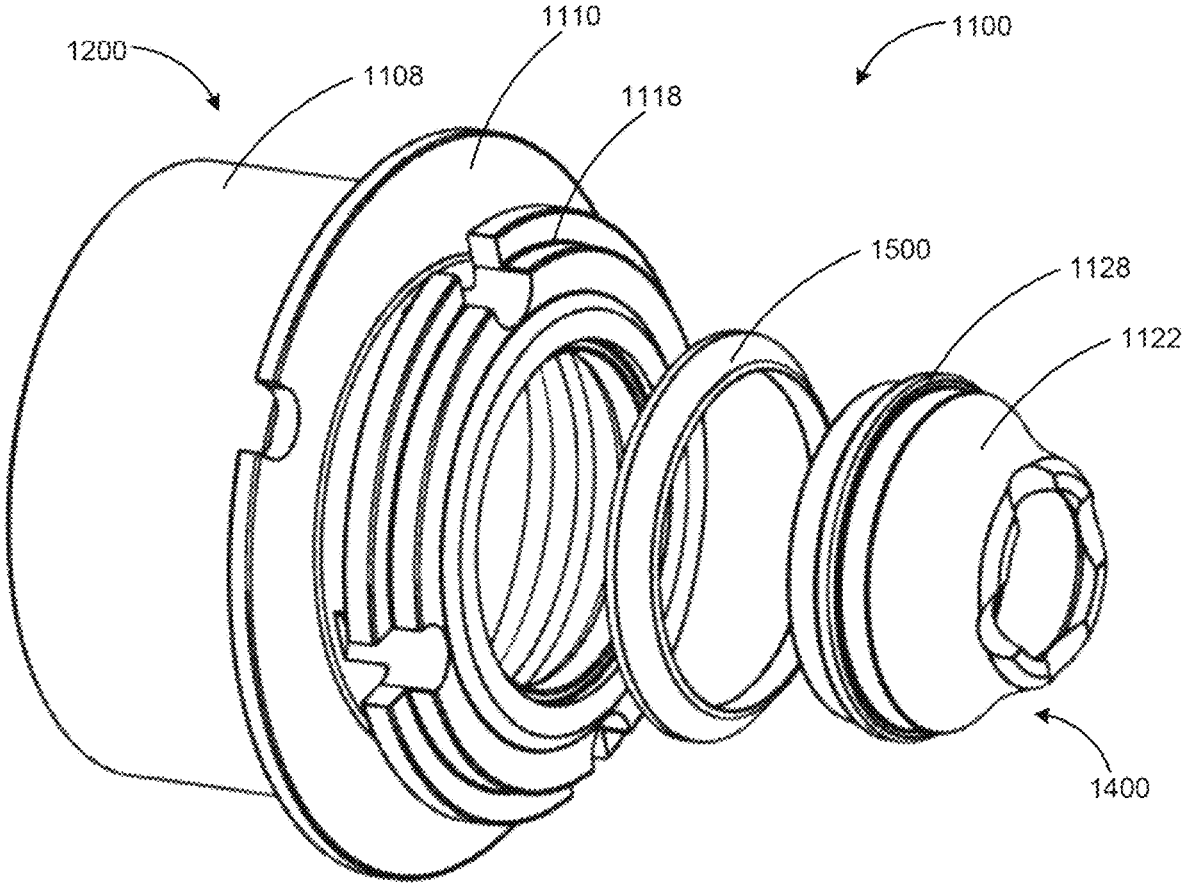
FIG. 11G depicts and exploded front view of the multi-material baffle of FIG. 11A in accordance with one or more embodiments of the disclosure.

Referring now to FIGS. 11A to 11G, an exemplary baffle in accordance with one or more embodiments of the disclosure is provided. FIG. 11A depicts a perspective front view of baffle 1100, FIG. 11B depicts a side view of baffle 1100, FIG. 11C depicts a perspective rear view of baffle 1100, FIG. 11D depicts a front view of baffle 1100, FIG. 11E depicts a rear view of baffle 1100, FIG. 11F depicts a cross-sectional side view of baffle 1100, and FIG. 11G depicts an exploded perspective front view of baffle 1100. Baffle 1100 may be constructed similar to blast baffle 400 and/or baffle 500, and may be used in suppressor 100 in place of blast baffle 400 and/or baffle 500.

Baffle 1100 may include distal portion 1200, which is described in further detail with regard to FIGS. 12A to 12E, cone insert 1400, which is described in further detail with regard to FIGS. 14A to 14E, and weld ring 1500, which is described in further detail with regard to FIGS. 15A to 15E. Alternatively, instead of distal portion 1200, baffle 1100 may include distal portion 1300, which is described in further detail with regard to FIGS. 13A to 13E. Accordingly, with distal portion 1300, baffle 1100 may be used to replace, e.g., baffle 500, and with distal portion 1200, baffle 1100 may be used to replace blast baffle 400.

As shown in FIG. 11F, cone insert 1400 may be sandwiched between the proximal end of distal portion 1200 and weld ring 1500. Specifically, as described in further detail below, cone insert 1400 may include ridge 1128 extending circumferentially along the outer surface of a distal portion of cone insert 1400, such that distal portion 1200 and weld ring 1500 may have corresponding geometries for engaging with ridge 1128. Distal portion 1200 and/or weld ring 1500 may be formed of a first material, e.g., titanium, whereas cone insert 1400 may be formed of a second material different from the first material (e.g., steel, Inconel (nickel alloy containing chromium and iron), non-metallic materials, etc.) to thereby reduce muzzle flash. As will be understood by a person having ordinary skill in the art, any of the baffles described herein, e.g., blast baffle 400, baffle 500, distal baffle 600, may formed of multiple materials, e.g., titanium and steel. Alternatively, other dissimilar materials may be used to form the inner or outer portion of the baffle. For instance, the outer portion (tubular member) may be formed from ceramic, tungsten, cobalt, carbide, and combinations thereof.

Conventional suppressors contain steel baffles, which add to the weight of the suppressor and impact balance of the firearm, potentially creating an unwieldy firearm system. However, lighter materials pose challenges as well because baffles formed from titanium, for example, can cause titanium sparking, which is an emission of visible sparks or flash from the end of the suppressor caused by the bullet closely passing a titanium surface. Accordingly, conventional suppressors that include titanium baffles may be undesirable in situations, such as low light scenarios, where both sound and visual signature must be reduced.

Using techniques described herein to form multi-material baffles can facilitate a light weight and high strength suppressor by making distal portions of the baffles (which are further from the path of the bullet) from a material such as titanium. By forming the inner portion of a baffle (i.e., the cone insert) from a heavier material (e.g., steel) and forming the outer portion of a lighter material (e.g., titanium), sound, weight, and titanium sparking can all be significantly reduced. As described in greater detail below, such multi-material baffles can be manufactured in multiple ways (e.g., through use of a weld ring 1500 or threading).

Figure 12A:
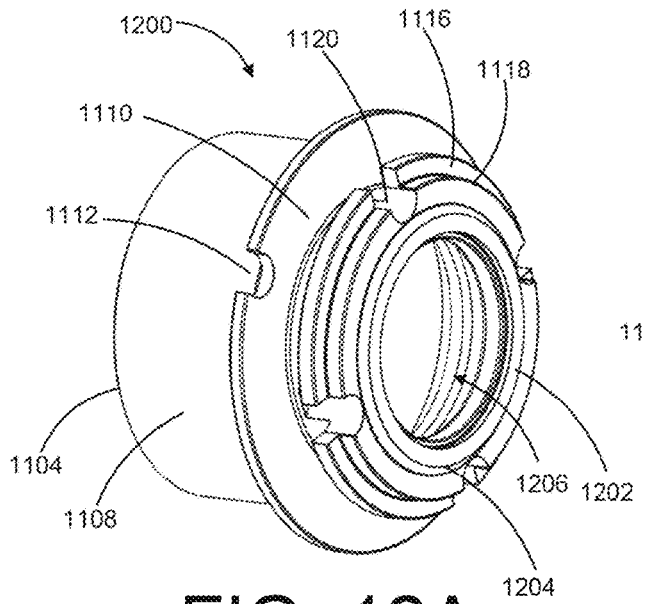
FIG. 12A depicts a perspective front view of the proximal portion of the multi-material baffle of FIG. 11A in accordance with one or more embodiments of the disclosure.
Figure 12B:
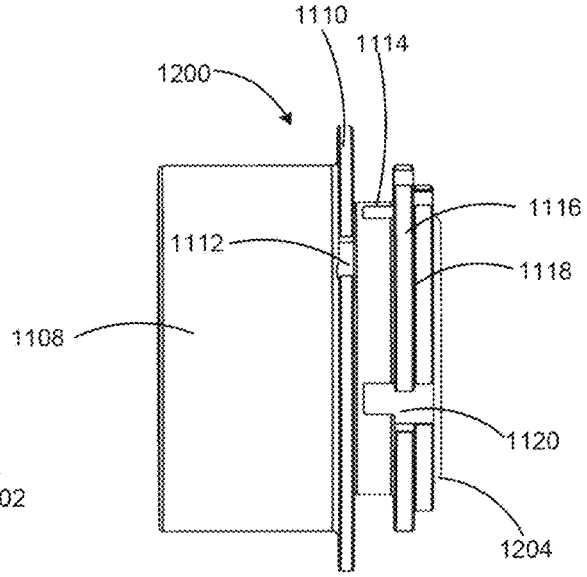
FIG. 12B depicts a side view of the proximal portion of the multi-material baffle of FIG. 11A in accordance with one or more embodiments of the disclosure.
Figure 12C:
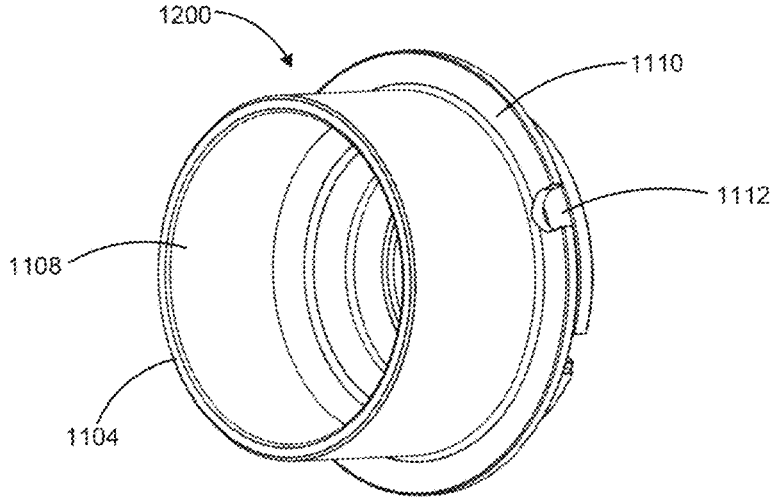
FIG. 12C depicts a perspective rear view of the proximal portion of the multi-material baffle of FIG. 11A in accordance with one or more embodiments of the disclosure.
Figure 12D:
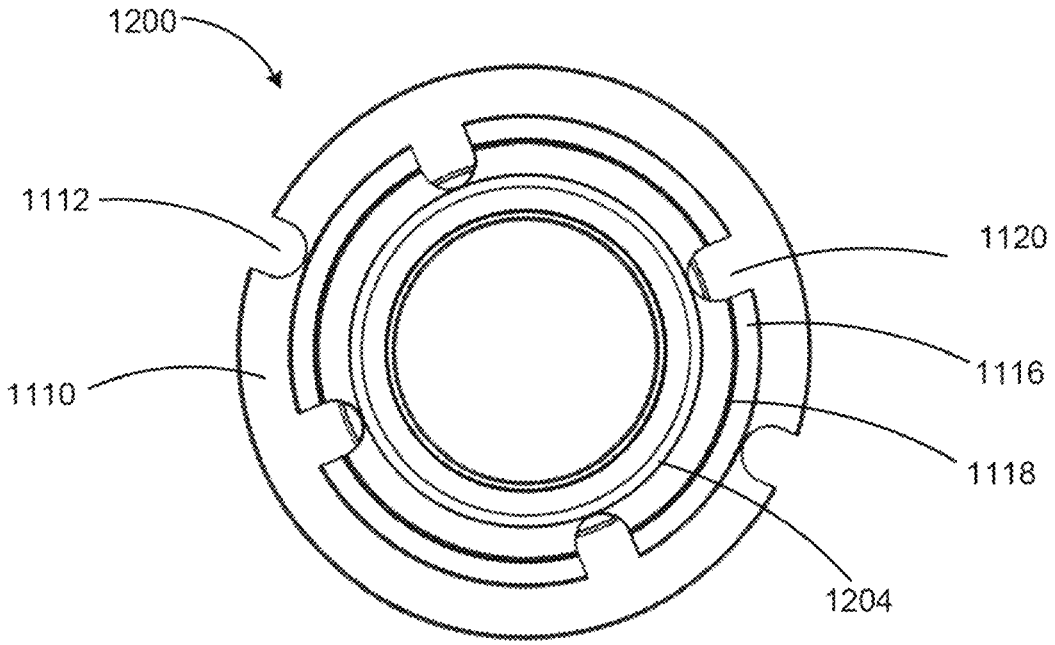
FIG. 12D depicts a front view of the proximal portion of the multi-material baffle of FIG. 11A in accordance with one or more embodiments of the disclosure.
Figure 12E:
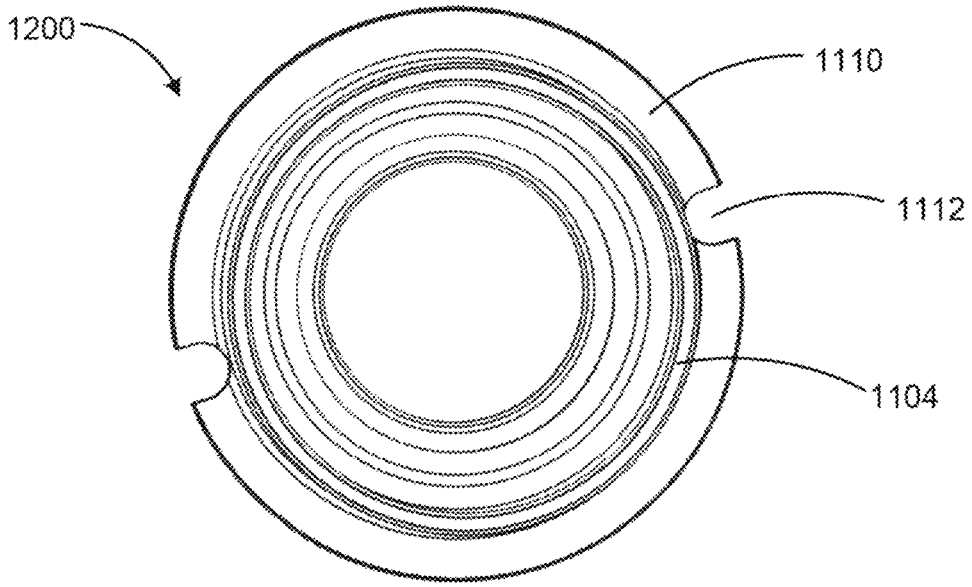
FIG. 12E depicts a rear view of the proximal portion of the multi-material baffle of FIG. 11A in accordance with one or more embodiments of the disclosure.

Referring now to FIGS. 12A to 12E, distal portion 1200 in accordance with one or more embodiments of the disclosure is provided. FIG. 12A depicts a perspective front view of distal portion 1200, FIG. 12B depicts a side view of distal portion 1200, FIG. 12C depicts a perspective rear view of distal portion 1200, FIG. 12D depicts a front view of distal portion 1200, and FIG. 12E depicts a rear view of distal portion 1200. Distal portion 1200 may have proximal end 1202, distal end 1104, and passageway 1206 extending therethrough through which a projectile may travel. In addition, distal portion 1200 may include distal portion 1108, e.g., a wall extending axially from distal end 1104 toward proximal end 1202 having a cylindrical shape, middle portion 1114, e.g., a wall extending axially from the proximal end of distal portion 1108 toward proximal end 1202 having a cylindrical shape. Proximal end 1202 may include step 1204 for engaging with ridge 1128 of cone insert 1400.

Moreover, distal portion 1200 may include proximal flange 1116 extending circumferentially along the outer surface of distal portion 1200, e.g., between proximal end 1202 and middle portion 1114. Proximal flange 1116 may include seat 1118. Seat 1118 may be formed in a single flange of proximal flange 1116, or alternatively, proximal flange 1116 may be formed by two adjacent flanges, the proximal flange of the two adjacent flanges having an outer diameter that is smaller than the distal flange of the two adjacent flanges, thereby forming seat 1118. The outermost diameter of proximal flange 1116 may be substantially equal to the outer diameter of distal portion 1108. Alternatively, the outermost proximal flange 1116 may be smaller or larger than to the outer diameter of distal portion 1108, but less than the diameter of the interior lumen of external can 800. Seat 1118 may be shaped to engage with distal end of the component of suppressor 100 disposed proximal and adjacent to baffle 1100.

In addition, distal portion 1200 may include distal flange 1110 extending circumferentially along the outer surface of distal portion 1200, e.g., between middle portion 1114 and distal portion 1108. The outer diameter of distal flange 1110 may be substantially equal to the diameter of the interior lumen of external can 800. Moreover, distal portion 1200 may include a plurality of through-wall ports 1112 circumferentially and symmetrically disposed on the outer edge of distal flange 1110. Accordingly, when baffle 1100 is disposed within external can 800, distal flange 1110 engages with the interior wall of external can 800 except for at through-wall ports 1112. As shown in FIGS. 12A to 12E, distal flange 1110 may include two through-wall ports 1112 symmetrically disposed about the central axis of distal portion 1200. As will be understood by a person having ordinary skill in the art, distal flange 1110 may include less or more than two through-wall ports 1112.

Distal portion 1200 further may include a plurality of through-wall ports 1120 circumferentially and symmetrically disposed on proximal flange 1116. As shown in FIG. 12B, ports 1120 may extend from a proximal side of proximal flange 1116, through proximal flange 1116 and through at least a portion of the outer surface of middle portion 1114 toward distal flange 1110. Accordingly, when baffle 1100 is disposed within external can 800, adjacent and distal to the adjacent baffle within external can 800, and the distal end of adjacent component is engaged with seat 1118 of proximal flange 1116, ports 1120 may provide fluid communication between the chamber formed within the interior of the proximally adjacent baffle and the chamber formed by the outer surface of the proximally adjacent baffle, external can 800 and the outer surface of baffle 1100. As shown in FIG. 12D, distal portion 1200 may include four ports 1120 symmetrically disposed about the central axis of distal portion 1200. As will be understood by a person having ordinary skill in the art, distal portion 1200 may include less or more than four ports 1120. Moreover, ports 1120 may be offset from through-wall ports 1112, to create the longest pathway for fluid to flow from ports 1120 to through-wall ports 1112.

Figure 13A:
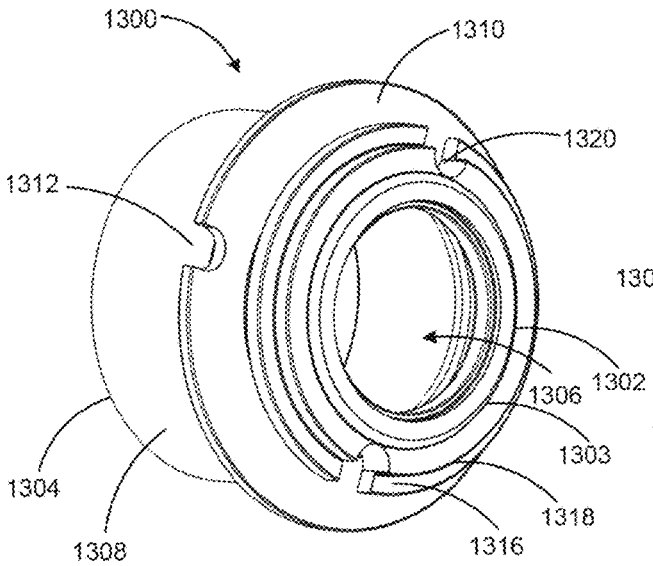
FIG. 13A depicts a perspective front view of an alternative proximal portion of the multi-material baffle of FIG. 11A in accordance with one or more embodiments of the disclosure.
Figure 13B:
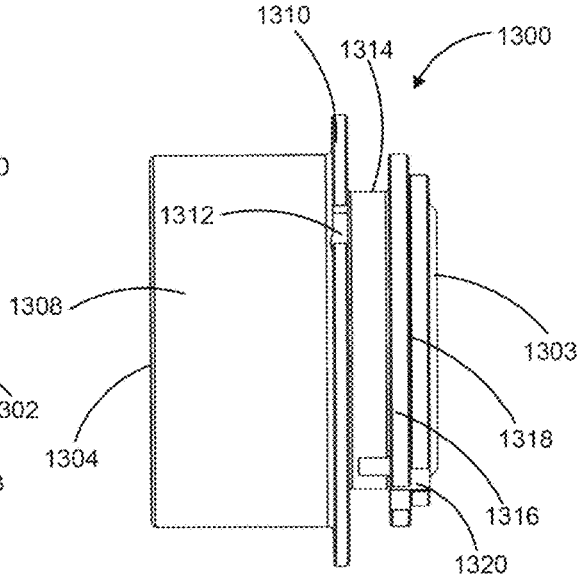
FIG. 13B depicts a side view of the proximal portion of FIG. 13A in accordance with one or more embodiments of the disclosure.
Figure 13C:
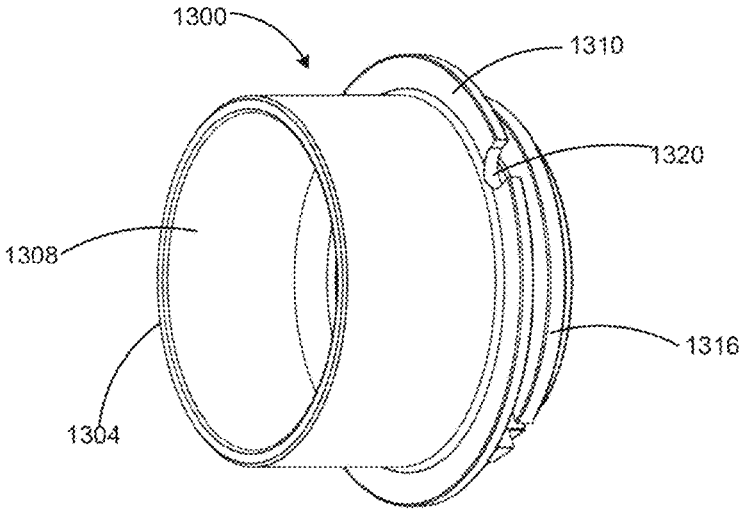
FIG. 13C depicts a perspective rear view of the proximal portion of FIG. 13A in accordance with one or more embodiments of the disclosure.
Figure 13D:
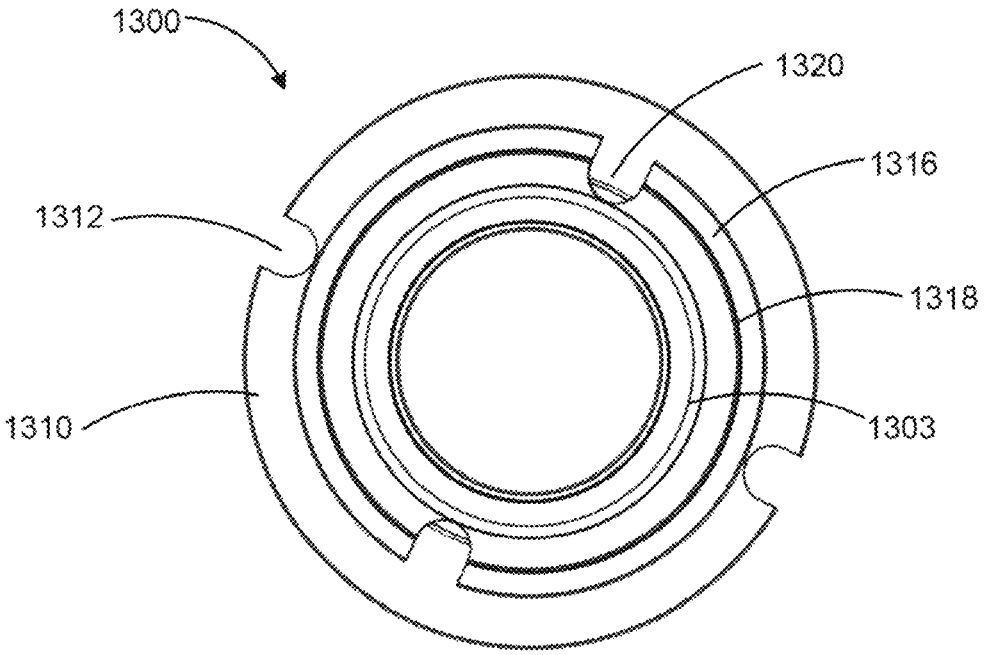
FIG. 13D depicts a front view of the proximal portion of FIG. 13A in accordance with one or more embodiments of the disclosure.
Figure 13E:
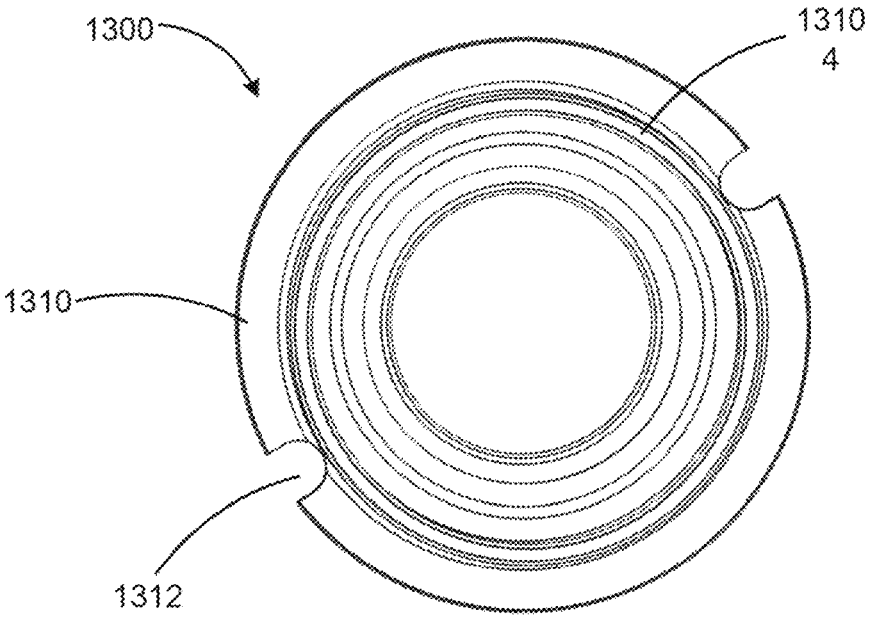
FIG. 13E depicts a rear view of the proximal portion of FIG. 13A in accordance with one or more embodiments of the disclosure.

Referring now to FIGS. 13A to 13E, distal portion 1300 in accordance with one or more embodiments of the disclosure is provided. FIG. 13A depicts a perspective front view of distal portion 1300, FIG. 13B depicts a side view of distal portion 1300, FIG. 13C depicts a perspective rear view of distal portion 1300, FIG. 13D depicts a front view of distal portion 1300, and FIG. 13E depicts a rear view of distal portion 1300. Distal portion 1300 may have proximal end 1302, distal end 1304, and passageway 1306 extending therethrough through which a projectile may travel. In addition, distal portion 1300 may include distal wall portion 1308, e.g., a wall extending axially from distal end 1304 toward proximal end 1302 having a cylindrical shape, middle portion 1314, e.g., a wall extending axially from the proximal end of distal wall portion 1308 toward proximal end 1302 having a cylindrical shape. Proximal end 1302 may include step 1303 for engaging with ridge 1128 of cone insert 1400.

Moreover, distal portion 1300 may include proximal flange 1316 extending circumferentially along the outer surface of distal portion 1300, e.g., between proximal end 1302 and middle portion 1314. Proximal flange 1316 may include seat 1318. Seat 1318 may be formed in a single flange of proximal flange 1316, or alternatively, proximal flange 1316 may be formed by two adjacent flanges, the proximal flange of the two adjacent flanges having an outer diameter that is smaller than the distal flange of the two adjacent flanges, thereby forming seat 1318. The outermost diameter of proximal flange 1316 may be substantially equal to the outer diameter of distal wall portion 1308. Alternatively, the outermost proximal flange 1316 may be smaller or larger than to the outer diameter of distal wall portion 1308, but less than the diameter of the interior lumen of external can 800. Seat 1318 may be shaped to engage with distal end of the component of suppressor 100 disposed proximal and adjacent to baffle 1100.

In addition, distal portion 1300 may include distal flange 1310 extending circumferentially along the outer surface of distal portion 1300, e.g., between middle portion 1314 and distal wall portion 1308. The outer diameter of distal flange 1310 may be substantially equal to the diameter of the interior lumen of external can 800. Moreover, distal portion 1300 may include a plurality of through-wall ports 1312 circumferentially and symmetrically disposed on the outer edge of distal flange 1310. Accordingly, when baffle 1100 is disposed within external can 800, distal flange 1310 engages with the interior wall of external can 800 except for at through-wall ports 1312. As shown in FIGS. 13A to 13E, distal flange 1310 may include two through-wall ports 1312 symmetrically disposed about the central axis of distal portion 1300. As will be understood by a person having ordinary skill in the art, distal flange 1310 may include less or more than two through-wall ports 1312.

Distal portion 1300 further may include a plurality of through-wall ports 1320 circumferentially and symmetrically disposed on proximal flange 1316. As shown in FIG. 13B, ports 1320 may extend from a proximal side of proximal flange 1316, through proximal flange 1316 and through at least a portion of the outer surface of middle portion 1314 toward distal flange 1310. Accordingly, when baffle 1100 is disposed within external can 800, adjacent and distal to the adjacent baffle within external can 800, and the distal end of adjacent component is engaged with seat 1318 of proximal flange 1316, ports 1320 may provide fluid communication between the chamber formed within the interior of the proximally adjacent baffle and the chamber formed by the outer surface of the proximally adjacent baffle, external can 800 and the outer surface of baffle 1100. As shown in FIG. 13D, distal portion 1300 may include two ports 1320 symmetrically disposed about the central axis of distal portion 1300. As will be understood by a person having ordinary skill in the art, distal portion 1300 may include less or more than two ports 1320. Moreover, ports 1320 may be offset from through-wall ports 1312, to create the longest pathway for fluid to flow from ports 1320 to through-wall ports 1312.

Figure 14A:
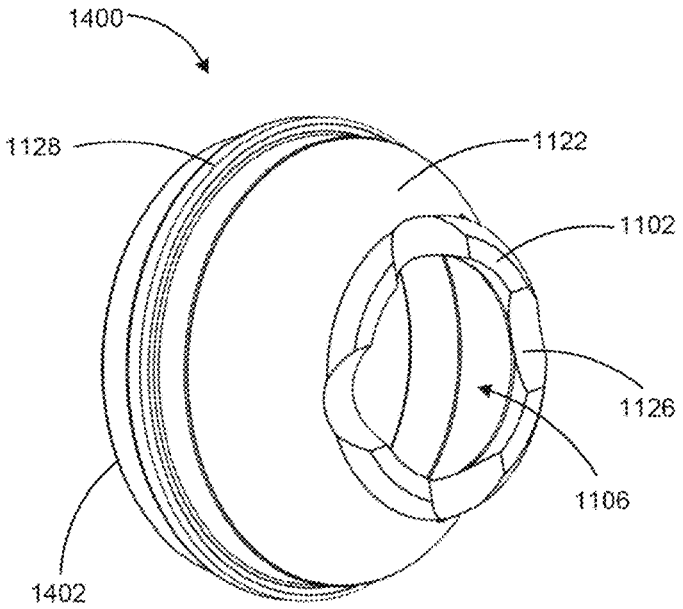
FIG. 14A depicts a perspective front view of the cone insert of the multi-material baffle of FIG. 11A in accordance with one or more embodiments of the disclosure.
Figure 14B:
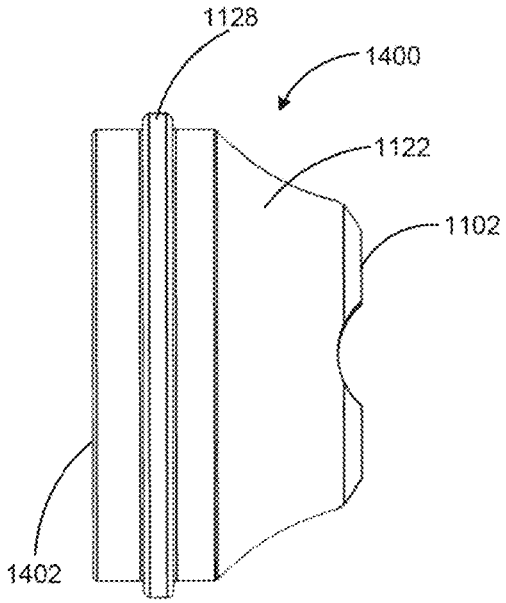
FIG. 14B depicts a side view of the cone insert of the multi-material baffle of FIG. 11A in accordance with one or more embodiments of the disclosure.
Figure 14C:
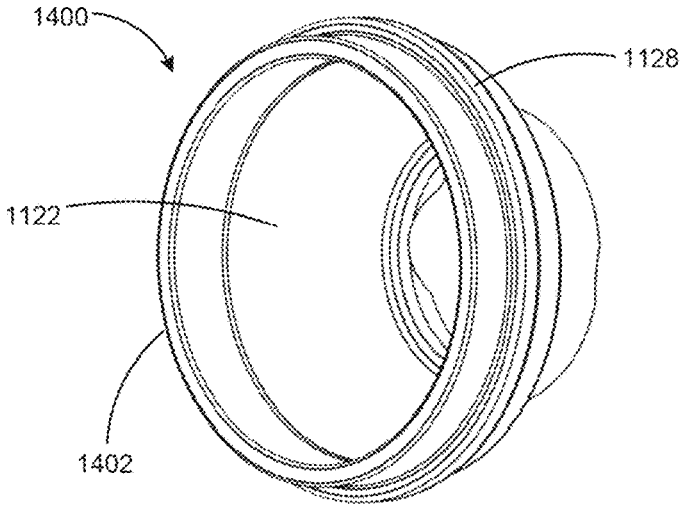
FIG. 14C depicts a perspective rear view of the cone insert of the multi-material baffle of FIG. 11A in accordance with one or more embodiments of the disclosure.
Figure 14D:
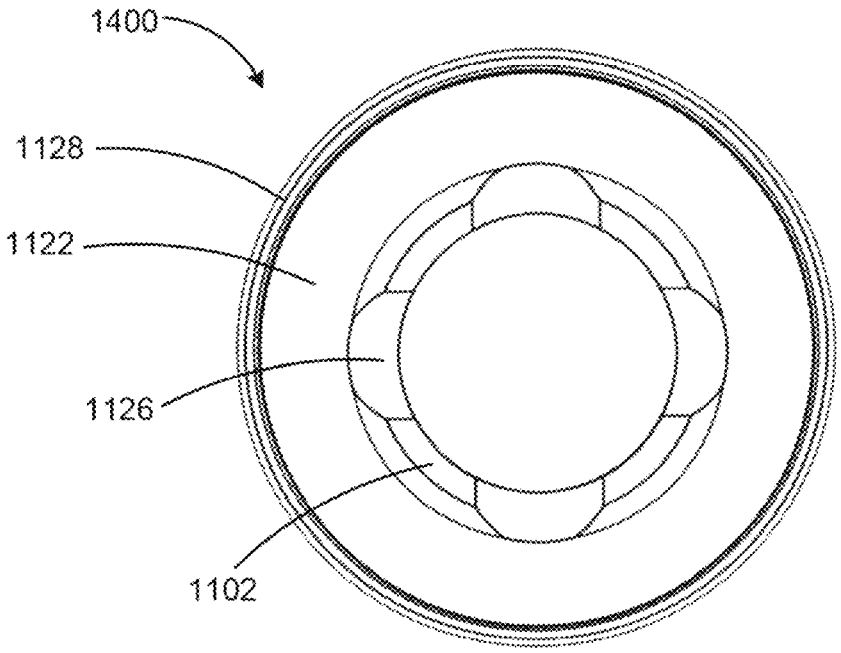
FIG. 14D depicts a front view of the cone insert of the multi-material baffle of FIG. 11A in accordance with one or more embodiments of the disclosure.
Figure 14E:
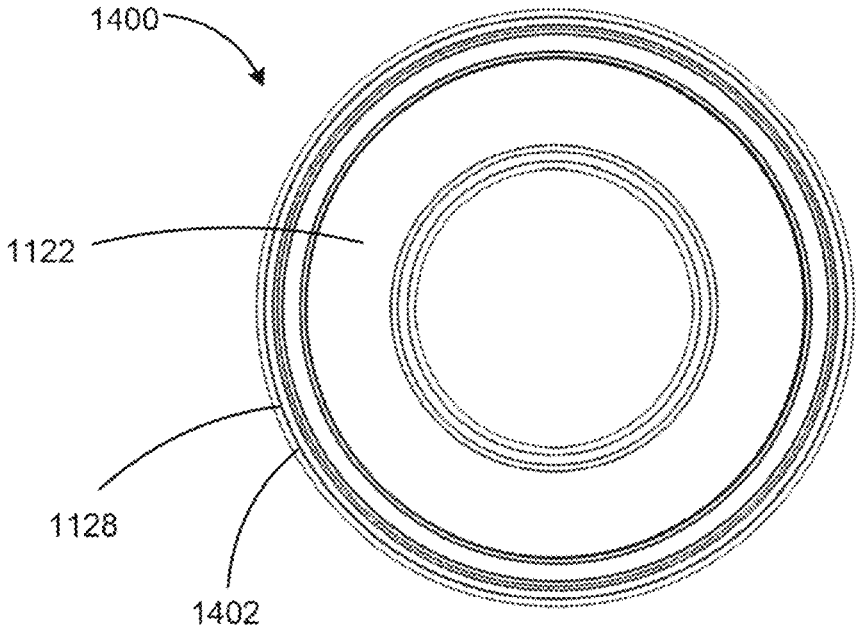
FIG. 14E depicts a rear view of the cone insert of the multi-material baffle of FIG. 11A in accordance with one or more embodiments of the disclosure.

Referring now to FIGS. 14A to 14E, cone insert 1400 in accordance with one or more embodiments of the disclosure is provided. FIG. 14A depicts a perspective front view of cone insert 1400, FIG. 14B depicts a side view of cone insert 1400, FIG. 14C depicts a perspective rear view of cone insert 1400, FIG. 14D depicts a front view of cone insert 1400, and FIG. 14E depicts a rear view of cone insert 1400. Cone insert 1400 may have proximal end 1102, distal end 1402, and passageway 1106 extending therethrough through which a projectile may travel. Cone insert 1400 may include ridge 1128 disposed circumferentially along an outer surface of a distal portion of cone insert 1440.

Moreover, cone insert 1400 may have arcuate outer surface 1122, e.g., a concave shape, extending from distal end 1402 toward proximal end 1102. For example, arcuate outer surface 1122 may have a concave curved surface that extends from a portion that extends in a direction parallel or substantially parallel to the central axis of cone insert 1400 to a portion that extends in a direction orthogonal or substantially orthogonal to the central axis of cone insert 1400 adjacent the distal portion of cone insert 1400. Arcuate outer surface 1122 may be disposed about the central axis of cone insert 1400. This arcuate outer surface can help channel gas away from the path of the bullet and into the ports disposed around the baffle. In addition, proximal end 1102 may include a plurality of notches 1126 for facilitating the redirecting the fluid flow across the arcuate outer surface 1122. Accordingly, different cone inserts having different sized passageways may be easily interchanged, thereby creating a modular baffle that permits changing the caliber of suppressor 100 simply by changing the cone insert.

Figure 15A:
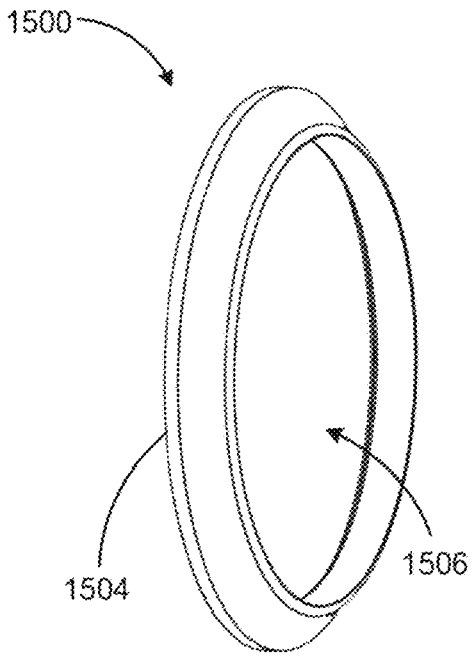
FIG. 15A depicts a perspective front view of the weld ring of the multi-material baffle of FIG. 11A in accordance with one or more embodiments of the disclosure.
Figure 15B:
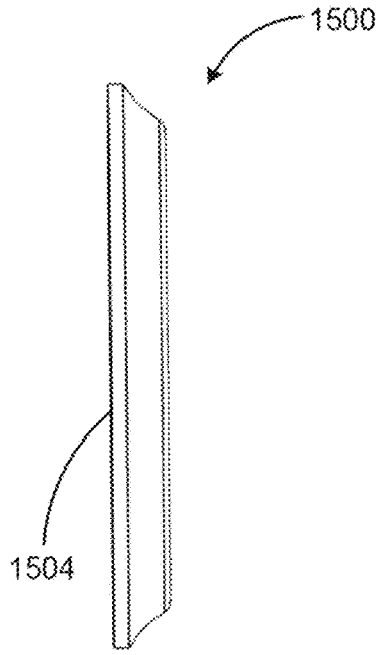
FIG. 15B depicts a side view of the weld ring of the multi-material baffle of FIG. 11A in accordance with one or more embodiments of the disclosure.
Figure 15C:
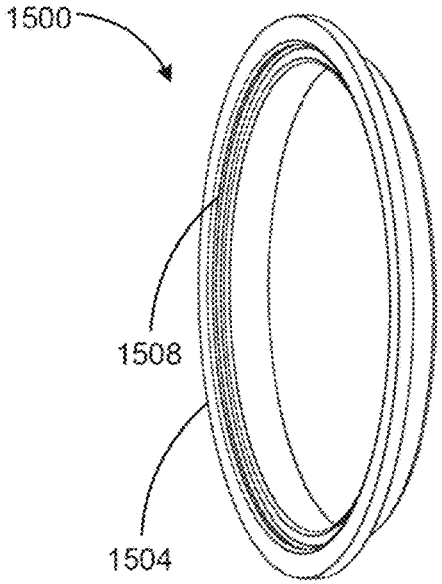
FIG. 15C depicts a perspective rear view of the weld ring of the multi-material baffle of FIG. 11A in accordance with one or more embodiments of the disclosure.
Figure 15D:
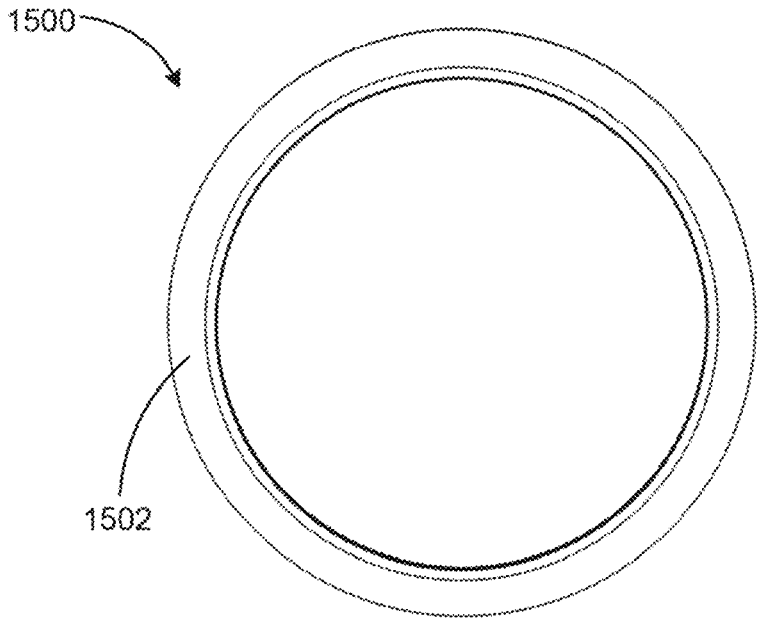
FIG. 15D depicts a front view of the weld ring of the multi-material baffle of FIG. 11A in accordance with one or more embodiments of the disclosure.
Figure 15E:
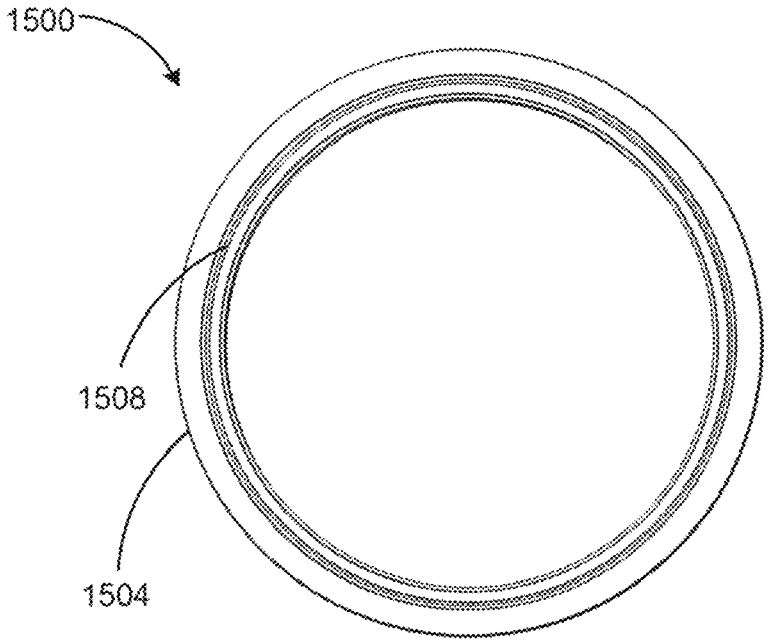
FIG. 15E depicts a rear view of the weld ring of the multi-material baffle of FIG. 11A in accordance with one or more embodiments of the disclosure.

Referring now to FIGS. 15A to 15E, weld ring 1500 in accordance with one or more embodiments of the disclosure is provided. FIG. 15A depicts a perspective front view of weld ring 1500, FIG. 15B depicts a side view of weld ring 1500, FIG. 15C depicts a perspective rear view of weld ring 1500, FIG. 15D depicts a front view of weld ring 1500, and FIG. 15E depicts a rear view of weld ring 1500. Weld ring 1500 may have proximal end 1502, distal end 1504, and passageway 1506 extending therethrough through which a projectile may travel. Distal end 1504 may include step 1508 for engaging with ridge 1128 of cone insert 1400. Accordingly, weld ring 1500 may be welded on distal portion 1200, 1300 to sandwich cone insert 1400 therebetween. Alternatively, weld ring 1500 may be coupled to distal portion 1200, 1300 using other methods including vacuum braising and/or soldering.

Figure 16A:
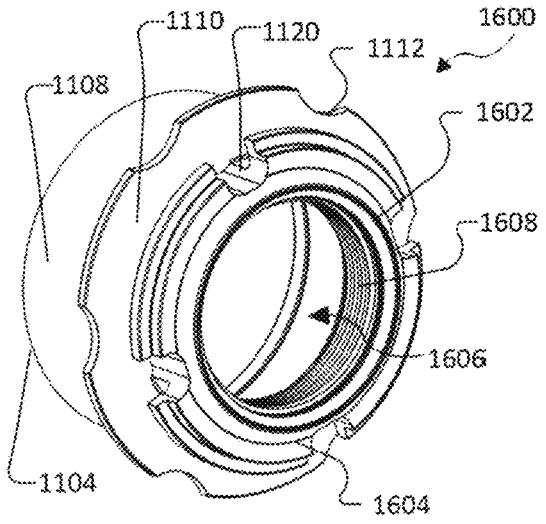
FIG. 16A depicts a perspective front view of an alternative proximal portion of a multi-material baffle in accordance with one or more embodiments of the disclosure.
Figure 16B:
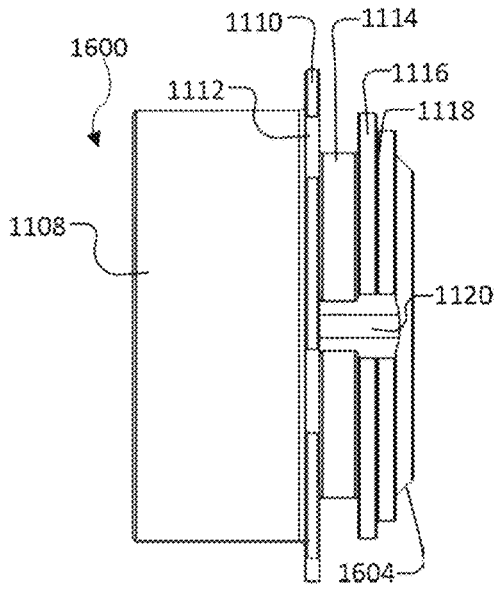
FIG. 16B depicts a side view of the proximal portion of FIG. 16A in accordance with one or more embodiments of the disclosure.
Figure 16C:
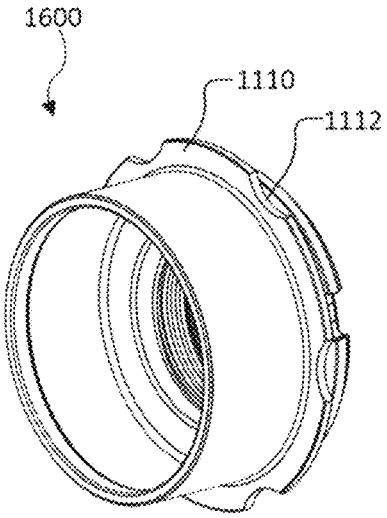
FIG. 16C depicts a perspective rear view of the proximal portion of FIG. 16A in accordance with one or more embodiments of the disclosure.
Figure 16D:
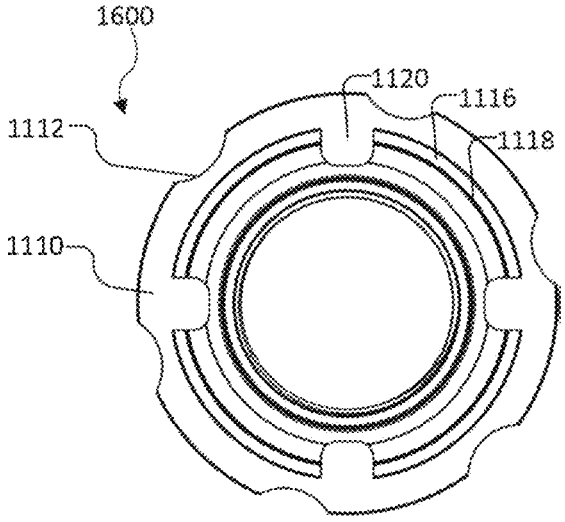
FIG. 16D depicts a front view of the proximal portion of FIG. 16A in accordance with one or more embodiments of the disclosure.

Referring now to FIGS. 16A to 16DE, distal portion 1600 in accordance with one or more embodiments of the disclosure is provided. Distal portion 1600 can be a part of a threaded baffle, for example, by receiving a threaded cone insert 1700 or flash hiding insert 1800, as described in greater detail below. FIG. 16A depicts a perspective front view of distal portion 1600, FIG. 16B depicts a side view of distal portion 1600, FIG. 16C depicts a perspective rear view of distal portion 1600, and FIG. 16D depicts a front view of distal portion 1600. Distal portion 1600 may have proximal end 1602, distal end 1104, and passageway 1606 extending therethrough through which a projectile may travel. In addition, distal portion 1600 may include distal portion 1108, e.g., a wall extending axially from distal end 1104 toward proximal end 1202 having a cylindrical shape, middle portion 1114, e.g., a wall extending axially from the proximal end of distal portion 1108 toward proximal end 1602 having a cylindrical shape. Proximal end 1602 may include a tapered ridge 1604 than can align with an outer surface of cone insert 1700.

Moreover, distal portion 1600 may include proximal flange 1116 extending circumferentially along the outer surface of distal portion 1600, e.g., between proximal end 1602 and middle portion 1114. Proximal flange 1116 may include seat 1118. Seat 1118 may be formed in a single flange of proximal flange 1116, or alternatively, proximal flange 1116 may be formed by two adjacent flanges, the proximal flange of the two adjacent flanges having an outer diameter that is smaller than the distal flange of the two adjacent flanges, thereby forming seat 1118. The outermost diameter of proximal flange 1116 may be substantially equal to the outer diameter of distal portion 1108. Alternatively, the outermost proximal flange 1116 may be smaller or larger than to the outer diameter of distal portion 1108, but less than the diameter of the interior lumen of external can 800. Seat 1118 may be shaped to engage with distal end of the component of suppressor 100 disposed proximal and adjacent to a threaded baffle having distal portion 1600.

Additionally, distal portion 1600 may include distal flange 1110 extending circumferentially along the outer surface of distal portion 1600, e.g., between middle portion 1114 and distal portion 1108. The outer diameter of distal flange 1110 may be substantially equal to the diameter of the interior lumen of external can 800. Moreover, distal portion 1600 may include a plurality of through-wall ports 1112 circumferentially and symmetrically disposed on the outer edge of distal flange 1110. Accordingly, when a baffle having distal portion 1600 is disposed within external can 800, distal flange 1110 engages with the interior wall of external can 800 except for at through-wall ports 1112. As shown in FIGS. 126 to 16D, distal flange 1110 may include six through-wall ports 1112 symmetrically disposed about the central axis of distal portion 1600. As will be understood by a person having ordinary skill in the art, distal flange 1110 may include less or more than six through-wall ports 1112.

Distal portion 1600 further may include a plurality of through-wall ports 1120 circumferentially and symmetrically disposed on proximal flange 1116. As shown in FIG. 16B, ports 1120 may extend from a proximal side of proximal flange 1116, through proximal flange 1116 and through at least a portion of the outer surface of middle portion 1114 toward distal flange 1110. Accordingly, when a baffle having distal portion 1600 is disposed within external can 800, adjacent and distal to the adjacent baffle within external can 800, and the distal end of adjacent component is engaged with seat 1118 of proximal flange 1116, ports 1120 may provide fluid communication between the chamber formed within the interior of the proximally adjacent baffle and the chamber formed by the outer surface of the proximally adjacent baffle, external can 800 and the outer surface of the baffle. As shown in FIG. 16D, distal portion 1600 may include four ports 1120 symmetrically disposed about the central axis of distal portion 1600. As will be understood by a person having ordinary skill in the art, distal portion 1600 may include less or more than four ports 1120. Moreover, ports 1120 may be offset from through-wall ports 1112, to create the longest pathway for fluid to flow from ports 1120 to through-wall ports 1112.

As described herein, distal portion 1600 may be similar to distal portions 1200 and 1300, except that distal portion 1600 contains inner threads 1608 at the proximal end of passageway 1606. Inner threads 1608 can be configured to receive outer threads 1706 of cone insert 1700 or flash hiding insert 1800. Thus, threads 1608 facilitate use a of a multi-material baffle (e.g., titanium and steel) without the use of weld ring 1500. Moreover, a distal portion 1600 can engage different threaded inserts designed for varying purposes, calibers, etc. (e.g., the cone insert 1700, flash hiding insert 1800, or others).

Figure 17A:
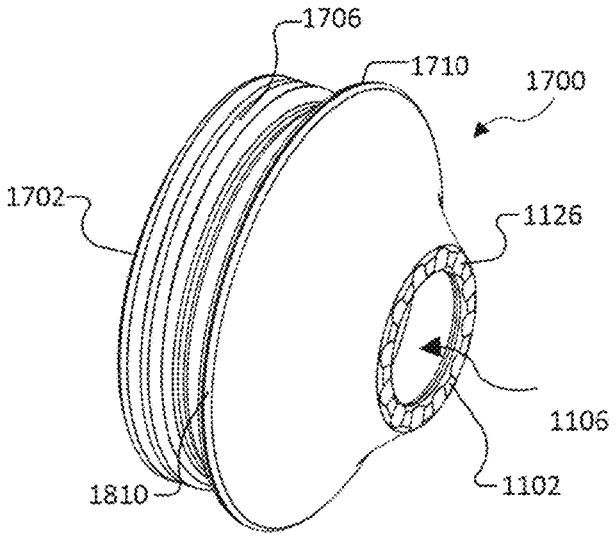
FIG. 17A depicts a perspective front view of an alternative cone insert for a multi-material baffle in accordance with one or more embodiments of the disclosure.
Figure 17B:
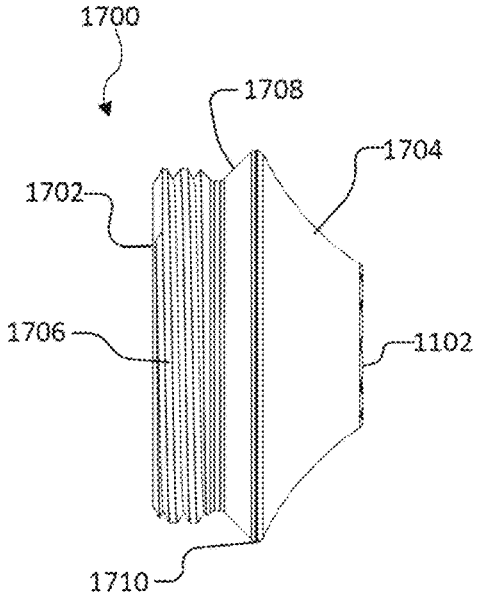
FIG. 17B depicts a side view of the cone insert of the multi-material baffle of FIG. 17A in accordance with one or more embodiments of the disclosure.
Figure 17C:
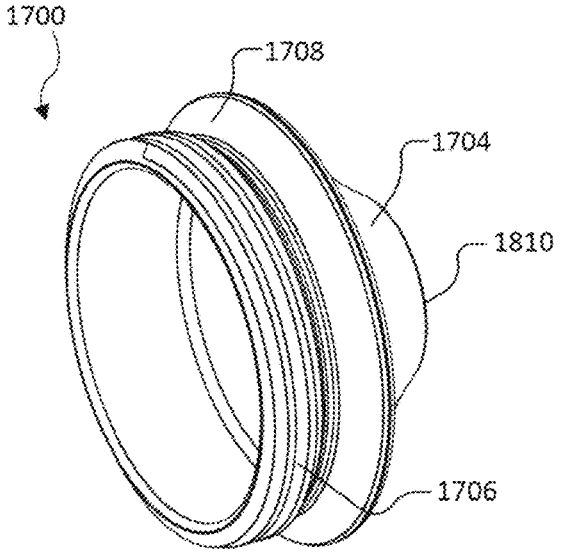
FIG. 17C depicts a perspective rear view of the cone insert of the multi-material baffle of FIG. 17A in accordance with one or more embodiments of the disclosure.
Figure 17D:
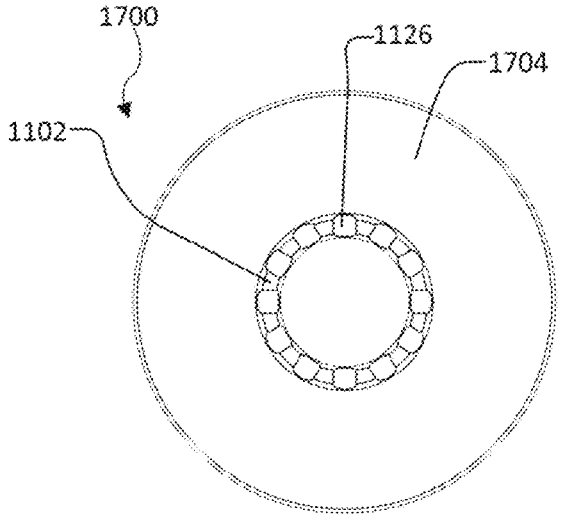
FIG. 17D depicts a front view of the cone insert of the multi-material baffle of FIG. 17A in accordance with one or more embodiments of the disclosure.

Referring now to FIGS. 17A to 17D, cone insert 1700 in accordance with one or more embodiments of the disclosure is provided. FIG. 17A depicts a perspective front view of cone insert 1700, FIG. 17B depicts a side view of cone insert 1700, FIG. 17C depicts a perspective rear view of cone insert 1700, and FIG. 17D depicts a front view of cone insert 1700. Cone insert 1700 may have proximal end 1102, distal end 1702, and passageway 1106 extending therethrough through which a projectile may travel. Cone insert 1700 may include ridge 1710 disposed circumferentially along an outer surface of cone insert 1700, between distal end 1702 and proximal end 1102. Cone insert 1700 may include angular face 1708 at the distal side of ridge 1710.

Moreover, cone insert 1700 may have an arcuate outer surface 1704, e.g., a concave shape, extending from proximal end 1102 toward distal end 1702. For example, arcuate outer surface 1704 may have a concave curved surface that extends from a portion that extends in a direction parallel or substantially parallel to the central axis of cone insert 1700 to a portion that extends in a direction orthogonal or substantially orthogonal to the central axis of cone insert 1700 adjacent the distal portion of cone insert 1700 (e.g., ridge 1710). Arcuate outer surface 1704 may be disposed about the central axis of cone insert 1700. This arcuate outer surface can help channel gas away from the path of the bullet and into the ports disposed around the baffle. In addition, proximal end 1102 may include a plurality of notches 1126 for facilitating the redirecting the fluid flow across the arcuate outer surface 1704. While FIGS. 17A through D depict a cone insert 1700 as having twelve notches 1126, embodiments having more or fewer notches are possible.

Cone insert 1700 may include external threads 1706 disposed between distal end 1702 and angular face 1708. External threads 1706 of cone insert 1700 may couple with internal threads 1608 of distal portion 1600 to form a two-piece baffle. Accordingly, different cone inserts having different sized passageways may be easily interchanged, thereby creating a modular baffle that permits changing the caliber of suppressor 100 simply by changing the cone insert. When threaded in ridge 1710 may be adjacent proximal end 1602 of distal portion 1600 of the baffle. In some embodiments, cone insert 1700 may be permanently or semi-permanently affixed to distal portion 1600. As an example, cone insert 1700 could be threaded into distal portion 1600 and then welded (for example, using a suitable version of weld ring 1500 or similar). As another example, glue or a thread-locking fluid could be used on threads 1706.

Figure 18A:
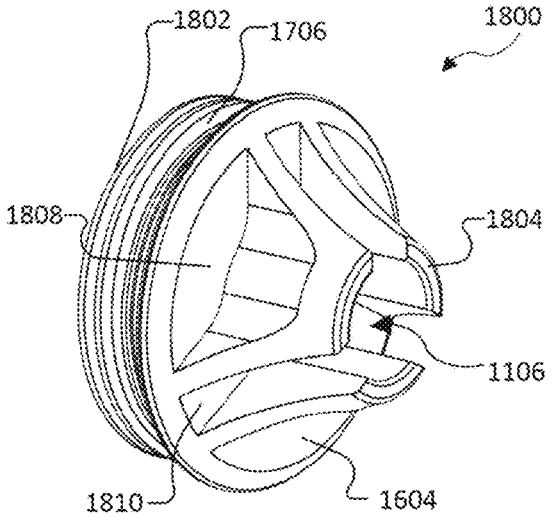
FIG. 18A depicts a perspective front view of a flash hiding insert for a multi-material baffle in accordance with one or more embodiments of the disclosure.
Figure 18B:
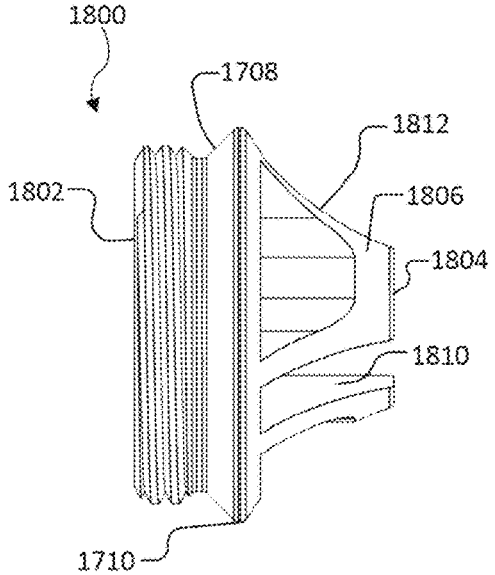
FIG. 18B depicts a side view of the flash hiding insert of the multi-material baffle of FIG. 18A in accordance with one or more embodiments of the disclosure.
Figure 18C:
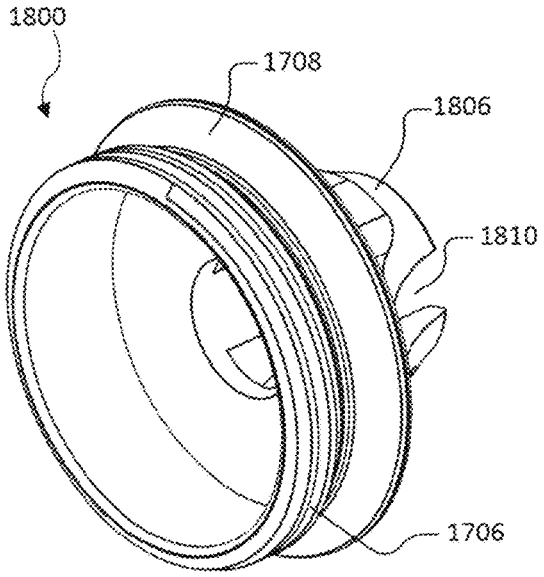
FIG. 18C depicts a perspective rear view of the flash hiding insert of the multi-material baffle of FIG. 18A in accordance with one or more embodiments of the disclosure.
Figure 18D:
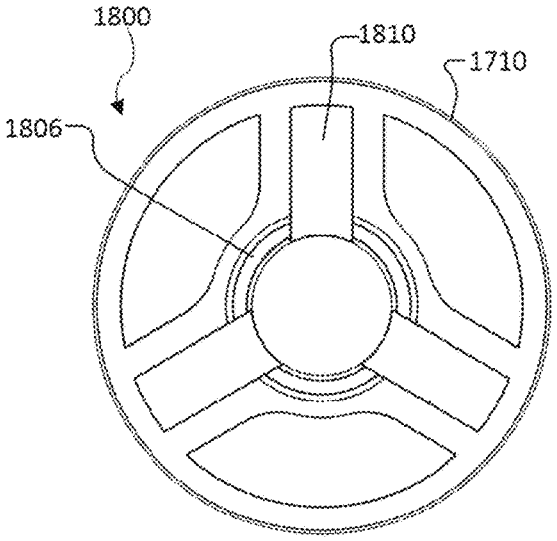
FIG. 18D depicts a front view of the flash hiding insert of the multi-material baffle of FIG. 18A in accordance with one or more embodiments of the disclosure.

Referring now to FIGS. 18A to 18D, flash hiding insert 1800 in accordance with one or more embodiments of the disclosure is provided. FIG. 18A depicts a perspective front view of flash hiding insert 1700, FIG. 18B depicts a side view of flash hiding insert 1800, FIG. 18C depicts a perspective rear view of flash hiding insert 1800, and FIG. 18D depicts a front view of flash hiding insert 1800. Flash hiding insert 1800 may have proximal end 1804, distal end 1802, and passageway 1106 extending therethrough through which a projectile may travel. Flash hiding insert 1800 may include ridge 1710 disposed circumferentially along an outer surface of flash hiding insert 1800, between distal end 1802 and proximal end 1804. Flash hiding insert 1800 may include angular face 1708 at the distal side of ridge 1710.

Moreover, flash hiding insert 1800 may have an arcuate outer surface 1812, e.g., a concave shape, extending from proximal end 1804 toward distal end 1802. For example, arcuate outer surface 1812 may have a concave curved surface that extends from a portion that extends in a direction parallel or substantially parallel to the central axis of flash hiding insert 1800 to a portion that extends in a direction orthogonal or substantially orthogonal to the central axis of flash hiding insert 1800 adjacent the distal portion of flash hiding insert 1800 (e.g., ridge 1710). Arcuate outer surface 1812 may be disposed about the central axis of flash hiding insert 1800. This arcuate outer surface can help channel gas away from the path of the bullet and into the ports disposed around the baffle. Arcuate outer surface 1812 can be separates into a plurality of prongs 1806. For example, prongs 1806 can form a three-prong flash hider that can reduce muzzle flash when a projectile is fired through passageway 1106. Prongs 1806 may include cutouts 1808 in arcuate outer surface 1812. Between prongs 1806 can be notches 1810 that extend axially through arcuate outer surface 1812 to a portion adjacent to ridge 1710.

Flash hiding insert 1800 may include external threads 1706 disposed between distal end 1702 and angular face 1708. External threads 1706 of flash hiding insert 1800 may couple with internal threads 1608 of distal portion 1600 to form a two-piece baffle. Accordingly, different flash hiding inserts having different sized passageways may be easily interchanged, thereby creating a modular baffle that permits changing the caliber of suppressor 100 simply by changing the flash hiding insert.

Figure 19:
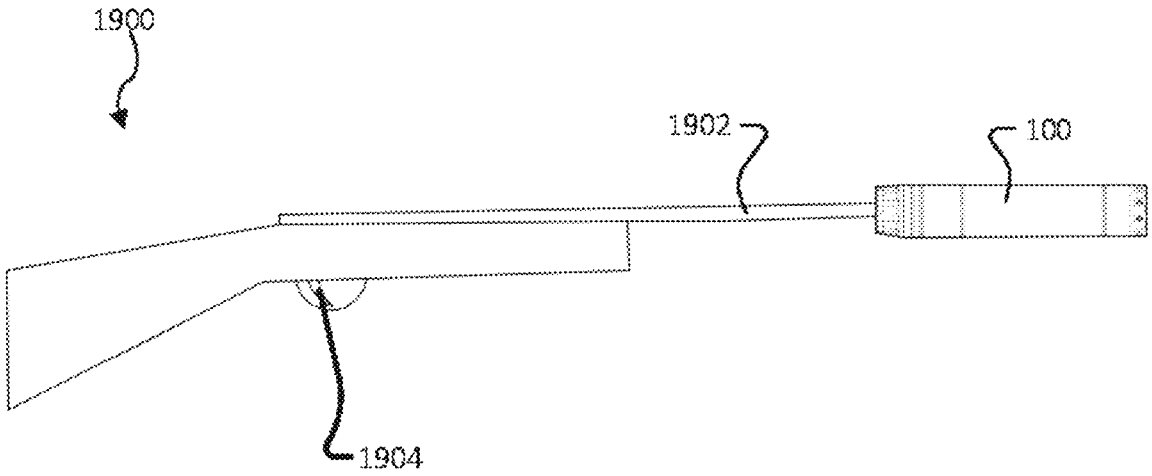
FIG. 19 depicts an exemplary firearm with a suppressor in accordance with one or more embodiments of the disclosure.

Referring now to FIG. 19, a firearm 1900 having a suppressor 100 in accordance with one or more embodiments of the disclosure is provided. Firearm 1900 can have a barrel 1902 through which a projectile may be fired. Firearm may include a fire control 1904 for selectively controlling the firing of projectiles from firearm 1900. Suppressor 100 can be connected to distal end of barrel 1902. Suppressor 100 can be coupled with barrel 1902 in a variety of ways consistent with the present disclosure. For example, internal threads of mount 200 of suppressor 100 can be coupled to external threads on the distal end of barrel 1902. As another example, the distal end of barrel 1902 may include a muzzle device that may couple with suppressor 100. Various muzzle devices and connection methods may be possible, as would be understood by one of ordinary skill in the art. As yet another example, the suppressor may be integral or permanently affixed to barrel to 1902 (e.g., through welding or similar processes).

Although certain suppressor features, functions, components, and parts have been described herein in accordance with the teachings of the present disclosure, the scope of coverage of this patent is not limited thereto. On the contrary, this patent covers all embodiments of the teachings of the disclosure that fairly fall within the scope of permissible equivalents. Likewise, while certain methodologies for directed exhaust through a suppressor are disclosed herein, the disclosed methods are not limited to the particular order of the steps in the methods described herein. Instead, one or more of the steps of one or more of the methodologies described herein may be in a different order or may not be performed at all according to some embodiments. Further, additional steps may also be completed at any point during the methods of directing exhaust through the suppressor assembly as described herein.

Conditional language, such as, among others, "can," "could," "might," or "may," unless specifically stated otherwise, or otherwise understood within the context as used, is generally intended to convey that certain implementations could include, while other implementations do not include, certain features, elements, and/or operations. Thus, such conditional language generally is not intended to imply that features, elements, and/or methods are in any way required for one or more implementations or that these features, elements, and/or methods are included or are to be performed in any particular implementation.

Many modifications and other implementations of the disclosure set forth herein will be apparent having the benefit of the teachings presented in the foregoing descriptions and the associated drawings. Therefore, it is to be understood that the disclosure is not to be limited to the specific implementations disclosed and that modifications and other implementations are intended to be included within the scope of the appended claims. Although specific terms are employed herein, they are used in a generic and descriptive sense only and not for purposes of limitation.

All references cited and/or discussed in this specification are incorporated herein by reference in their entireties and to the same extent as if each reference was individually incorporated by reference.

What is claimed is:

1. An endcap for use with a firearm suppressor, the endcap comprising:

a tubular body having a proximal end, a distal end, and a plurality of radially-oriented through-wall ports disposed on the tubular body between the proximal end and the distal end;

a rear wall coupled to the distal end of the tubular body, the rear wall defining a central aperture; and a ramp disposed entirely within the tubular body, wherein the ramp comprises:

one or more inner surfaces defining a passageway in fluid communication with the aperture; and one or more outer surfaces each having a first portion that extends in a direction parallel or substantially parallel to a central axis of the endcap, and a second portion that adjoins the rear wall and extends in a direction orthogonal or substantially orthogonal to the central axis of the endcap so that the ramp is configured to direct fluid through the aperture and through the through-wall ports during operation of the suppressor.

2. The endcap of claim 1, wherein at least one of the through-wall ports is threaded.

3. The endcap of claim 1, further comprising threads at the proximal end of the tubular body configured to engage with threads of an external can of the firearm suppressor.

4. A firearm suppressor comprising the endcap of claim 1.

5. A firearm comprising the firearm suppressor of claim 4.

* * * * *